US010350746B2

(12) United States Patent
Martinez et al.

(10) Patent No.: US 10,350,746 B2
(45) Date of Patent: Jul. 16, 2019

(54) TOOL STORAGE DEVICES

(71) Applicant: Milwaukee Electric Tool Corporation, Brookfield, WI (US)

(72) Inventors: Mark R. Martinez, Atwater, CA (US); Joel Allen, Winton, CA (US); Brandon Miller, Milwaukee, WI (US); Whitney M. Moks, Franklin, WI (US); Christopher S. Hoppe, Milwaukee, WI (US); Steven W. Hyma, Milwaukee, WI (US); Michael S. Steele, Pewaukee, WI (US); Steven G. Melnyk, Cedarburg, WI (US); Wade F. Burch, Wauwatosa, WI (US); Matthew W. Naiva, Wauwatosa, WI (US); Eric Mackey, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 15/401,304

(22) Filed: Jan. 9, 2017

(65) Prior Publication Data

US 2017/0182652 A1 Jun. 29, 2017

Related U.S. Application Data

(62) Division of application No. 14/134,468, filed on Dec. 19, 2013, now Pat. No. 9,539,722.

(Continued)

(51) Int. Cl.

*B25H 3/00* (2006.01)
*A45C 13/02* (2006.01)

(Continued)

(52) U.S. Cl.

CPC ..... *B25H 3/022* (2013.01); *A45C 3/001* (2013.01); *A45F 3/04* (2013.01); *A45F 5/021* (2013.01);

(Continued)

(58) Field of Classification Search

CPC . B25H 3/022; B25H 3/00; B25H 3/02; B25H 3/023; B25H 3/026; B65D 33/06;

(Continued)

(56) References Cited

U.S. PATENT DOCUMENTS 2,125,856 A 8/1938 De Wtt
2,145,143 A 1/1939 Trecartin (Continued)

FOREIGN PATENT DOCUMENTS

FR 2657915 8/1991

OTHER PUBLICATIONS

JR Shooting Sports, "Genuine Browning Shooting Accessories Utility Cases" website available as early as Aug. 20, 2003.

(Continued)

*Primary Examiner* — Gideon R Weinerth
(74) *Attorney, Agent, or Firm* — Reinhart Boerner Van Deuren s.c.

(57) ABSTRACT

A tool storage device and a tool box. The device may include flexible walls cooperating to define a storage area, and a rigid frame supported in the storage area and including a central portion extending in a direction from a bottom wall toward a top wall, one base portion extending from one side of the central portion, along the bottom wall and toward one side wall, and another base portion extending from an opposite side of the central portion, along the bottom wall and toward an opposite side wall. The tool box may include a body defining a storage compartment; a lid defining a groove in its outer surface to support an elongated work (Continued)

piece; and a handle engageable with a work piece supported in the groove. The lid may be attachable to the top of the body in a closed position and to the bottom in a stowed position.

12 Claims, 55 Drawing Sheets

Related U.S. Application Data

(60) Provisional application No. 61/867,438, filed on Aug. 19, 2013, provisional application No. 61/840,265, filed on Jun. 27, 2013, provisional application No. 61/839,783, filed on Jun. 26, 2013, provisional application No. 61/766,493, filed on Feb. 19, 2013, provisional application No. 61/739,473, filed on Dec. 19, 2012, provisional application No. 61/739,459, filed on Dec. 19, 2012, provisional application No. 61/739,530, filed on Dec. 19, 2012.

(51) Int. Cl.

| | |
|---|---|
| ***A45C 13/04*** | (2006.01) |
| ***B25H 3/02*** | (2006.01) |
| ***A45C 3/00*** | (2006.01) |
| ***A45F 3/04*** | (2006.01) |
| ***A45F 5/02*** | (2006.01) |
| ***B65D 33/06*** | (2006.01) |
| ***B65D 43/16*** | (2006.01) |

(52) U.S. Cl.
CPC ..... *B25H 3/00* (2013.01); *B25H 3/02* (2013.01); *B65D 33/06* (2013.01); *B65D 43/165* (2013.01); *A45F 2200/0575* (2013.01); *B25H 3/023* (2013.01); *B25H 3/026* (2013.01); *Y10S 312/902* (2013.01)

(58) Field of Classification Search
CPC ..... B65D 43/165; A45C 3/001; A45C 3/04; A45C 3/005; A45F 5/021; A45F 2200/0575; Y10S 312/902
USPC ..... 206/373; 190/109, 111, 112
See application file for complete search history.

(56) References Cited

U.S. PATENT DOCUMENTS 2,334,895 A * 11/1943 Bracken ..... A45C 7/0077 190/111
2,758,798 A * 8/1956 Schmidt ..... B25H 3/00 206/234
2,799,306 A 7/1957 Martin
2,883,184 A 4/1959 Brewington
3,177,023 A 4/1965 Nuckols
3,259,411 A 7/1966 Griffiths
3,394,955 A 7/1968 Martin
3,817,419 A 6/1974 Moller et al.
3,851,756 A 12/1974 Brown
3,924,844 A 12/1975 Bachtel, Jr.
4,105,112 A 8/1978 Graf
4,263,951 A * 4/1981 Siegel ..... A45C 3/06 150/106
D259,154 S 5/1981 White, Jr. et al.
4,278,187 A 7/1981 Luedtke
4,353,182 A 10/1982 Junkas et al.
D272,203 S 1/1984 Di Bartolo
4,890,414 A 1/1990 Bridenthal et al.
D309,981 S 8/1990 French et al.
5,035,389 A * 7/1991 Wang ..... A47G 29/08 248/224.51
5,042,193 A 8/1991 Steiner
D326,815 S 6/1992 Meisner et al.
5,165,148 A 11/1992 Fleischer et al.
D333,215 S 2/1993 Brown
D333,487 S 2/1993 Papp
5,295,742 A 3/1994 Knutson
D347,731 S 6/1994 Hayakawa et al.
5,379,887 A 1/1995 Conley, Jr.
D355,849 S 2/1995 Trower et al.
5,386,907 A 2/1995 Kahl et al.
5,394,965 A 3/1995 Kho
5,423,404 A * 6/1995 Shaw ..... A45C 3/00 190/102
5,429,287 A 7/1995 Frano
5,470,000 A 11/1995 Muñoz
D368,159 S 3/1996 Calmeise et al.
5,501,379 A 3/1996 Muñoz
5,518,139 A 5/1996 Trower et al.
D370,619 S 6/1996 Hall et al.
D374,772 S 10/1996 Hotaling et al.
5,562,208 A 10/1996 Hasler et al.
D375,834 S 11/1996 Meisner et al.
D376,477 S * 12/1996 Patterson, Jr. ..... D3/304
5,580,137 A 12/1996 Doan et al.
D377,118 S 1/1997 Carbone et al.
5,595,228 A 1/1997 Meisner et al.
D378,247 S 3/1997 Meisner et al.
5,620,212 A 4/1997 Bourne et al.
5,660,276 A 8/1997 Winnard
5,672,145 A 9/1997 Pollington et al.
D385,110 S 10/1997 Yemini
D386,903 S 12/1997 Curry et al.
D390,358 S 2/1998 Calmeise
5,732,987 A 3/1998 Wright et al.
5,755,311 A 5/1998 Younessian et al.
5,762,411 A 6/1998 Yemini
D402,106 S 12/1998 Buckingham et al.
D405,956 S 2/1999 Meisner et al.
5,915,553 A 6/1999 Brown et al.
5,915,554 A 6/1999 Hung
5,924,533 A 7/1999 Cnockaert et al.
D414,038 S 9/1999 van Rhienen
5,947,286 A * 9/1999 Chau ..... B25H 3/023 190/40
6,006,906 A 12/1999 Winnard
D418,977 S 1/2000 Streich
6,015,064 A 1/2000 Liu
6,038,747 A 3/2000 Hamilton et al.
6,073,766 A 6/2000 Winnard
6,081,695 A 6/2000 Wallace et al.
6,082,538 A 7/2000 Snider et al.
6,126,003 A * 10/2000 Brouard ..... A45C 3/00 206/372
6,167,680 B1 1/2001 Horn
6,176,559 B1 1/2001 Tiramani et al.
6,179,185 B1 * 1/2001 Dancyger ..... A45F 5/02 206/373
D437,684 S 2/2001 Streich et al.
6,203,075 B1 3/2001 Wells, Jr. et al.
6,206,063 B1 3/2001 Lin
6,213,296 B1 4/2001 Streich et al.
6,230,887 B1 5/2001 Snider
6,244,485 B1 6/2001 Holland et al.
6,244,486 B1 6/2001 Holland et al.
D447,340 S 9/2001 Snider
D447,630 S 9/2001 Snider
D448,162 S 9/2001 Snider
D449,442 S 10/2001 Snider
D449,738 S 10/2001 Snider et al.
D451,275 S 12/2001 Snider et al.
D452,071 S 12/2001 Snider
D453,624 S 2/2002 Itzkovitch
6,343,708 B1 2/2002 Riso
6,343,815 B1 2/2002 Poe
6,347,847 B1 2/2002 Tiramani et al.
D455,263 S 4/2002 Schoen et al.
6,371,320 B2 4/2002 Sagol
D459,073 S 6/2002 Lee
6,405,864 B1 6/2002 Streich et al.
6,415,924 B1 7/2002 Lee

(56) References Cited

U.S. PATENT DOCUMENTS

D462,168 S 9/2002 Klemmensen et al.
D465,923 S 11/2002 Pangerc et al.
6,478,463 B2 11/2002 Snider
D467,070 S 12/2002 Snider et al.
6,502,882 B2 1/2003 Snider et al.
D470,659 S 2/2003 Story et al.
D471,360 S 3/2003 Huang
6,527,309 B1 3/2003 Gaydos et al.
6,533,138 B2 3/2003 Chwen-Ru
D472,774 S 4/2003 Pelstring et al.
6,561,402 B2 5/2003 Holland et al.
6,614,337 B1 9/2003 Winnard
6,622,856 B2 9/2003 Gallo et al.
D480,867 S 10/2003 Snider et al.
6,675,965 B2 1/2004 Holland et al.
6,675,967 B2 1/2004 Huang
6,695,142 B2 2/2004 Chen et al.
D487,345 S * 3/2004 Brouard ..... D3/276
6,698,609 B2 3/2004 Pangerc et al.
6,722,524 B1 4/2004 Huang et al.
6,755,302 B1 6/2004 Streich et al.
6,755,448 B2 6/2004 Jackson et al.
6,761,366 B1 7/2004 Klemmensen et al.
6,789,670 B2 9/2004 Cooper et al.
6,860,059 B1 3/2005 Hoover
D505,548 S 5/2005 Yang
6,915,902 B2 7/2005 Brouard
D509,656 S 9/2005 Pangerc et al.
6,955,381 B2 10/2005 Parker et al.
6,978,890 B2 12/2005 Pangerc et al.
D516,310 S 3/2006 Brunson et al.
D516,808 S 3/2006 Brunson et al.
D516,812 S 3/2006 Pangerc et al.
7,008,031 B2 3/2006 Doerflinger et al.
7,021,637 B2 4/2006 Snider et al.
D520,746 S 5/2006 Meyer et al.
7,048,133 B2 5/2006 Pangerc et al.
7,108,131 B2 9/2006 Dreher et al.
7,121,407 B2 10/2006 Hurt et al.
7,158,376 B2 1/2007 Richardson et al.
7,225,923 B2 6/2007 Hallee et al.
7,228,983 B2 6/2007 Pangerc et al.
7,237,673 B2 7/2007 Wikle et al.
7,237,688 B2 7/2007 Pangerc et al.
7,243,793 B2 * 7/2007 Ho ..... B25H 3/023 206/349
7,246,704 B2 7/2007 Brunson et al.
7,314,134 B2 * 1/2008 Redzisz ..... A45C 13/04 206/372
7,316,309 B2 1/2008 Streich et al.
7,322,470 B2 1/2008 Brunson
7,326,428 B2 2/2008 Weir
7,334,680 B2 * 2/2008 Cunningham ..... B25H 3/023 206/372
D563,669 S 3/2008 Bosak et al.
7,357,250 B2 4/2008 Hagemann et al.
7,357,268 B2 4/2008 Yang
7,367,451 B2 5/2008 Pendergraph et al.
7,370,891 B1 5/2008 Schmitt et al.
D572,479 S 7/2008 Buck et al.
D572,480 S 7/2008 Buck et al.
7,401,698 B2 7/2008 Dost et al.
7,401,700 B2 7/2008 Dost et al.
7,418,846 B2 9/2008 James et al.
D588,811 S 3/2009 Wenchel et al.
D589,703 S 4/2009 Wenchel et al.
7,540,364 B2 6/2009 Sanderson
7,552,560 B2 6/2009 Hoover
7,552,950 B2 6/2009 Scheffy et al.
D599,112 S 9/2009 Wenchel et al.
D600,015 S 9/2009 Wenchel et al.
D600,912 S 9/2009 Brunner
D601,797 S 10/2009 Wenchel et al.
7,600,640 B2 10/2009 Hallee et al.
D605,403 S 12/2009 Santamarina et al.
D608,094 S 1/2010 Concari et al.
D609,911 S 2/2010 Twig
D609,913 S 2/2010 Landau
7,661,530 B1 2/2010 Hewitt
D613,507 S * 4/2010 Brouard ..... D3/315
D616,200 S 5/2010 Riedel et al.
D618,911 S 7/2010 Brunner
7,780,051 B2 * 8/2010 Godshaw ..... A45C 3/00 206/372
D624,317 S 9/2010 Wenchel et al.
D627,968 S 11/2010 Brunner
7,837,053 B2 11/2010 Arnett et al.
D629,607 S 12/2010 Sabbag et al.
7,845,653 B2 12/2010 Katz
7,854,321 B2 12/2010 Twig et al.
D630,435 S 1/2011 Brunner
D630,851 S 1/2011 Landau et al.
7,874,328 B2 1/2011 Dancyger
7,883,096 B2 2/2011 Katz et al.
D635,769 S 4/2011 Sosnovsky
D636,996 S 5/2011 Kokawa et al.
D637,812 S 5/2011 Horiyama et al.
7,938,412 B2 5/2011 Katz
D639,554 S 6/2011 Sosnovsky et al.
D641,552 S 7/2011 Sosnovsky
7,984,820 B2 7/2011 Dancyger
D647,301 S 10/2011 Sosnovsky
D648,532 S 11/2011 Sosnovsky
D648,533 S 11/2011 Sosnovsky
D649,350 S 11/2011 Shitrit
8,056,943 B2 11/2011 Scheffy et al.
8,061,536 B2 11/2011 Lin et al.
D649,783 S 12/2011 Brunner
8,132,819 B2 3/2012 Landau et al.
8,152,037 B2 4/2012 Sabbag
D661,858 S 6/2012 Lifshitz et al.
D661,903 S 6/2012 Kokawa et al.
8,191,910 B2 6/2012 Landau et al.
D664,354 S 7/2012 Crevling, Jr. et al.
8,210,387 B2 7/2012 Twig et al.
8,267,245 B2 9/2012 Kotula et al.
8,267,247 B1 9/2012 Horiyama
8,272,628 B2 9/2012 Winnard
D668,867 S 10/2012 Yamamot
D668,868 S 10/2012 Lehovetzki
D668,869 S 10/2012 Yamamoto et al.
D670,500 S 11/2012 Sosnovsky
D672,555 S 12/2012 Shitrit
8,327,576 B2 12/2012 Sellers
8,328,247 B2 12/2012 Tonelli
D873,774 1/2013 Neuhaus et al.
8,376,177 B2 2/2013 Castner et al.
8,403,141 B2 * 3/2013 Williams ..... A45C 13/02 190/124
8,434,617 B1 5/2013 Wang
8,469,195 B2 6/2013 Gosselink et al.
8,505,729 B2 8/2013 Sosnovsky et al.
8,561,954 B2 * 10/2013 Padilla ..... E06C 7/14 182/122
8,657,307 B2 2/2014 Lifshitz et al.
D701,696 S 4/2014 Shitrit et al.
D714,059 S * 9/2014 Blackwell ..... D3/304
8,833,557 B1 * 9/2014 Gwynn, Jr. ..... B25H 3/022 206/372
D744,750 S 12/2015 Sabbag et al.
D750,890 S 3/2016 Quehl
9,345,301 B2 * 5/2016 Brouard ..... A45C 13/36
D783,287 S * 4/2017 Swartzel ..... D3/305
2002/0014507 A1 2/2002 Snider et al.
2002/0043534 A1 4/2002 Uke
2002/0074332 A1 6/2002 Sagol
2002/0096545 A1 * 7/2002 Chang ..... A45F 5/02 224/271
2002/0125160 A1 9/2002 Itzkovitch
2002/0170933 A1 * 11/2002 Martin ..... A45F 5/02 224/197
2003/0042093 A1 3/2003 Godshaw et al.
2003/0075468 A1 4/2003 Story et al.

(56) References Cited

U.S. PATENT DOCUMENTS

2004/0065573 A1* 4/2004 Brouard ..... A45C 13/02 206/373
2004/0112777 A1 6/2004 Huang
2005/0109650 A1 5/2005 Huang
2006/0017293 A1 1/2006 Tonelli
2006/0124505 A1 6/2006 Hanson
2006/0144732 A1 7/2006 Kaplan et al.
2006/0201834 A1 9/2006 Lutz
2007/0137960 A1 6/2007 Redzisz
2007/0194543 A1 8/2007 Duvigneau
2007/0241113 A1 10/2007 Williams
2007/0241158 A1* 10/2007 Shima ..... A45C 13/02 224/663
2008/0017537 A1 1/2008 Inskeep et al.
2008/0035508 A1 2/2008 Streich et al.
2008/0035510 A1 2/2008 Brunson
2008/0067206 A1 3/2008 Kuhn
2008/0152944 A1 6/2008 Bonini et al.
2008/0164842 A1 7/2008 Bergner
2008/0169739 A1* 7/2008 Goldenberg ..... B25H 3/04 312/244
2008/0179370 A1* 7/2008 Williams ..... A45C 13/02 224/682
2008/0230416 A1* 9/2008 Brouard ..... B25H 3/02 206/372
2009/0008281 A1* 1/2009 Williams ..... B25H 3/00 206/373
2009/0080809 A1 3/2009 Pham et al.
2009/0145866 A1* 6/2009 Panosian ..... A47F 5/0838 211/85.15
2009/0211932 A1 8/2009 Schmitt et al.
2009/0211934 A1* 8/2009 McKenzie ..... B25H 3/02 206/373
2009/0236810 A1 9/2009 Anderson
2009/0250365 A1 10/2009 Goto et al.
2009/0277937 A1* 11/2009 Sabbag ..... B25H 3/00 224/236
2009/0294237 A1* 12/2009 Sisitsky ..... A45C 1/024 190/103
2010/0012538 A1 1/2010 Brunner
2010/0012655 A1 1/2010 Dathy
2010/0033325 A1 2/2010 Vilkomirski et al.
2010/0133304 A1* 6/2010 Williams ..... A45C 13/02 224/191
2010/0224527 A1 9/2010 Huang
2010/0258465 A1 10/2010 Gomas
2011/0084075 A1 4/2011 Arnett et al.
2011/0094910 A1 4/2011 Fleury et al.
2011/0132046 A1 6/2011 Tonelli
2011/0174648 A1 7/2011 Huang et al.
2011/0268374 A1 11/2011 Hotta et al.
2012/0018330 A1 1/2012 Kato et al.
2012/0055894 A1* 3/2012 Cabana ..... A47F 7/12 211/85.3
2012/0152944 A1 6/2012 Vilkomirski et al.
2012/0206907 A1 8/2012 Seidel
2012/0216928 A1* 8/2012 Groover ..... A45C 1/024 150/110
2012/0257379 A1 10/2012 Herr et al.
2012/0267374 A1 10/2012 Kotula et al.
2012/0292213 A1 11/2012 Brunner
2012/0312708 A1 12/2012 Roehm et al.
2012/0317933 A1 12/2012 Crull
2012/0318792 A1 12/2012 Larson et al.
2012/0326406 A1 12/2012 Lifshitz et al.
2012/0326669 A1 12/2012 Horiyama et al.
2013/0007979 A1 1/2013 Wolfe et al.
2013/0186795 A1 7/2013 Borrelli
2014/0102928 A1 4/2014 Sabbag et al.
2014/0190852 A1* 7/2014 Kinskey ..... B25H 3/022 206/374
2015/0237992 A1* 8/2015 Kinskey ..... A45F 3/005 224/681
2016/0100661 A1* 4/2016 Redzisz ..... B25H 3/023 280/47.17
2018/0000234 A1* 1/2018 White ..... B25H 3/00

OTHER PUBLICATIONS

SKB cases, I Series Indestructible Catalog (2010) 16 pages.
Barska, "Barska Loaded Gear HD-400 Watertight Dry Box" website available as early as Mar. 13, 2013.

* cited by examiner

Fig. 2A
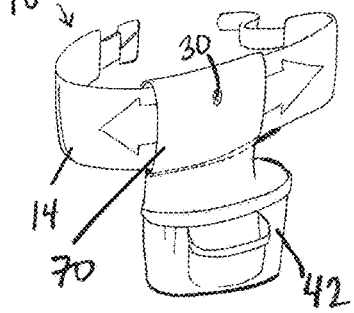
Fig. 2B
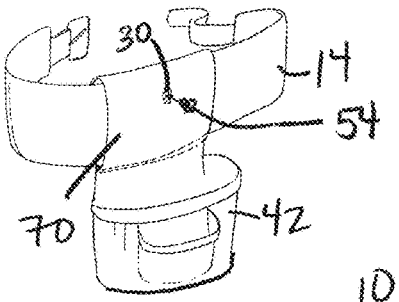
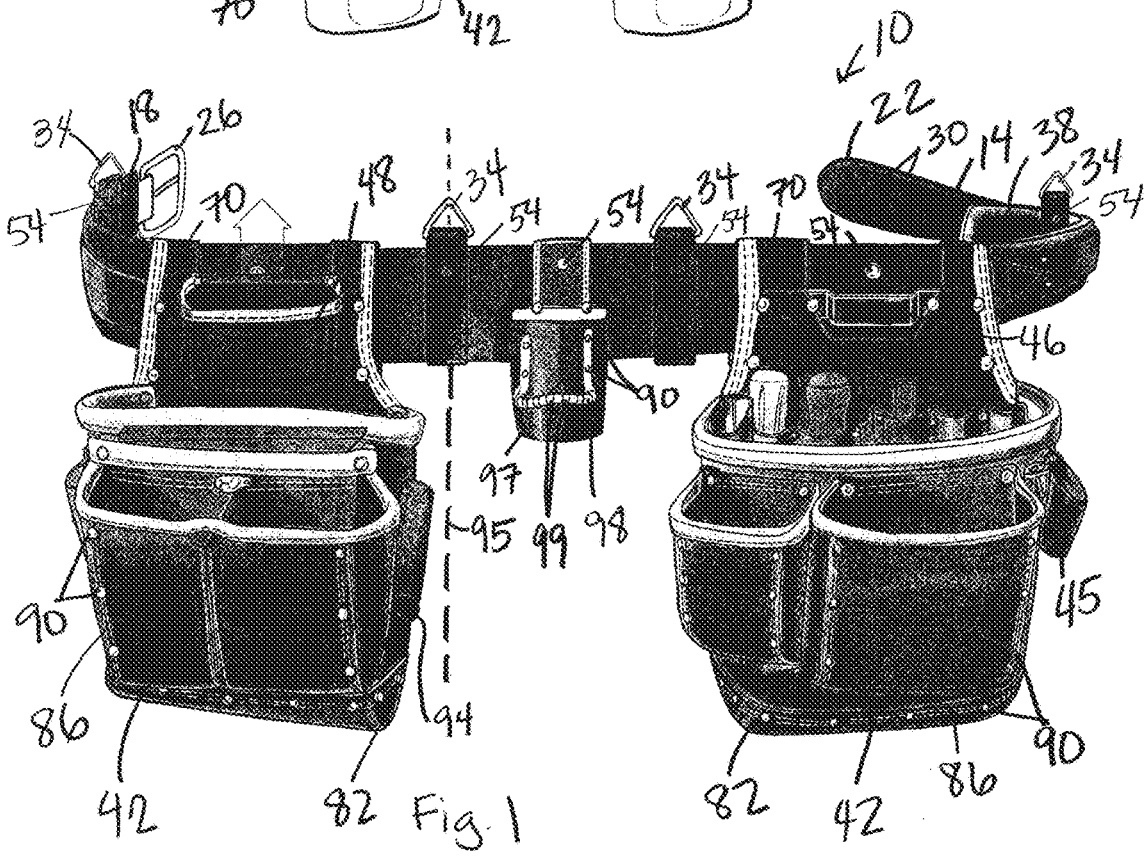
Fig. 1

TOOL STORAGE DEVICES

CROSS-REFERENCE TO RELATED APPLICATIONS

This application is a divisional of co-pending U.S. patent application Ser. No. 14/134,468 filed Dec. 19, 2013, which claims priority to U.S. Provisional Patent Application No. 61/739,459, filed Dec. 19, 2012, to U.S. Provisional Patent Application No. 61/739,473, filed Dec. 19, 2012, to U.S. Provisional Patent Application No. 61/739,530, filed Dec. 19, 2012, to U.S. Provisional Patent Application No. 61/766,493, filed Feb. 19, 2013, to U.S. Provisional Patent Application No. 61/839,783, filed Jun. 26, 2013, to U.S. Provisional Patent Application No. 61/840,265, filed Jun. 27, 2013, and to U.S. Provisional Patent Application No. 61/867,438, filed Aug. 19, 2013, the entire contents of all of which are hereby incorporated by reference.

FIELD OF THE INVENTION

The present invention relates to tool storage devices, including tool boxes, tool bags, tool belts, etc.

SUMMARY OF THE INVENTION

Tool storage devices, such as tool boxes, belts, pouches, totes, and bags, are most commonly used to conveniently store and organize tools and accessories. Tools and accessories are often transported between worksites, so portability is an important design consideration for tool storage devices. Durability is also an important factor because tool storage devices may be used in various terrains and in various weather conditions at worksites. Finally, accessibility is another important design consideration because tools and/or accessories that are difficult to access or remove from the tool storage device at the worksite can cause project delays, increased cost, and aggravation.

In one independent embodiment, a tool storage device may generally include flexible walls cooperating to define a storage area to receive tools, the walls including a bottom wall, a top wall and a plurality of side walls extending between the bottom wall and the top wall; a rigid frame supported in the storage area and including a central portion extending in a direction from the bottom wall toward the top wall, a first base portion extending from one side of the central portion, along the bottom wall and toward one side wall, and a second base portion extending from an opposite side of the central portion, along the bottom wall and toward an opposite side wall; and a handle directly connected to the central portion and engageable by a user In another independent embodiment, a tool box may generally include a body including a bottom wall and side walls extending from the bottom and cooperating to define a storage compartment, the bottom wall having an outer periphery, the side walls having a top edge; and a lid movable relative to the body, the lid having a rim engageable with the top edge of the side walls in a closed position to close the storage area, the lid being movable from the closed position toward an open position to permit access to the storage compartment, the lid having an attachment portion located inwardly of the rim and engageable with the outer periphery of the bottom wall to retain the lid on the bottom wall in a stowed position.

In yet another independent embodiment, a tool box may generally include a body defining a storage compartment; a lid movable relative to the body between an open position to permit access to the storage compartment and a closed position to close the storage compartment, the lid having an outer surface, opposite end walls and a length defined between the opposite end walls, a groove being defined in the outer surface, the groove extending the length of the lid and opening through the end walls, the groove being configured to support an elongated work piece; and a handle pivotally coupled to the lid and extending along an axis parallel to the length of the lid, the handle being pivotable to engage a work piece supported in the groove.

In a further independent embodiment, a tool box may generally include a body defining a storage compartment; a lid movable relative to the body between an open position to permit access to the storage compartment and a closed position to close the storage compartment, the lid having an inner surface facing toward the storage compartment in the closed position; a power tool battery charger; and a mounting arrangement between the lid and the battery charger to mount the battery charger to the inner surface of the lid in an operational position.

In some constructions, the mounting arrangement includes a projection on one of the inner surface of the lid and the battery charger and a recess defined on the other of the inner surface of the lid and the battery charger, the projection being engageable in the recess to mount the charger to the lid. In some constructions, the projection is provided on the inner surface of the lid, and the recess is defined on the charger. In such constructions, the inner surface of the lid may define a boss, and a separate projection (e.g., a fastener) is supported by the boss. In some constructions, the mounting arrangement includes at least two projections and complementary recesses.

In another independent embodiment, a tool storage system may generally include a first tool box have a bottom surface and a top surface, a second tool box having a bottom surface and a top surface and a connecting arrangement provided between the first tool box and the second tool box and operable to connect one tool box on top of the other tool box, the connecting arrangement including a plurality of projections on one of the bottom surface and the top surface of each tool box and a plurality of complementary recesses on the other of the bottom surface and the top surface of each tool box, the projections being engageable in the recesses to connect the tool boxes.

In some constructions, the first tool box has a first length, and the second tool box has a different second length, the projections and the recesses being arranged on the first tool box and the second tool box to connect the tool boxes in at least two spaced apart locations along the length of the tool boxes. In some constructions, a third tool box has a third length different than the first length and the second length, and the projections and recesses are arranged on the tool boxes to selectively connect the second tool box to the first tool box and the third tool box to the first tool box in at least two spaced apart locations along the length of the tool boxes. In such constructions, the third tool box is also connectable to the second tool box in at least two spaced apart locations along the length of the tool boxes.

In yet another independent embodiment, a tool box may generally include a body defining a storage compartment; a lid movable relative to the body between an open position to permit access to the storage compartment and a closed position to close the storage compartment, the lid having opposite end walls and a lid length defined between the opposite end walls; and a handle extending along an axis parallel to the length of the lid and having a handle length, the handle having a grip portion engageable by a user to carry the tool box, the grip portion having a grip length, at least one of the ratio of the handle length to the lid length being between about 0.55 and about 0.35 and the ratio of the grip length to the lid length being between about 0.50 and about 0.30.

In a further independent embodiment, a tool storage device may generally include a rigid container having a generally square cross-section, the container including a bottom wall and side walls extending from the bottom wall and cooperating to define a storage area, each of two opposite side walls defining a groove; and a divider including opposite side edges, each receivable in an associated groove to connect the divider to the container, the divider, when connected dividing the storage area into a first area and a second area; the divider including a handle to facilitate removal of the divider from the container.

In another independent embodiment, a tool storage device may generally include a container defining a storage area and including at least one wall defining a plurality of slots; and an insert including a rigid body, organizers including at least one pocket and loop attached to the body, and tongues insertable into complementary slots in the wall to connect the insert to the container.

In yet another independent embodiment, a tool box may generally include a body defining a storage compartment; a lid movable relative to the body between an open position to permit access to the storage compartment and a closed position to close the storage compartment; and at least one latch assembly operable to releasably retain the lid in the closed position. The latch assembly may include a latch body pivotally coupled to the lid, and a latch member pivotally coupled to the latch body and including a latch portion, with the lid in a closed position, the latch body being pivotable relative to the lid and the latch member being pivotable relative to the latch body between a latch position, in which the latch portion is engageable with the body to releasably retain the lid in the closed position, and a release position, in which the latch portion is disengaged from the body.

Other independent features and independent aspects of the invention will become apparent by consideration of the following detailed description, claims and accompanying drawings.

BRIEF DESCRIPTION OF THE DRAWINGS

FIG. 1 is a front perspective view of a tool belt according to one independent embodiment.

FIG. 2A is a front perspective view of a tool pouch for use with the tool belt of FIG. 1.

FIG. 2B is a front perspective view of another tool pouch for use with the tool belt of FIG. 1.

Figure 3:
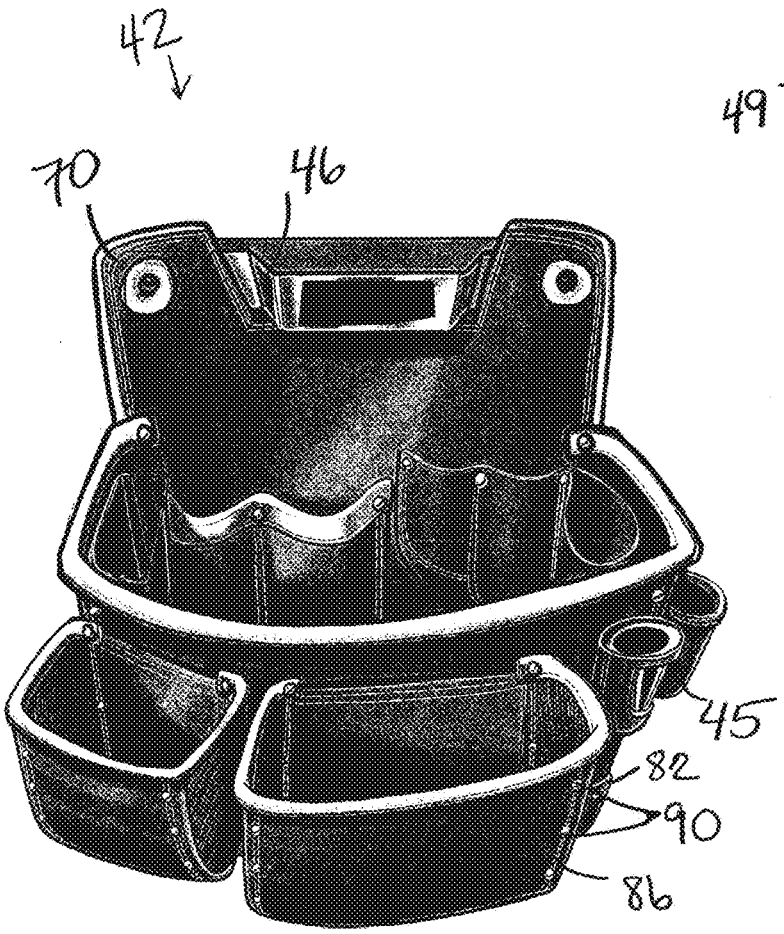
FIG. 3 is front perspective view of a tool pouch compatible with the tool belt shown in FIG. 1.
Figure 4:
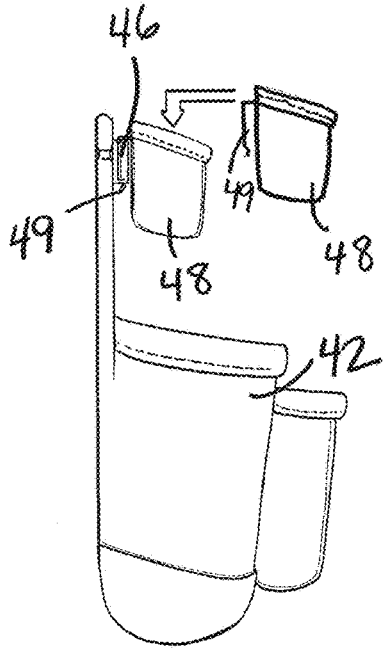
FIG. 4 is a side view of a portion of the tool pouch shown in FIG. 3 and illustrates a tool pocket.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate a tool carrier or tool belt 10 and related components. The illustrated tool belt 10 is capable of storing tools and accessories in an organized manner, as well as providing increased accessibility to a user. The tool belt 10 includes a belt or waist strap 14 having a first end 18 and a second end 22. As illustrated, the first end 18 includes a double tongue roller buckle 26 and the second end 22 includes a plurality of apertures 30 configured to mate with the buckle 26 (a tang buckle). However, in other embodiments, the buckle and apertures 30 may be reversed. In still other embodiments, another suitable closure mechanism, such as a hook and loop fastener, a snap buckle, a clip buckle, etc., may be provided. Clips 34 are positioned along the length of the belt 14 to facilitate attachment of the belt 14 to suspenders on a user. Although four clips are shown, the belt 14 may include fewer or more clips.

The belt 14 is formed of leather or another suitable material (e.g., tough, durable, tear-resistant, and/or water-resistant). The belt 14 includes a pad 38 configured to lie adjacent a user's waist to provide increased comfort. The illustrated pad 38 is an integral piece extending substantially the length of the belt 14 but may include a plurality of pads 38 positioned on the belt 14. The pad 38 is formed of foam or another suitable cushioning material.

The tool belt 10 is configured to receive a plurality of interchangeable and removable tool pouches or containers 42 to store and organize tools for craftsmen and other tool laborers. The tool pouches 42 are moveable and interchangeable on the same tool belt, between other tool belts, with a tool bag, or other similar device.

The tool pouches 42 include an attachment portion 70 so that the tool pouches 42 can slide (FIG. 2A) or otherwise be manipulated onto the belt 14. The tool pouch 42 may be coupled to the belt 14 through complementary apertures 30 with a removable barrel bolt 54 or other suitable fastener (FIG. 2B) to allow the tool pouches 42 to be locked in place on the belt 14.

In the illustrated embodiment, each of the tool pouches 42 includes a bracket 46 configured to provide support to the tool pouch 42 and a tool pocket 48. Each of the tool pockets 48 includes a flange 49 (FIG. 4) configured to fit through the brackets 46 of the tool pouch 42 or a tool bag (not shown) to anchor the tool pocket 48. In some embodiments, the bracket 46 may be integral with the tool pouch 42 (FIGS. 1 and 3). The tool pockets 48 and tool pouches 42 are configured to store and hold a plurality of tools and/or accessories. The tool pouches 42 and pockets 48 are removably interchangeable, such that the tool pouches 42 and tool pockets 48 can couple to the belt 14, a tool bag (see FIG. 5), or other suitable device. The tool pouches 42 and tool pockets 48 are formed from leather or another suitable material (e.g., tough, durable, tear-resistant, and/or water-resistant) such as polyester, nylon, etc.

A reinforcement plate (not shown) may be coupled to the belt 14 to increase durability of the belt 14, allow the belt 14 to receive multiple tool pouches 42 at multiple apertures 30, etc. In such embodiments, the barrel bolt 54 would thread through both the reinforcement plate and the belt 14 to couple the tool pouch 42 to the belt 14.

The tool pouches 42 include reinforced corners 82 for additional strength and stability. The reinforced corners 82 may be the same material as the tool pouch 42 or another suitable material. The tool pouch 42 also includes a double stitch design 86 or another stitch design to provide increased durability. The tool pouches 42 further include, on the pouches, pockets, loops, and other similar features, rivets 90 to add strength and stability to the tool pouch 42. The rivets 90 are ultra-strong, marine proof rivets, other types of rivets or suitable fasteners.

In the illustrated embodiment, one of the tool pouches 42 includes an angled nail puller loop 94 oriented at a 45 degree angle relative to a vertical axis 95 (see FIG. 1) for storing a nail puller (not shown). The angled loop 94 prevents a stored nail puller from interfering with the user (e.g., rubbing against the user's leg). However, in other embodiments, the nail puller loop 94 may be oriented at an angle greater or less than 45 degrees. The loop 94 is illustrated on the side of the tool pouch 42 but may be positioned at another suitable location. The nail puller loop 94 is formed of the same material as the tool pouch 42 or another suitable material.

The tool belt 10 further includes a hammer loop 98 coupled to a tool pocket 97 and including rollers 99 to facilitate removal of a hammer (not shown) from the loop 98. The hammer loop 98 is coupled to the tool pocket 97 with rivets 90, and the tool pocket 97 is removably coupled to the belt 14 with a barrel bolt 54. The hammer loop 98 is positioned to allow increased accessibility of the tool to the user. The hammer loop 98 is formed of metal, the material of the tool pouch 42 or another suitable material.

The tool belt 10 is illustrated with two tool pouches 42, an angled nail puller loop 94, and a hammer loop 98. In some embodiments, the tool belt 10 may include other numbers or types of tool pouches 42, loops 45 (FIG. 1), tools, and accessories, which may be moved to other locations on the tool belt 10. The illustrated tool pouches 42 and tool pockets 48 are representative, and variations, such as custom designed tool pouches 42 and tool pockets 48, may be used with the tool belt 10. The tool belt 10 and the tool pouches 42 are adaptable with or without a logo, design, adornment, and/or ornamentation.

FIGS. 5-10 illustrate a tool bag 1010 and related components. The illustrated tool bag 1010 (FIGS. 5 and 9-10) is a portable tool bag, transportable between worksites (e.g., construction sites, garages, etc.) and for storing tools and accessories in an organized manner.

The tool bag 1010 includes a bottom panel 1014, a front panel 1018, a back panel 1022, end panels 1026, 1030, and a top panel 1034. The panels 1014-1034 are formed of tough, durable, tear-resistant, and/or water-resistant material, such as polyester, nylon, or other suitable material, and each panel 1014-1034 is adaptable with or without a logo, design, adornment, and/or ornamentation. Adjacent panels 1014-1034 are coupled by stitching along the common edges. Joining the panels 1014-1034 together creates a storage space 1046 (FIG. 5) configured to store tools and accessories.

The tool bag 1010 includes reinforced corners 1038 to provide additional strength and stability. The reinforced corners 1038 may be formed of the same material as the adjoining panels 1014-1034 or another suitable material. The edges of each panel 1014-1034 may also be reinforced for additional strength and stability. The tool bag 1010 is also provided, on one or more panels 1014-1034, with a double stitch design 1042 (FIG. 5) or other stitch design to provide increased durability.

Figure 5:
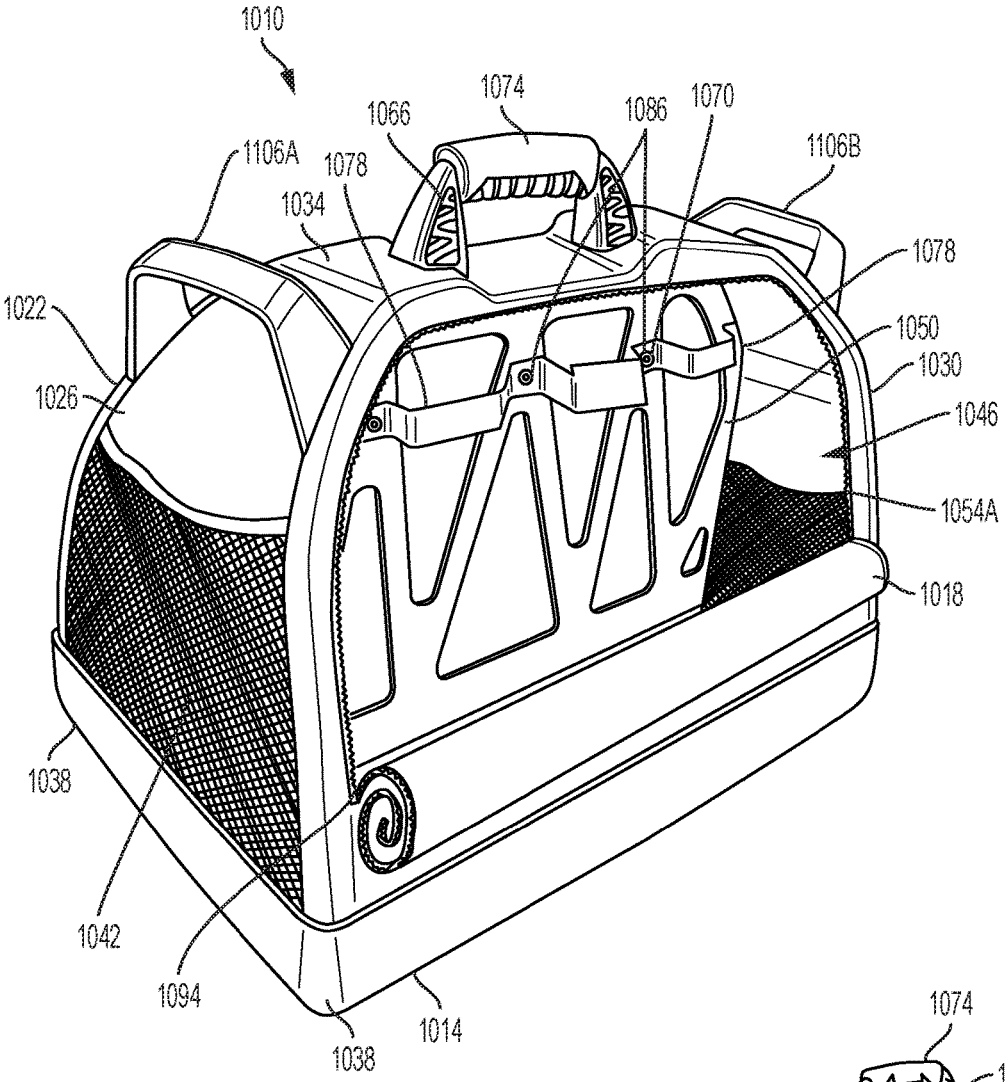
FIG. 5 is a front perspective view of a tool bag according to one independent embodiment and illustrates an interior storage space of the tool bag.
Figure 6:
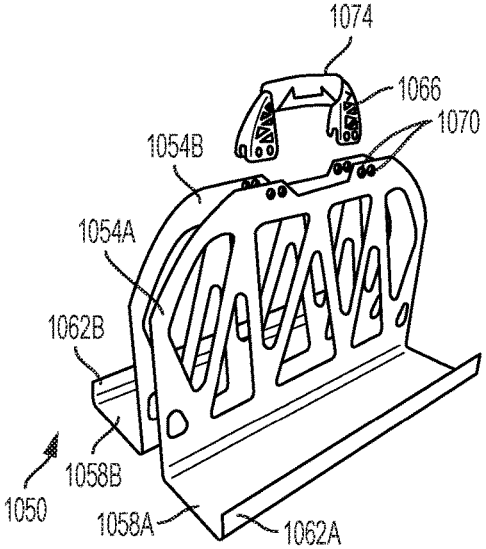
FIG. 6 is a perspective view of an inner casing of the tool bag shown in FIG. 5.

As shown in FIGS. 5-6 (see also FIG. 44), a frame or an inner casing 1050 in the storage space 1046 maintains the tool bag 1010 upright, provides increased support and durability, etc. The illustrated inner casing 1050 includes two stamped aluminum center spines 1054A, 1054B, each having a base 1058A, 1058B and a lip 1062A, 1062B. The base 1058A, 1058B provides for sturdy storage of tools and accessories, and the lip 1062A, 1062B contributes to the stability of the tool bag 1010. In other embodiments, the inner casing 1050 may be formed of other suitable materials and/or other suitable manufacturing processes. In other embodiments, the inner casing 1050 may be formed as an integral unit.

A handle 1066 couples the center spines 1054A, 1054B with a plurality of rivets 1070 or other suitable fasteners. The handle 1066 extends through the top panel 1034 to provide a sturdy location for a user or lifting device to grab the tool bag 1010. The handle 1066 is shaped and contoured as a comfortable location for the user to grip the tool bag 1010 during loading, unloading, transport, etc. The illustrated handle 1066 includes a grip portion 1074 formed of rubber, an elastomeric material, another suitable material or combination of materials.

Figure 7A:
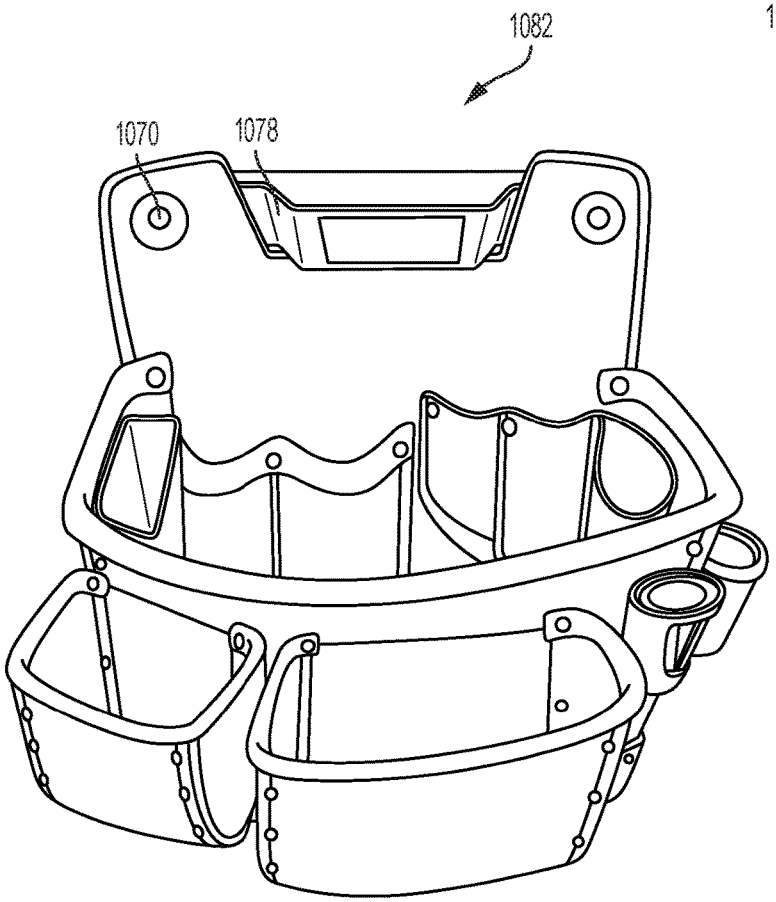
FIG. 7A is a front perspective view of a tool pouch compatible with the tool bag shown in FIG. 5 and with a tool belt shown in FIG. 8.
Figure 7B:
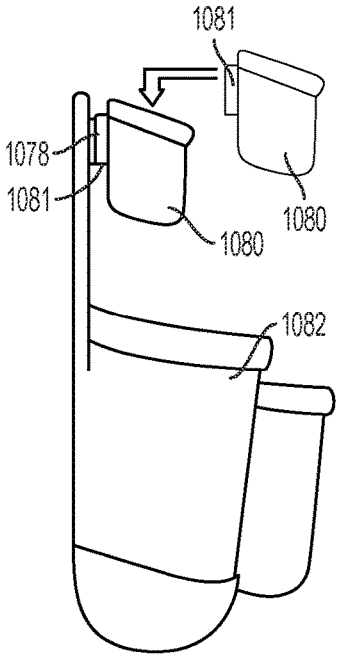
FIG. 7B is a side view of a portion of the tool pouch shown in FIG. 7A and illustrates a tool pocket.
Figure 8:
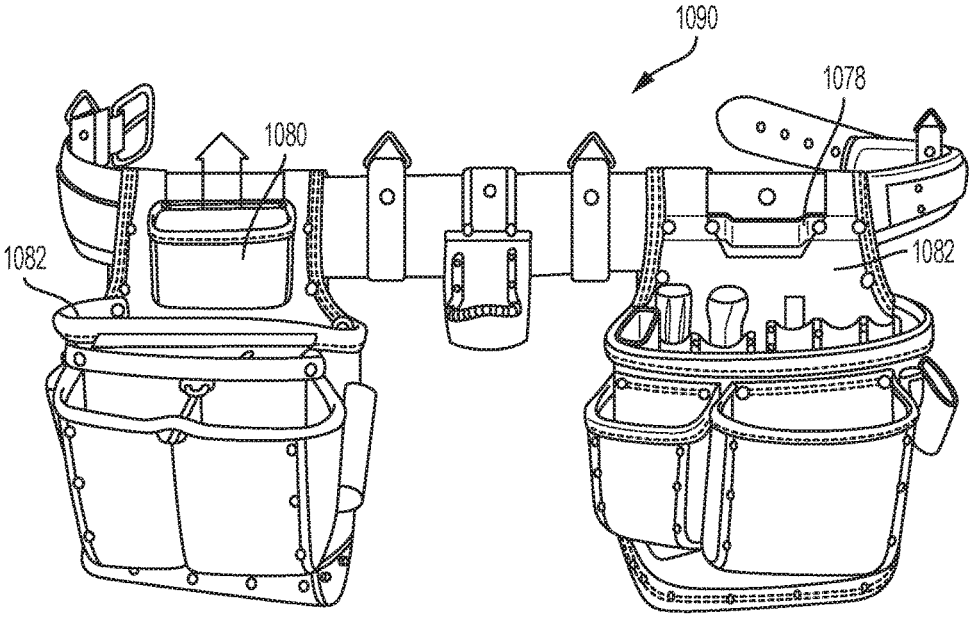
FIG. 8 is front perspective view of a tool belt including tool pouches and tool pockets and compatible with the tool bag shown in FIG. 5.

The center spine 1054A, 1054B includes brackets 1078 (FIG. 5) configured to receive and support a tool pocket 1080 (FIGS. 7B and 8). Each bracket 1078 is coupled to the center spine 1054A, 1054B with a rivet 1070 or other suitable fastener through an aperture (not shown) at a connection location 1086. The brackets 1078 may be used to hold or store tools and/or accessories without the pocket 1080 (see FIG. 44).

The illustrated brackets 1078 are integrally formed as a single piece. However, in other embodiments, each bracket 1078 may be separate from the other brackets. The brackets 1078 are illustrated in a substantially straight line but may be staggered to accommodate different sized tool pockets 1080. In some embodiments, the brackets 1078 may be different sizes to accommodate different sized tool pockets 1080. In some embodiments, a bracket 1078 may be integral with a tool pouch 1082 (FIG. 7A).

Each tool pocket 1080 includes a flange 1081 (FIG. 7B) configured to fit through the brackets 1078 of the tool bag 1010 and/or a tool pouch 1082 to anchor the tool pocket 1080. The tool pockets 1080 and tool pouches 1082 store and hold a plurality of tools and/or accessories. The pouches 1082 and pockets 1080 are removably interchangeable to couple to the tool bag 1010, a tool belt 1090 (FIG. 8), or other suitable device. The pocket 1080 and the pouches 1082 may be placed into the tool bag 1010 without being coupled to the bracket 1078 or center spine 1054A, 1054B.

The front panel 1018 of the tool bag 1010 includes a zipper 1094 (FIGS. 5 and 9) about three sides to permit exposure of the storage space 1046. When the front panel 1018 is unzipped, the storage space 1046 is accessible to insert or remove tools/accessories, tool pouches 1082, tool pockets 1080. Although illustrated as a zipper 1094, another suitable closure mechanism (e.g., snaps, buttons, buckles, other fasteners) may be used. Furthermore, one or more panels 1014-1034 may be adapted to provide access to the storage space 1046 in the tool bag 1010.

Figure 10:
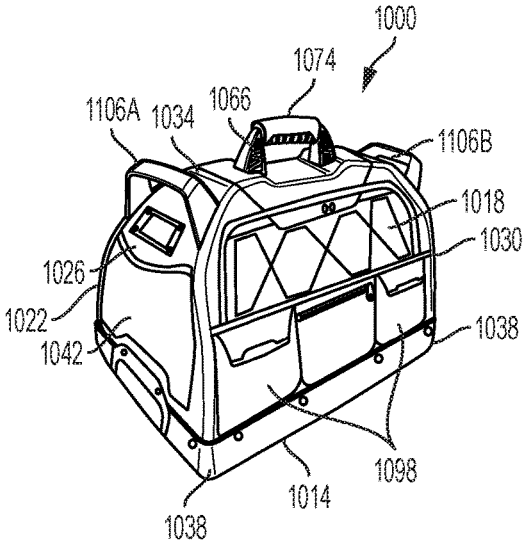
FIG. 10 is a front perspective view of a tool bag according to another independent embodiment.

As shown in FIG. 10, any of the panels 1014-1034 may include one or more exterior pockets 1098 or storage areas. The exterior pockets 1098 may be zippered, snapped, buttoned, or otherwise configured to provide access to the contents of the exterior pocket 1098.

Figure 9:
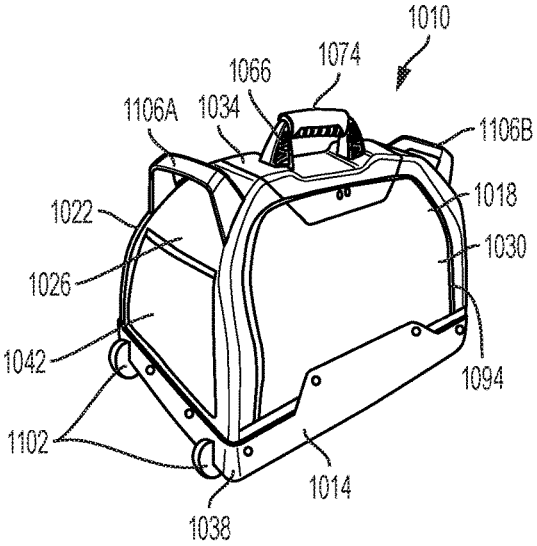
FIG. 9 is a front perspective view of a tool bag according to another independent embodiment.

As shown in FIG. 9, the tool bag 1010 may include a plurality of wheels 1102 to increase portability. The tool bag 1010 may also include a telescoping handle (not shown) on a side opposite the wheels 1102 to reduce bending of the user. Side handles 1106A, 1106B (FIGS. 5 and 9-10) extend from the tool bag 1010 at a location where the top panel 1034 meets each end panel 1026, 1030. The handles 1106A, 1106B may be used for transport, to hang the tool bag 1010 horizontally (e.g., from a railing), etc.

Figure 11:
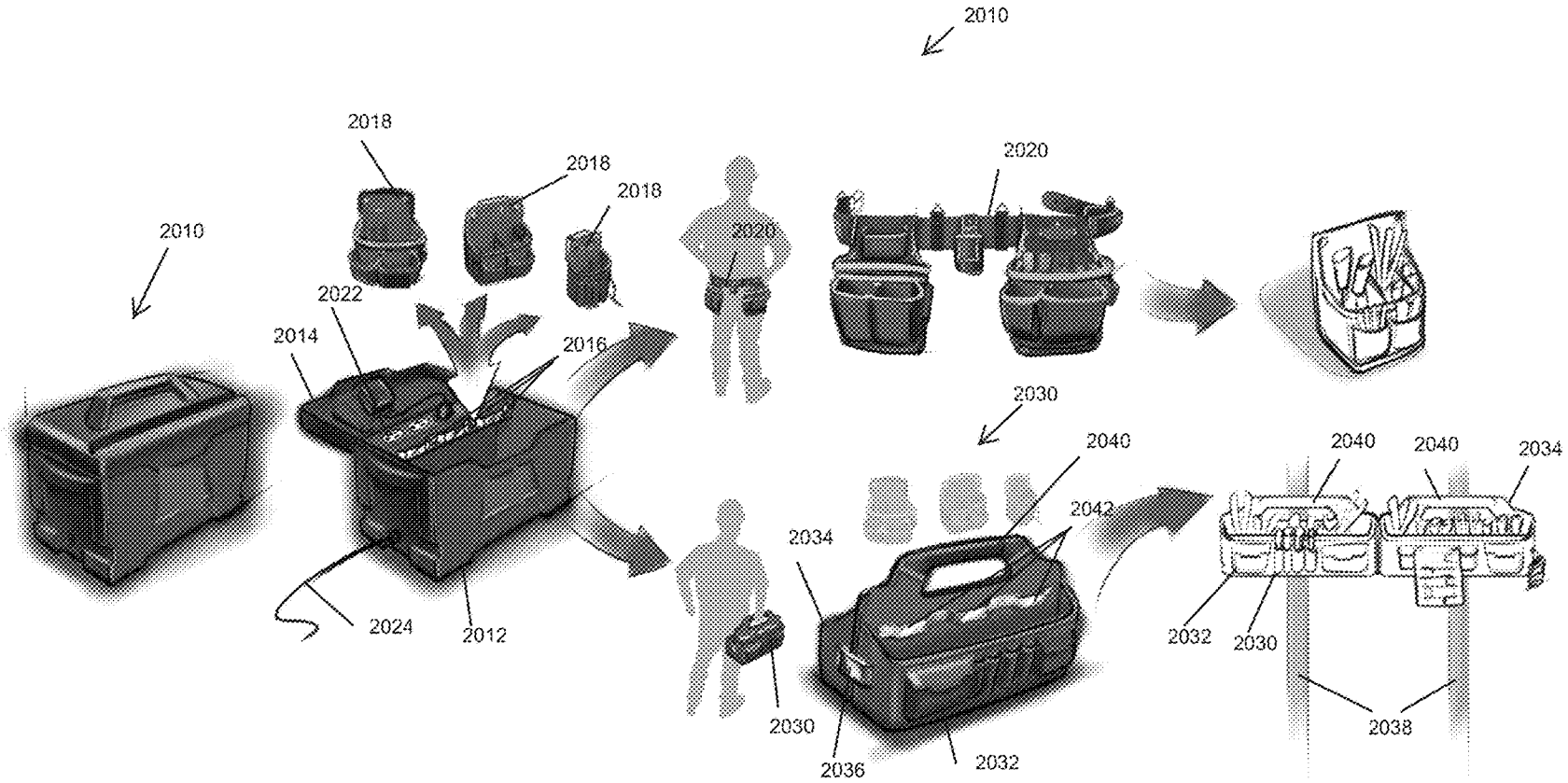
FIG. 11 illustrates a tool storage and organization system according to an independent embodiment.

FIG. 11 illustrates a modular tool storage and organization system 2010. The system 2010 includes a main storage compartment 2012. The main storage compartment 2012 includes a lid 2014 and a plurality of hangers 2016. The system 2010 further includes a plurality of tool pouches or bags 2018 that can be coupled to the hangers 2014 inside the compartment 2012 to hang and store the bags 2018 inside the compartment 2012.

The system 2010 may further include a tool belt 2020. The user can attach the bags 2018 from the compartment 2012 to the belt 2020 as illustrated. The modular system 2010 allows the user to only attach the desired bags 2018 to the belt 2020 depending on the job the user is doing and the tools needed. The illustrated compartment 2012 includes a set of outlets 2022 and a power cord 2024 that can be used to charge batteries, provide power, etc.

The system 2010 may also include a tool bag 2030. The tool bag 2030 includes a first side 2032, a second side 2034, and a fastener 2036 that couples the sides 2032, 2034. In the illustrated embodiment, the fastener 2036 can be released and the bag 2030 can be unfolded (e.g., the sides 2032, 2034 extend in a line) to permit the tool bag 2030 to be hung on frame members 2038 (e.g., 2×4's or 2×6's) via handles 2040. In one embodiment, the handles 2040 are configured to be spaced in the unfolded position by a distance of about 16 inches, a standard spacing between frame members 2038. The bag 2030 further includes hangers 2042, similar to the hangers 2016 so that the smaller bags 2018 can also be hung inside the bag 2030.

Figure 12:
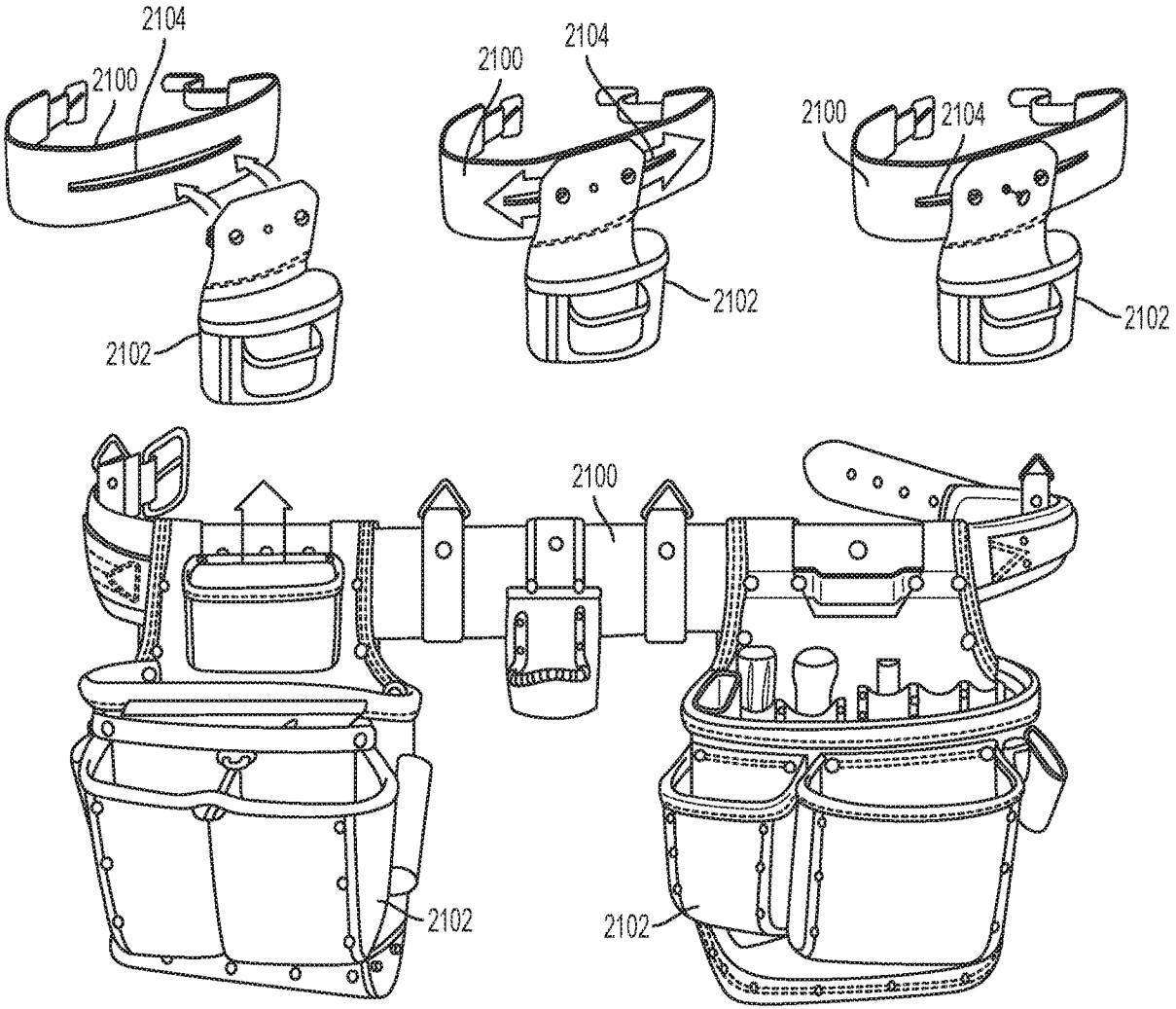
FIG. 12 illustrates a tool belt usable with the system of FIG. 11.

FIG. 12 illustrates a tool belt 2100 that may be used, for example, as the tool belt 2020 of the system 2010. The tool belt 2100 includes pouches 2102 that can be removably coupled to the belt 2100. The belt 2100 includes an elongated groove 2104 for attaching the pouches 2102 at different positions around the belt 2100. The pouches 2102 can be attached to the belt 2100 to easily slide along the groove 2104 or be held in a generally fixed position.

Figure 13:
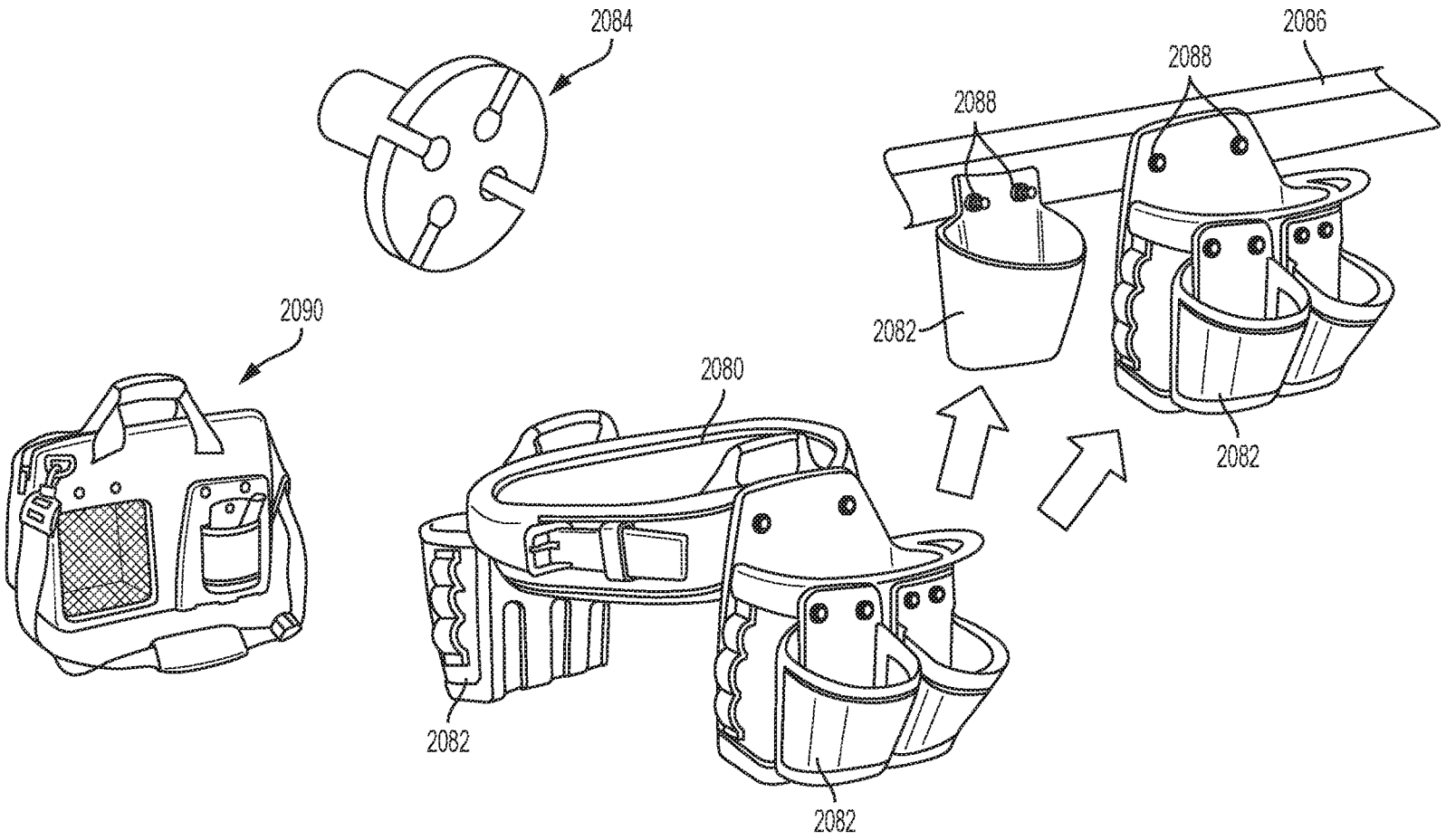
FIG. 13 illustrates another tool belt usable with the system of FIG. 11.

FIG. 13 illustrates another tool belt 2080 including tool pouches 2082 that can be removed and re-attached to the belt 2080 with an elastomeric button 2084 on the belt 2080. Apertures 2088 on the pouches 2082 receive a button 2084 to attach the pouches 2082 to the belt 2080 and can also be attached to a structural member 2086. Therefore, the user only needs to carry the desired pouches 2082 on the belt 2080 and can hang other pouches 2082 on structural members 2086. A bag 2090 can also include buttons 2084 so that the pouches 2082 can be attached to the bag 2090.

Figure 14:
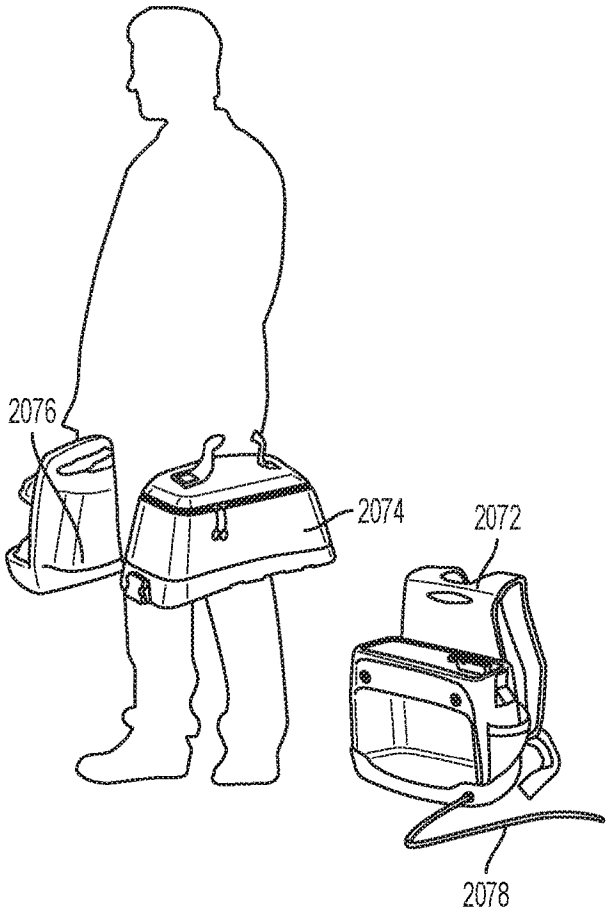
FIG. 14 illustrates a tool storage system according to another independent embodiment.
Figure 14:
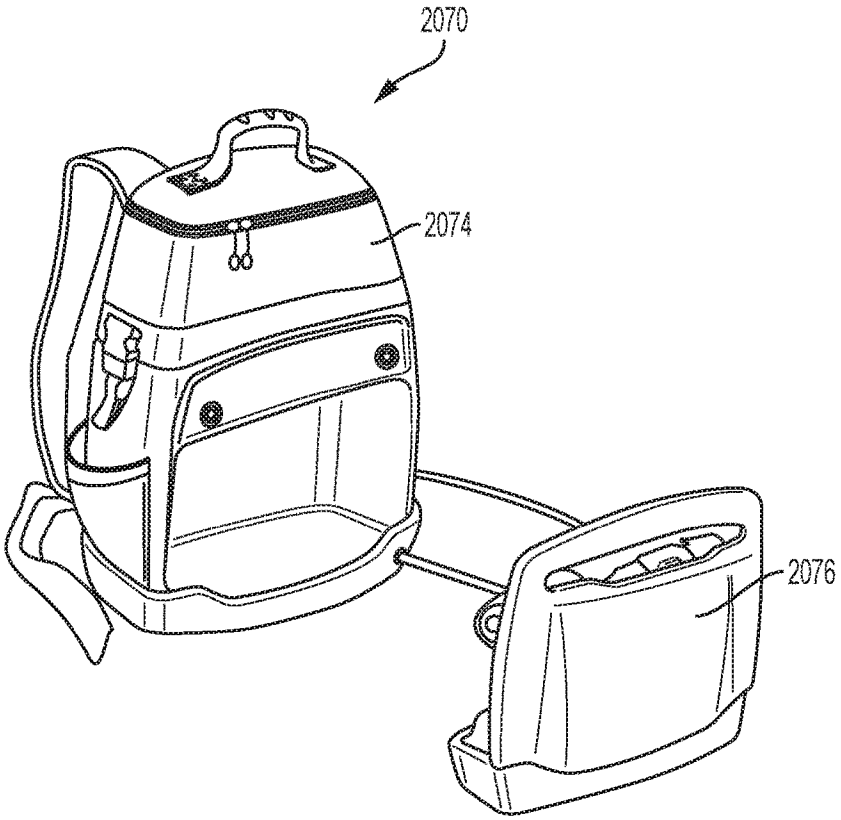

FIG. 14 illustrates another modular tool storage and organization system 2070. The system 2070 includes a base 2072, a first tool compartment 2074, which could be similar to the compartment 2012, discussed above, and a second tool compartment 2076. The base 2072 includes shoulder straps 2078 so the user to carry the system 2070.

The compartment 2074 latches to the base 2072 toward the top of the base 2072 to removably couple the compartment 2074 to the base. The compartment or tool tray 2076 slides out from the base 2072, as illustrated. Thus, the user can easily carry compartments 2074, 2076 on the base 2072 and then transport the compartments 2074, 2076 without the base 2072. The base 2072 can include a power cord 2078 that supplies power to a charging station in the base 2072 to charge power tool batteries.

Figure 15:
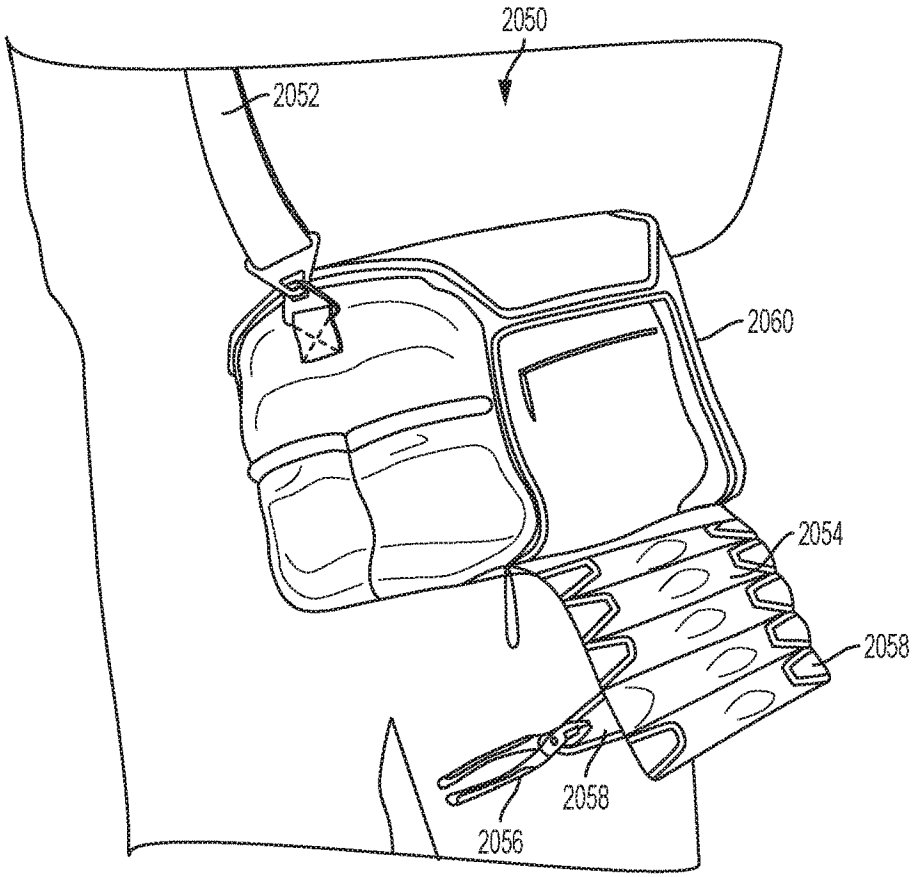
FIG. 15 illustrates a tool bag according to another independent embodiment.

FIG. 15 illustrates a tool storage bag 2050 including a shoulder strap 2052 and a fold out flap 2054. Tools, such as pliers 2056, can be attached to the flap 2054 by tabs 2058 that fold out from the flap 2054. The illustrated tabs 2058 are arranged relative to the flap 2054 so that the tools are held horizontally when the bag 2050 is carried by the user so that the tools do not fall out of the tab 2058 or flap 2054 when it is opened. A zipper 2060 (e.g., a waterproof zipper) can secure the flap 2054 closed against the main body of the bag 2050. The zipper 2060 is located at the perimeter of the bag top so there is no loss of interior capacity when the flap 2054 is closed.

Figure 16:
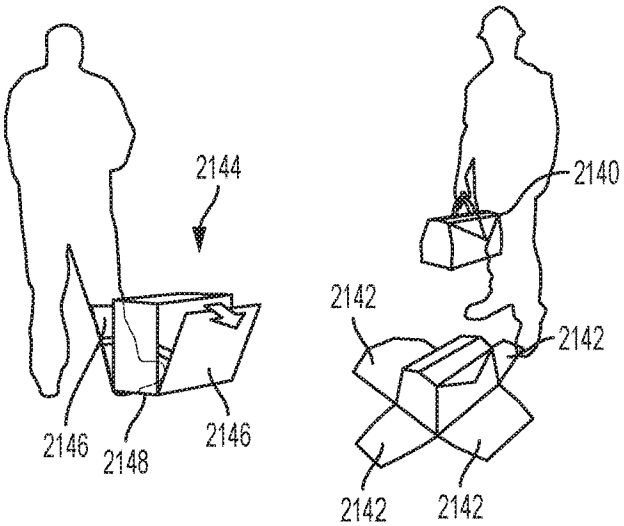
FIG. 16 illustrates tool carriers according to independent embodiments.

FIG. 16 illustrates a tool carrier 2140 including flaps 2142 that fold out from the sides and/or bottom. The flaps 2142 provide clear work spaces for workers on a surface (e.g., a floor, table, etc.). FIG. 16 also illustrates another tool carrier 2144 including side pockets 2146 that fold out to allow the user to access tools inside the pockets 2146. In one embodiment, the carrier 2144 is relatively rigid and includes a flat bottom 2148 so that the carrier 2144 stands upright on a support surface and can be used as a table, seat, etc.

Figure 17:
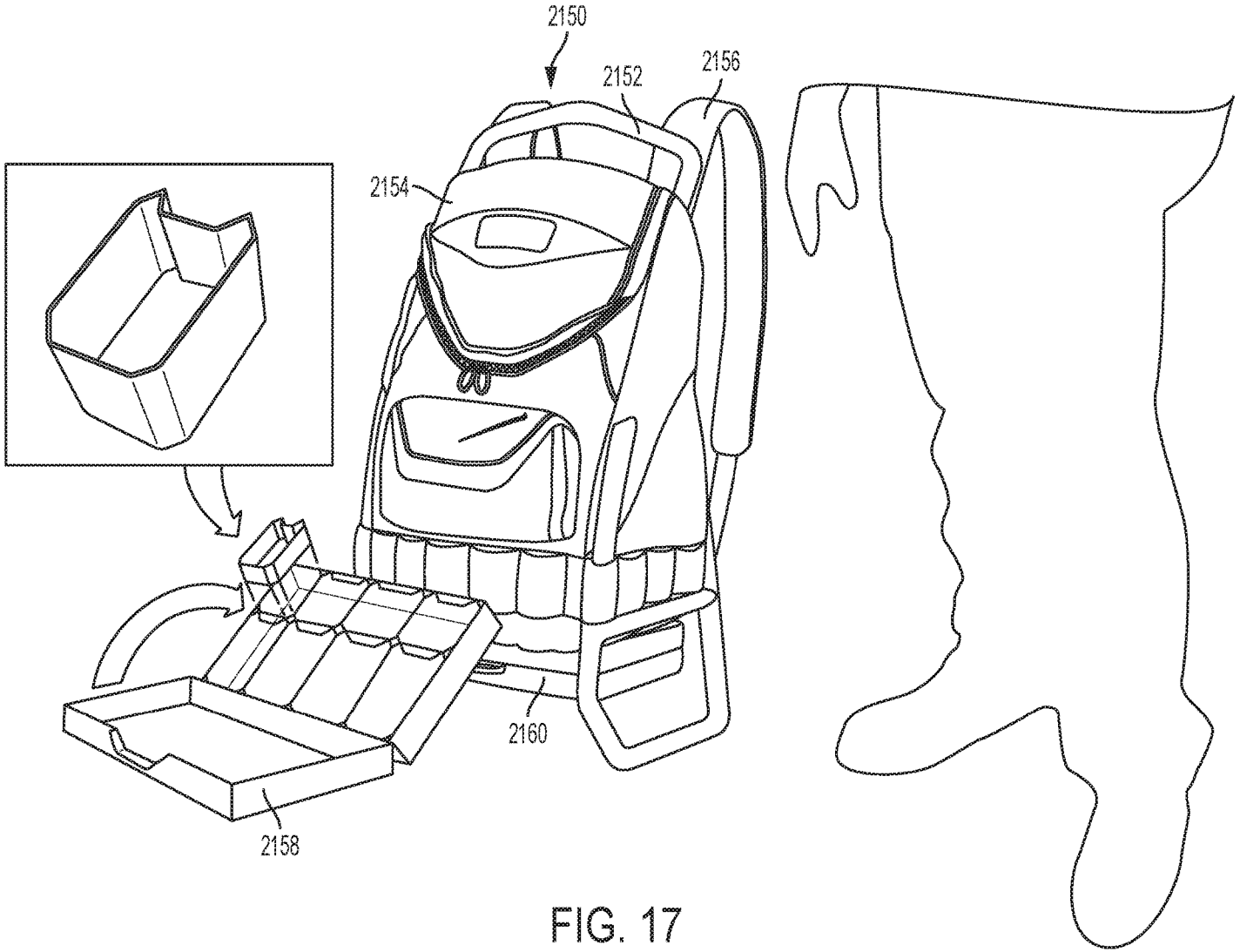
FIG. 17 illustrates a tool carrier according to another independent embodiment.

FIG. 17 illustrates a tool carrier 2150 including a rigid frame 2152 and a generally flexible tool bag 2154 attached to the rigid frame 2152. The carrier 2150 further includes shoulder straps 2156 and a waist belt (not shown) that allow the user to carry the carrier 2150. A pull out storage compartment 2158 is located in a bottom area 2160 of the bag 2154 for transporting relatively heavy items, and includes an organizer for storing relatively small items, including fasteners, small tools, etc.

Figure 18:
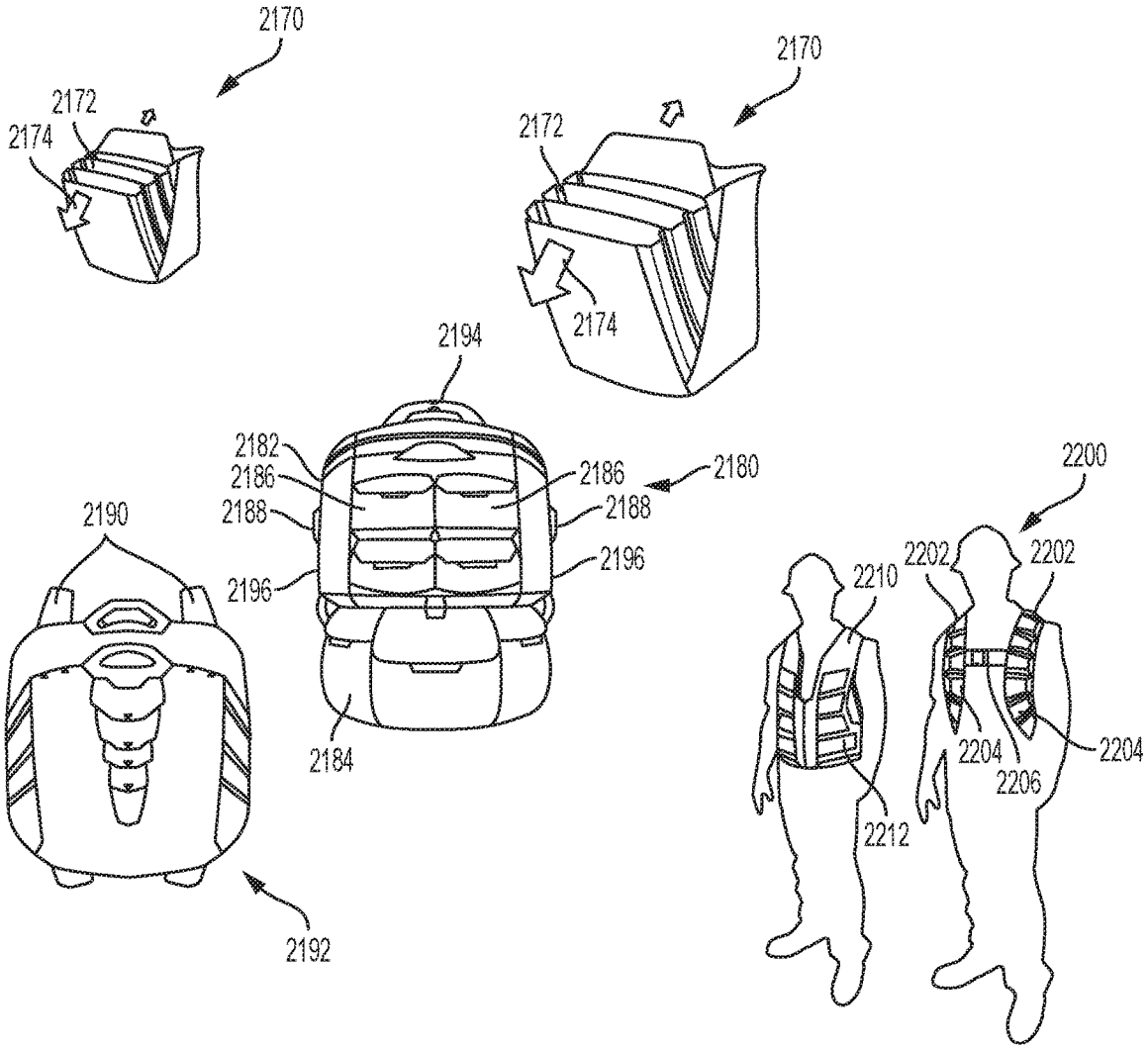
FIG. 18 illustrates a various tool carriers according to independent embodiments.

FIG. 18 illustrates a tool storage compartment 2170 including pockets 2172 for tool storage that fold out from a main body in the direction of arrow 2174. FIG. 18 further illustrates a tool storage bag 2180 including an upper pack 2182 and a lower pack 2184. The packs 2182, 2184 are detachable so that the user can take one pack to a specific job site location without the other.

The upper pack 2182 includes doors 2186 that flip down to expose more tools. The doors 2186 can include the pockets 2172, described above with respect to storage compartment 2170. Also, the upper pack 2182 includes hook and loop fasteners 2188 on the side to attach items to the bag 2180, such as a hard hat, gloves, etc.

The bag 2180 includes shoulder straps, similar to the shoulder straps 2190 of bag 2192, also illustrated in FIG. 18, which allow the user to carry the bags 2180, 2192. The bag 2180 also includes a handle 2194 that allows the user to carry the bag 2180, typically without the use of the shoulder straps. The handle 2194 is illustrated on a top end of the bag 2180, and additional handles, similar to the handle 2194, can be located on sides 2196 of the bag 2180 so that the user can carry the bag 2180 in multiple orientations.

A tool vest 2200 is also shown in FIG. 18. The vest 2200 includes pockets 2202 along straps 2204 of the vest 2200. A size adjustment strap 2206 extends between the straps 2204 that allows the user to adjust the spacing between the straps 2206 and therefore the size of the vest 2200. Another tool vest 2210 that includes pockets 2212 is also illustrated in FIG. 18.

Figure 19:
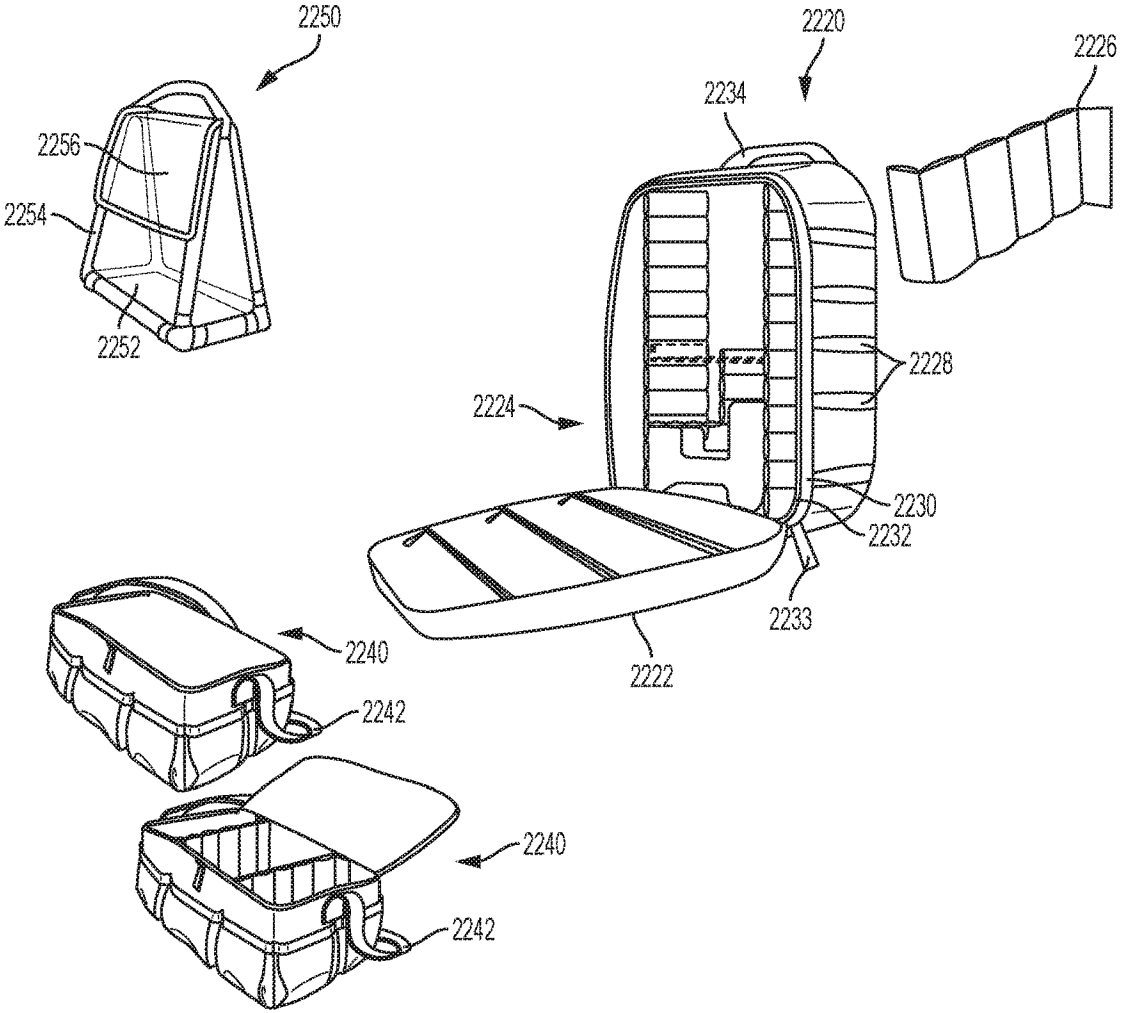
FIG. 19 illustrates a tool carrier according to another independent embodiment.

FIG. 19 illustrates a tool storage bag 2220 including a door or lid 2222 that opens and closes a main compartment 2224. Semi-stiff padded panels 2226 can be arranged in any suitable configuration inside the compartment 2224 to store power tools, tools, etc. between the panels 2226. The panels 2226 can be secured inside the compartment using hook and loop fasteners. Side pockets 2228 are located outside the compartment 2224.

An elastic band 2230 is located along a zipper 2232 around the perimeter of the compartment 2224 that allows the zipper 2232 to flex, which makes it easier to close the lid 2222 when the compartment is full of tools or includes an oversized tool. The illustrated zipper 2232 includes a tab 2233 and can include large loops that are easily grabbed when the user is wearing gloves. The zipper 2232 can also include flexible steel cables sewn into straps of the zipper 2232 that extend around the compartment 2224 for added security because the steel cables are extremely difficult to cut.

The bag 2220 can also include additional straps, pouches, elastic bands, etc. that can be used to attach a hard hat, gloves, etc. Daisy chains, etc. can also be located on the outside of the bag 2220 to attach items using a clip or elastic properties of the daisy chains. The bag 2220 further includes a handle 2234 that allows the user to hang the bag 2220 or lay the bag 2220 down on the ground.

FIG. 19 further illustrates a tool storage bag 2240 similar to the bag 2230 and including a shoulder strap 2242. The bag 2240 is deeper, which allows for larger tools and/or for tools to stand up in the bag 2240.

FIG. 19 also illustrates a bag 2250 with flexible fabric side walls 2252 and a rigid frame 2254. A lid 2256 folds up and down to open and close the bag 2250. In another embodiment, the bag 2250 can include a roll top lid (not shown) that provides a great deal of protection against outside elements as well as a range of internal volume options. Embodiments with a roll top lid may not include the rigid frame, which allows the user to adjust the volume. The roll top lid can also be used on pockets described above for tool vests, tool carriers, etc.

Figure 20:
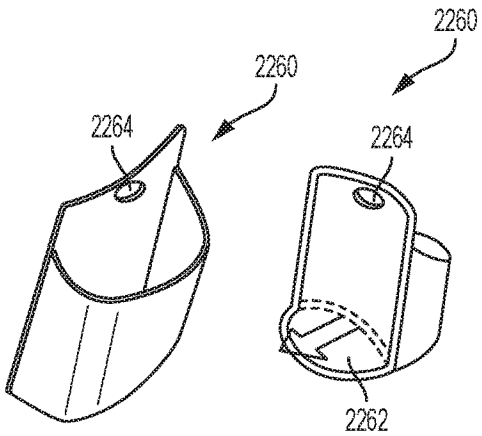
FIG. 20 illustrates a tool bag according to another independent embodiment.

FIG. 20 illustrates a tool bag 2260 that can be attached to a tool belt, such as one of the tool belts discussed above. The bag 2260 includes a fold out or pop out stand 2262 to stand the bag 2260 on a surface (e.g., a table top, floor, etc.). The bag 2260 further includes an aperture 2264 to attach the bag 2260 to a tool belt or hang the bag on a support, hook, fastener, etc.

FIGS. 21-24 illustrate a tool storage device 3020, such as a generally rigid toolbox, including a container 3024 and a lid 3028. The container 3024, or base, includes a bottom wall 3032 and four sidewalls 3036, 3040, 3044, 3048 extending generally perpendicularly from the bottom wall 3032. The bottom wall 3032 and the sidewalls 3036-3048 together define a storage area 3052 (FIG. 27) of the toolbox 3020. The cover or lid 3028 is pivotally coupled to the container 3024 to open (FIGS. 26 and 28) and close (FIGS. 21 and 22) the toolbox 3020. In the illustrated embodiment, the container 3024 and the lid 3028 are made of a rigid, molded plastic material but may be made of other suitable materials, such as metal.

Figure 21:
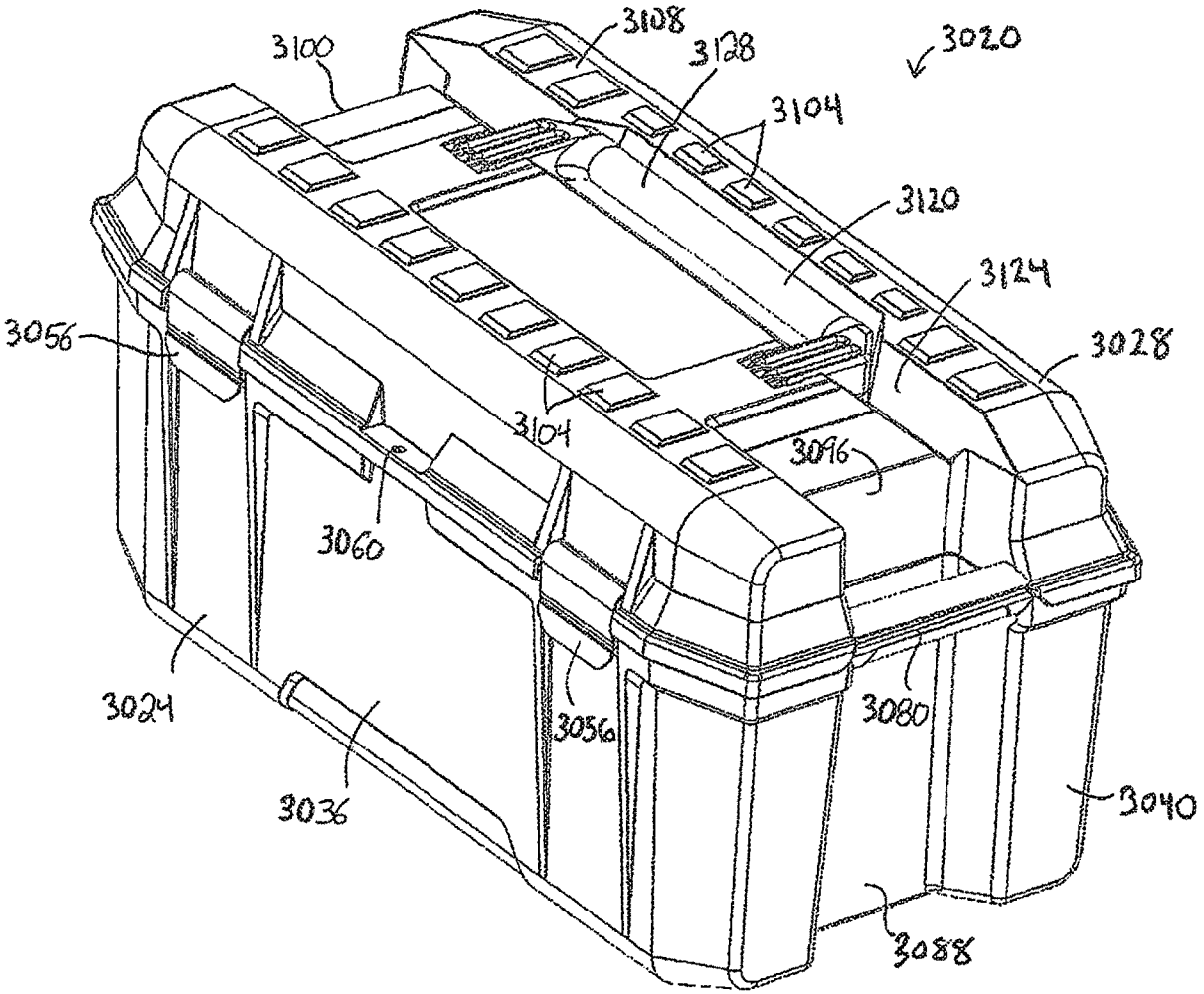
FIG. 21 is a front perspective view of a tool storage device, such as a tool box, according to another independent embodiment, illustrated in a closed position.

As shown in FIG. 21, the lid 3028 includes two latches 3056 pivotally movable relative to the lid 3028 to selectively engage corresponding portions of the container 3024. Each latch 3056 includes a rib or protrusion that slides underneath a corresponding lip of the container 3024 to secure the lid 3028 in a closed position. The lid 3028 also defines an opening 3060 that aligns with an opening in the container 3024, and the openings are configured to receive a padlock, cable, clip, or other suitable device to retain or lock the lid 3028 in the closed position.

Figure 22:
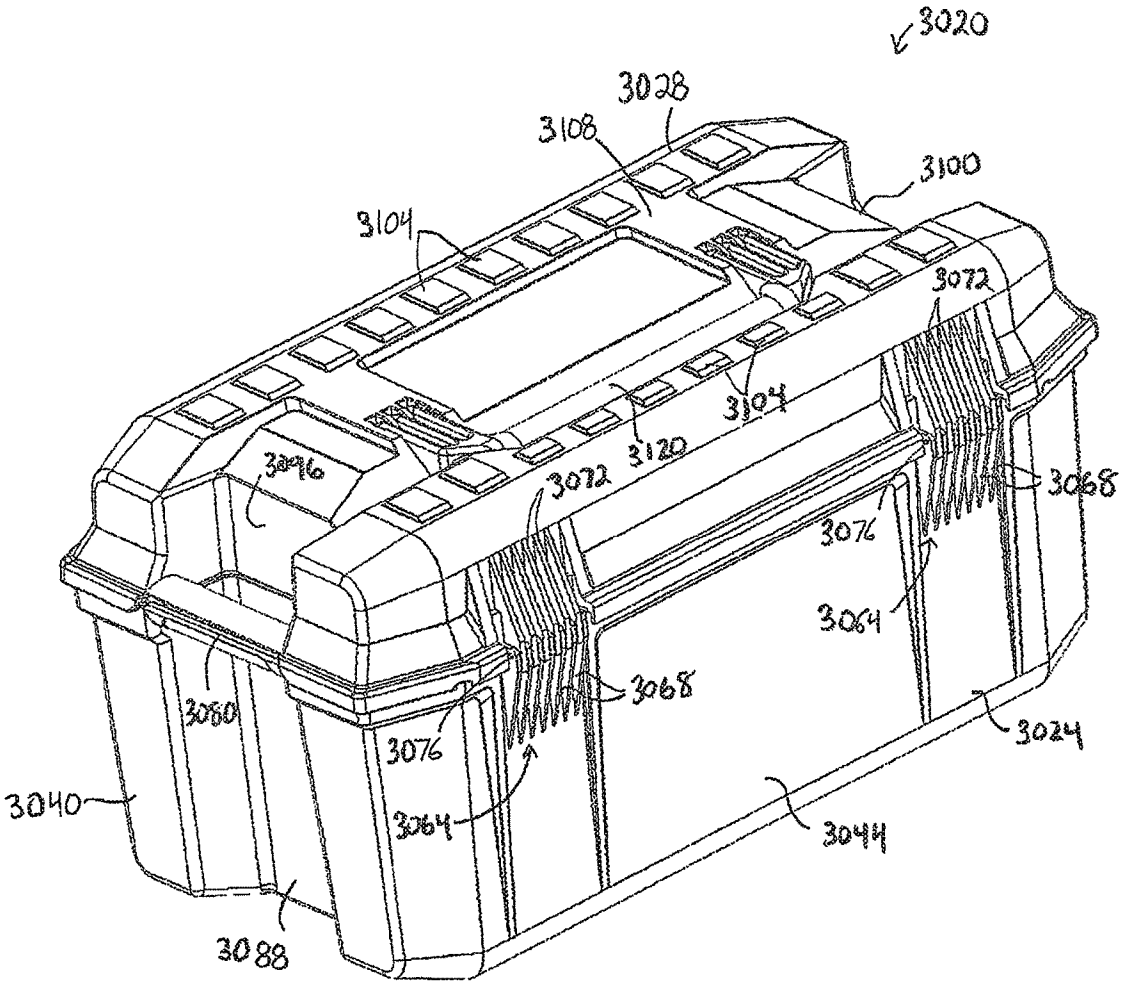
FIG. 22 is a rear perspective view of the device of FIG. 21.

As shown in FIG. 22, the lid 3028 is pivotally coupled to the container 3024 by two buttress hinges 3064. Each buttress hinge 3064 includes a series of spaced apart first flanges 3068 extending from the container 3024, and a series of spaced apart second flanges 3072 extending from the lid 3028. The flanges 3068, 3072 are interspersed such that each flange 3072 of the lid 3028 is positioned between two adjacent flanges 3068 of the container 3024. A pin 3076 extends through the flanges 3068, 3072 of each hinge 3064 to pivotally couple the flanges 3068, 3072 and, thereby, the container 3024 and the lid 3028. The flanges 3068, 3072 provide a relatively smooth hinge to reduce the possibility of snagging. In addition, the flanges 3068, 3072 provide a relatively strong hinge that inhibits the lid 3028 from opening more than 180 degrees relative to the container 3024.

As shown in FIGS. 21-24, in the closed position, the container 3024 and the lid 3028 define handles 3080, 3084 on opposing sides of the toolbox 3020. The sidewalls 3040, 3048 of the container 3024 define recessed areas 3088, 3092 to provide clearance for gripping the handles 3080. Similarly, sidewalls of the lid 3028 also define recessed areas 3096, 3100 aligned with the corresponding recessed areas 3088, 3092 of the container 3024 to provide clearance for gripping the handles 3080. The recessed areas 3088, 3092, 3096, 3100 allow a user's hand to pass between the handles 3080, 3084 and the container 3024 and the lid 3028 to facilitate grasping and carrying the toolbox 3020. In addition, the recessed areas 3088, 3092, 3096, 3100 allow a user to thread a cable or padlock around the handles 3080, 3084 to retain or lock the toolbox 3020 in the closed position and/or to a surrounding structure (e.g., a work bench). The handles 3080, 3084 are thereby pass-through handles that allow hands or other objects to pass between the handles 3080, 3084 and the container 3024 and the lid 3028.

Figure 23:
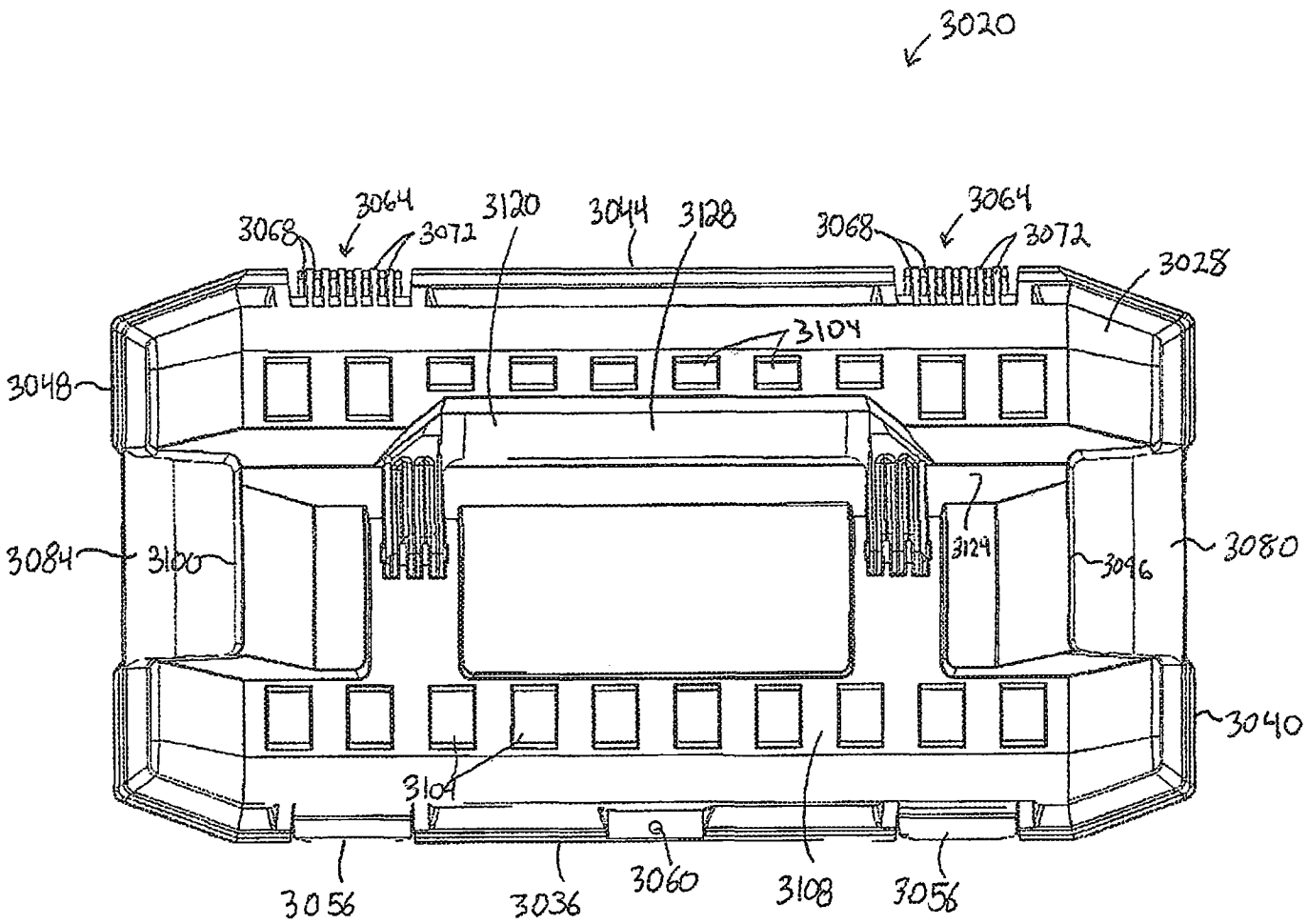
FIG. 23 is a top view of the device of FIG. 21.
Figure 24:
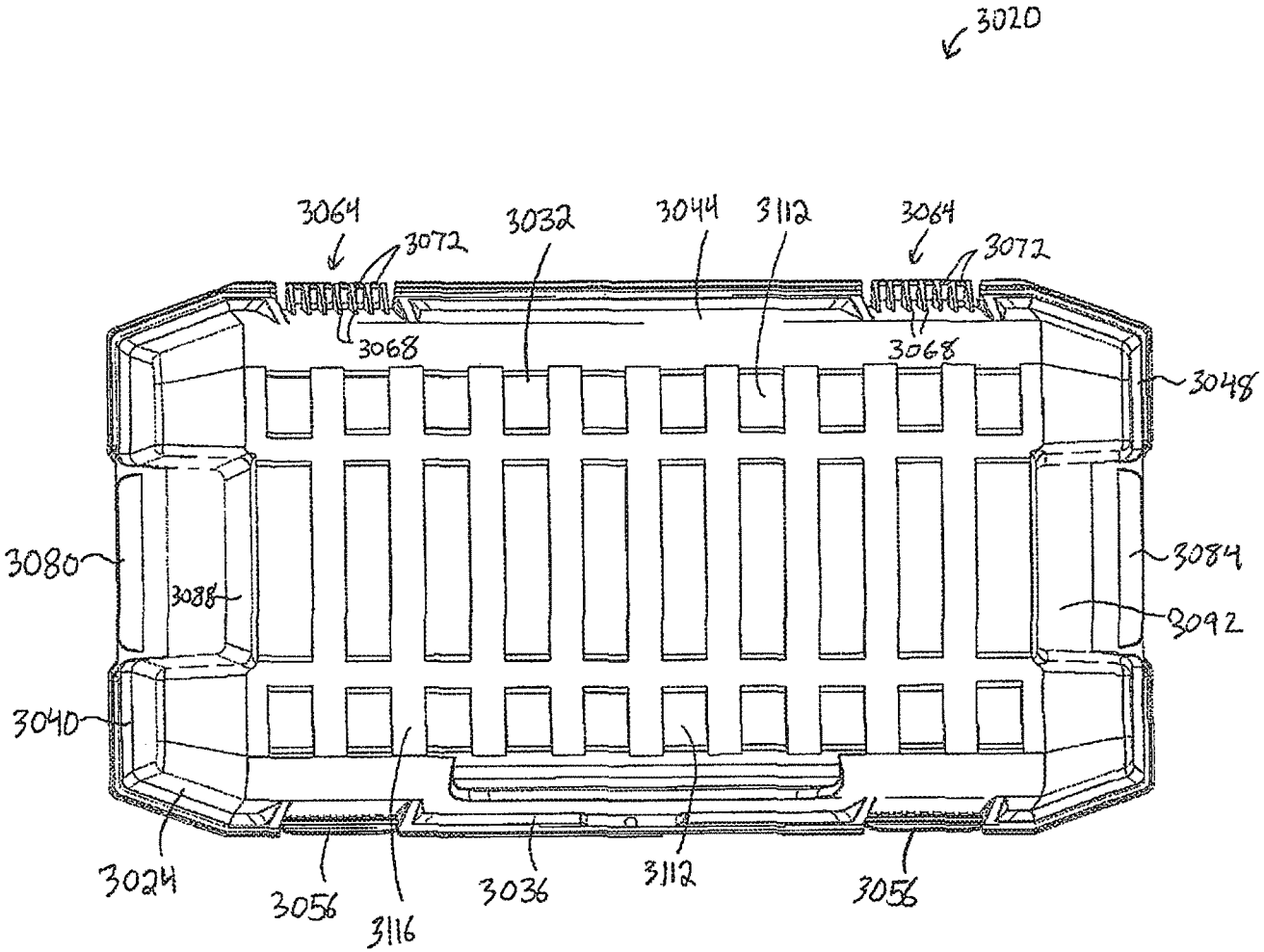
FIG. 24 is a bottom view of the device of FIG. 21.

As shown in FIG. 23, the lid 3028 includes detents 3104 formed in an outer surface 3108. In the illustrated embodiment, the detents 3104 are raised rectangles that extend upwardly from the surface 3108 but may have other shapes or sizes and/or be arranged in other patterns. The illustrated detents 3104 are configured to be received in corresponding recesses 3112 (FIG. 24) in a lower surface 3116 of the container 3024. The detents 3104 fit within the recesses 3112 to help stack multiple toolboxes on top of each other. The detents 3104 and the recesses 3112 inhibit the toolboxes from shifting relative to one another when stacked. The detents 3104 and the recesses 3112 can also correspond with and engage detents and/or recesses of other storage products, such as large storage chests, soft-sided tool bags, etc.

Figure 25:
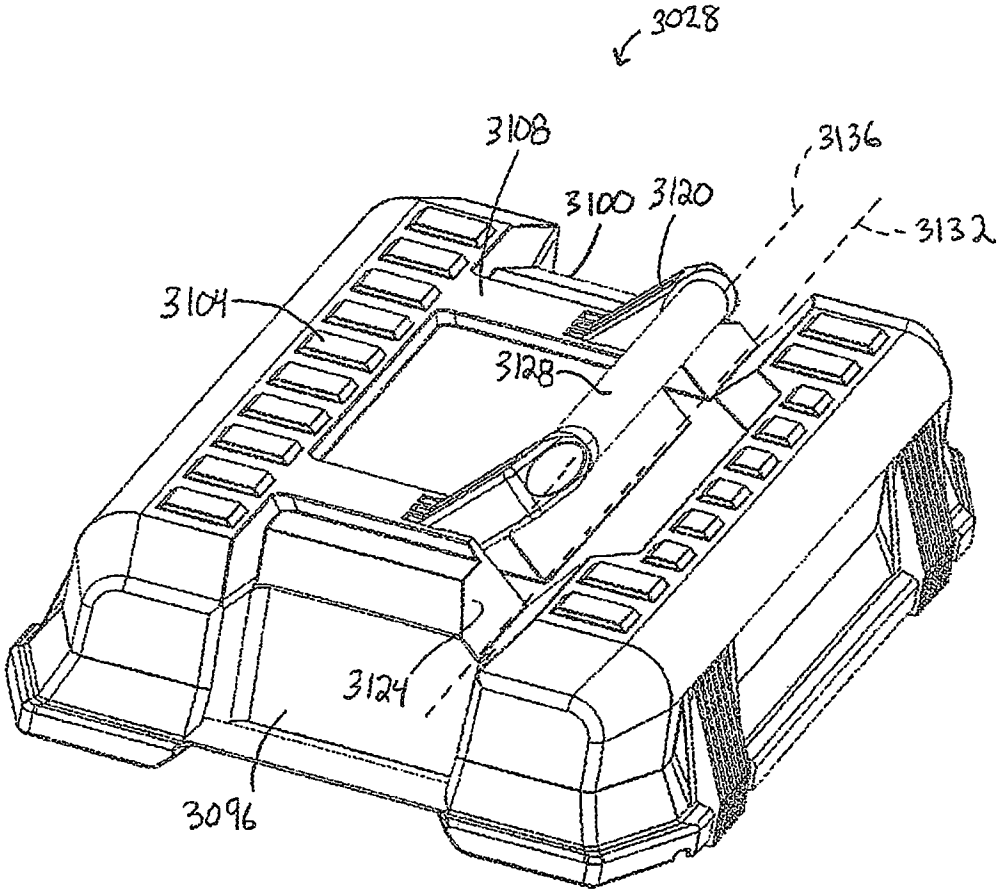
FIG. 25 is a perspective view of a lid of the device of FIG. 21.

As shown in FIG. 25, the lid 3028 also includes a handle 3120 and a groove 3124 formed in the outer surface 3108. The handle 3120 is pivotally coupled to the lid 3028 and movable between a lowered, storage position (FIG. 21) and a number of raised, operating positions (one of which is shown in FIG. 25). When the handle 3120 is in the storage position, the handle 3120 is generally flush with or recessed relative to the outer surface 3108 of the lid 3028. The handle 3120 includes a grip portion 3128 configured to be grasped by a user to facilitate carrying the toolbox 3020. In some embodiments, the grip portion 3128 may be covered or coated with a rubber or elastomeric material.

The illustrated groove 3124 extends longitudinally across the outer surface 3108 of the lid 3028 adjacent the handle 3120. In particular, a longitudinal axis 3132 of the groove 3124 is generally parallel to a longitudinal axis 3136 of the grip portion 3128 of the handle 3120, regardless of the pivoted position of the handle 3120. The illustrated groove 3124 has a generally V-shaped cross-sectional shape but may have other suitable cross-sectional shapes, such as a semi-circular cross-sectional shape. The groove 3124 is configured to receive an elongated work piece, such as a pipe, conduit, etc., for cutting. When a work piece is positioned within the groove 3124, the handle 3120 can be pressed against the work piece to clamp and hold it in place, and a user can then cut the work piece. If the grip portion 3128 of the handle 3120 is covered with a rubber or elastomeric material, the handle 3120 can help grip the work piece to inhibit it from slipping relative to the lid 3028.

Figure 26:
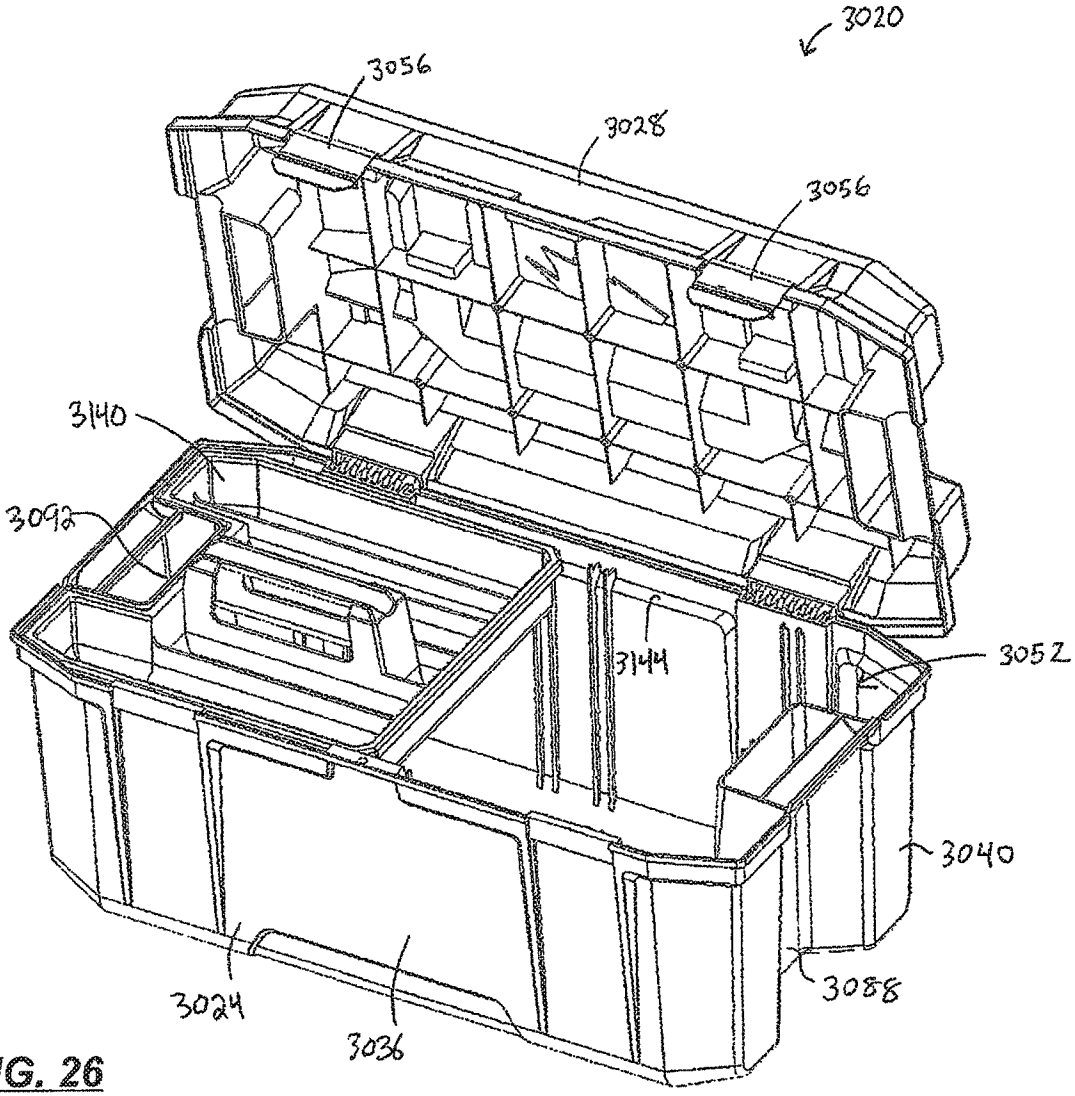
FIG. 26 is a front perspective view of the device of FIG. 21, illustrated in an open position.

As shown in FIG. 26, the toolbox 3020 also includes a storage tray 3140 positioned within the storage area 3052 of the container 3024. The storage tray 3140 is supported on a shelf 3144 of the container 3024 near the uppermost portion of the storage area 3052 (i.e., near the lid 3028). The storage tray 3140 can be removed from the container 3024 and repositioned within the container 3024 in one or more positions (e.g., two positions—the illustrated position in the left side of the container 3024 and a corresponding position in the right side of the container 3024).

Figure 27:
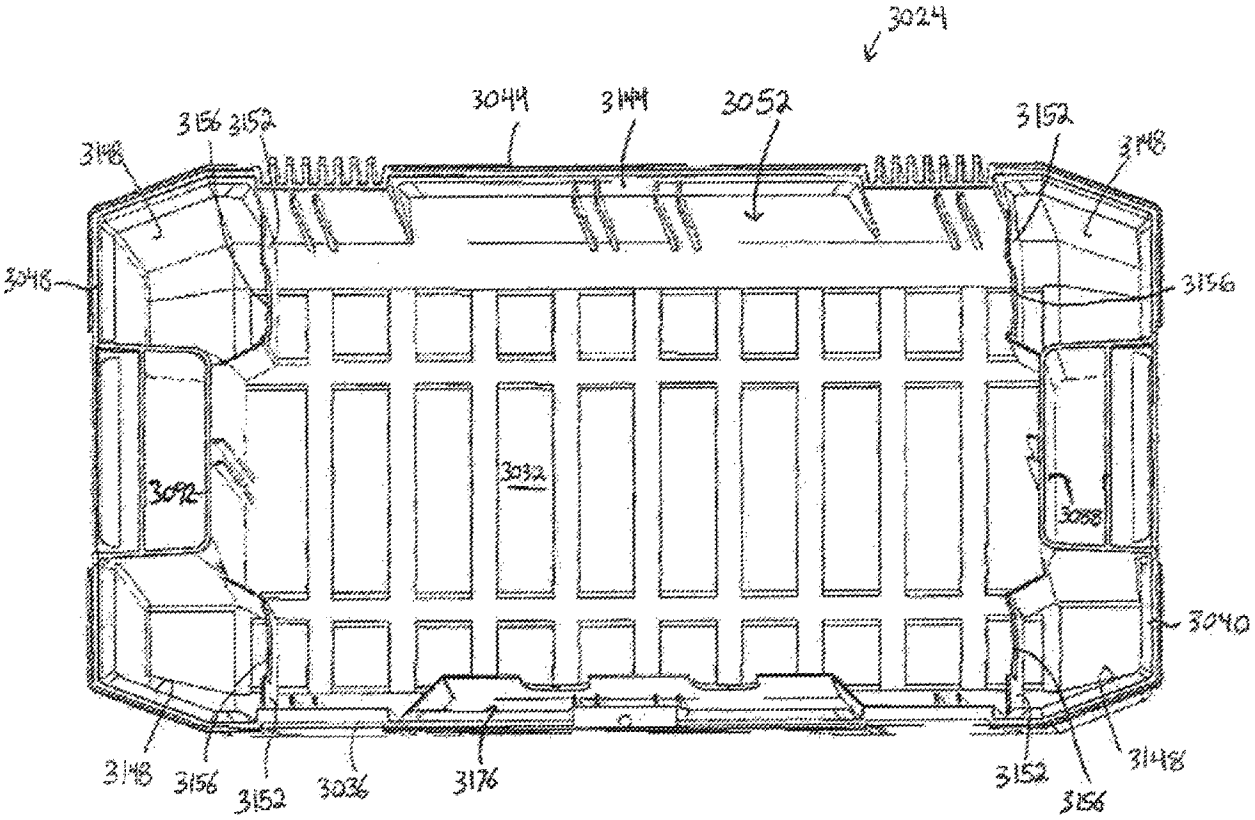
FIG. 27 is a top view of a container of the device of FIG. 21.
Figure 29:
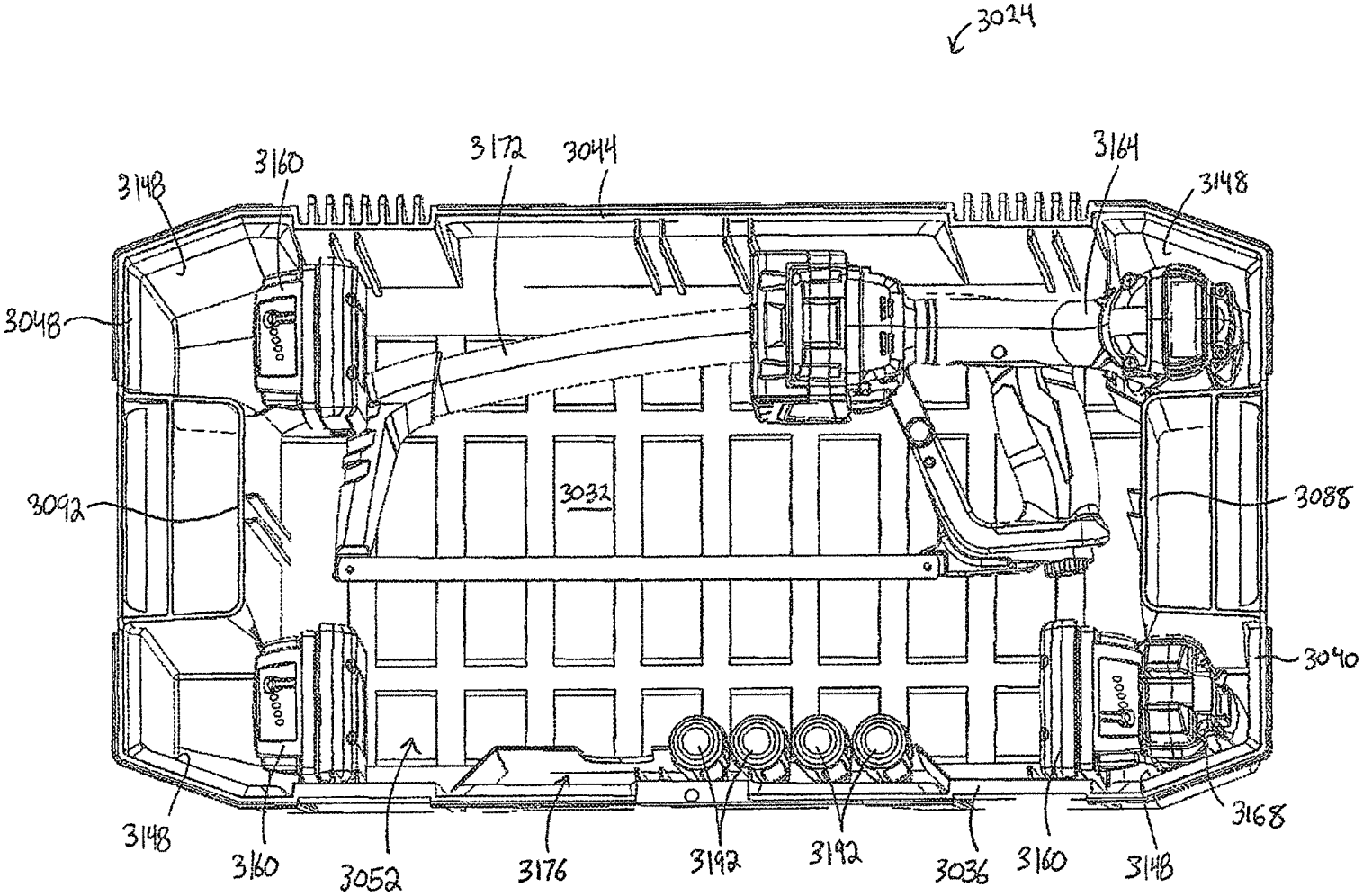
FIG. 29 is a top view of the container of FIG. 27, illustrated with various tools positioned within the container.

As shown in FIG. 27, the container 3024 includes four corner pockets 3148 in the storage area 3052. The corner pockets 3148 are defined between the sidewalls 3036-3048 and the recessed areas 3088, 3092 of the container 3024. Each corner pocket 3148 is further defined by an interior partition 3152 that extends from the sidewalls 3036, 3044 to one of the recessed areas 3088, 3092. The pockets 3148 are configured to receive tools, battery packs, or other devices to help organize items within the storage area 3052. Each interior partition 3148 defines a semi-circular cutout 3156 configured to receive a portion of a battery pack 3160 to support the battery pack 3160, as shown in FIG. 29. The interior partitions 3152 also provide structural support to the container 3024 reducing the possibility of fracturing when the toolbox 3020 is formed of a relatively malleable material.

Figure 28:
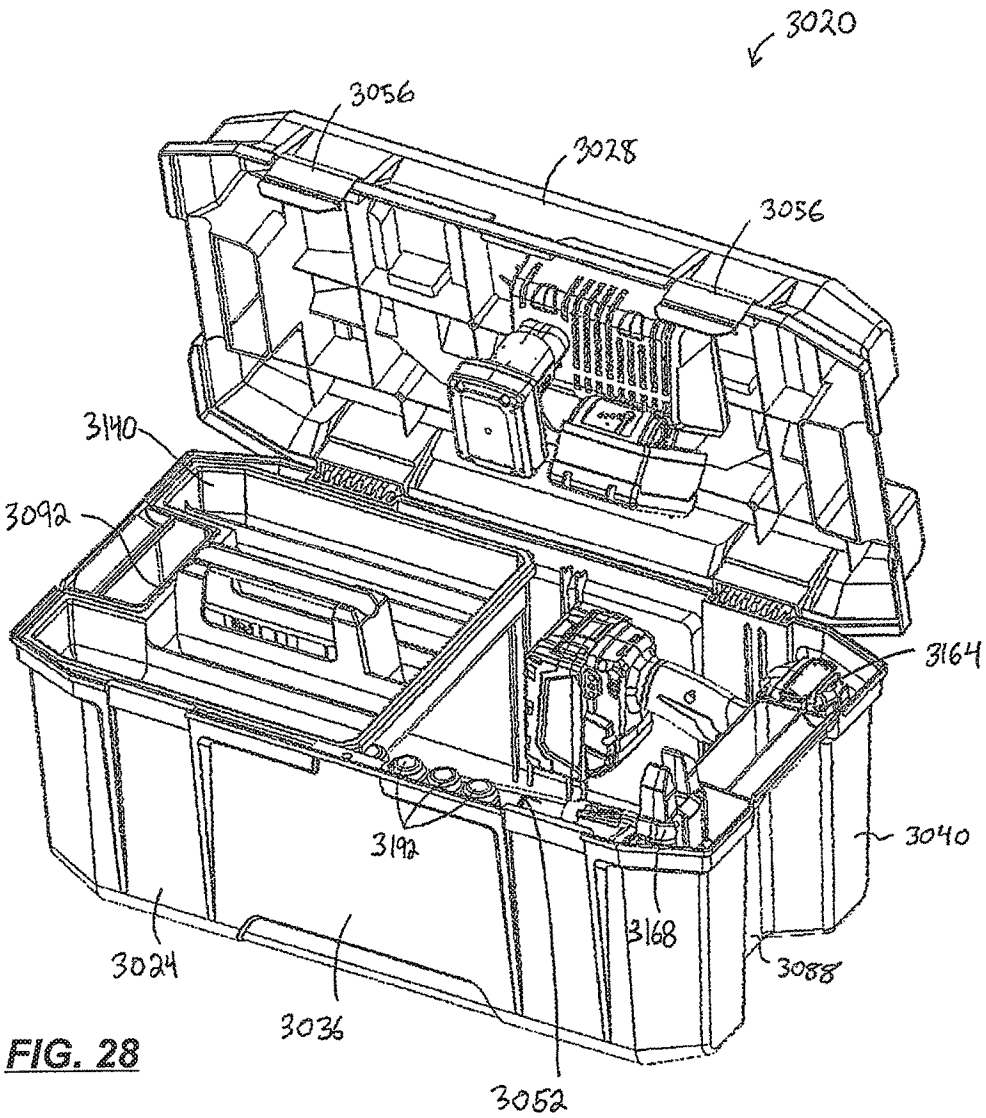
FIG. 28 is a front perspective view of the device of FIG. 21, illustrated in the open position and with various tools positioned within the device.

FIGS. 28-29 illustrate the toolbox 3020 in an open position with a variety of tools stored within the container 3024. For example, as shown in FIG. 29, a drill 3164 is partially positioned in one corner pocket 3148, and a fork meter 3168 is positioned in another corner pocket 3148. In addition, three battery packs 3160 are supported by three interior partitions 3152. A handsaw 3172 is also positioned to lie flat on the bottom wall 3032 of the container 3024 within the storage area 3052.

Figure 30:
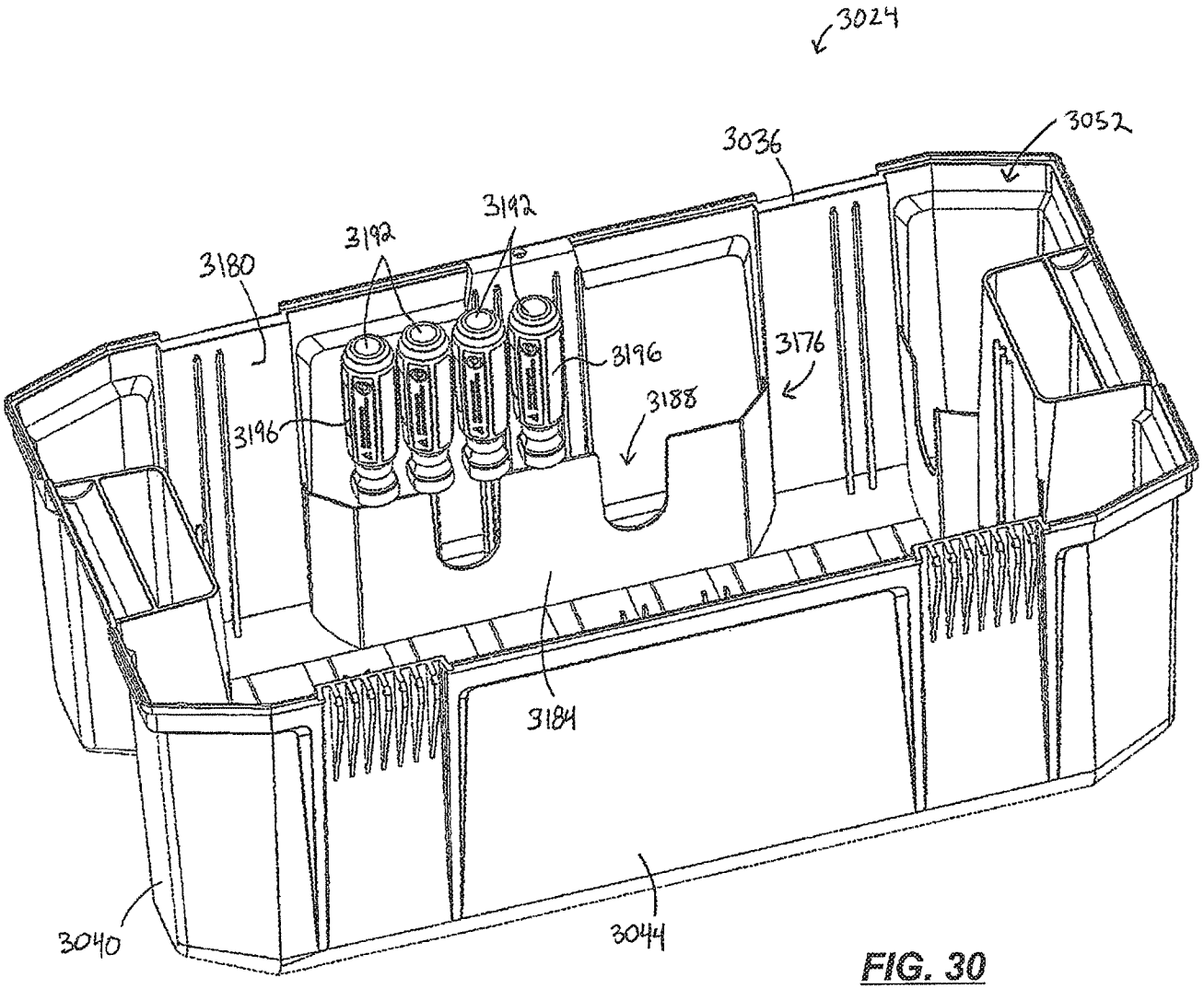
FIG. 30 is a rear perspective view of the container of FIG. 27, illustrated with various tools positioned within the container.

As shown in FIG. 30, the container 3024 includes a barrel storage area 3176 formed on an interior side 3180 of the sidewall 3036. The barrel storage area 3176 is defined by an inner wall 3184 of the container 3024. The inner wall 3184 extends inwardly from the sidewall 3036 to define a space 3188 between the sidewall 3036 and the inner wall 3184. The space 3188 is configured to receive hand tools, such as screwdrivers 3192, personal effects, etc. In the illustrated embodiment, the inner wall 3184 is sized to engage a handle 3196 of each screwdriver 3192 such that the screwdrivers 3192 are supported in an upright position within the barrel storage area 3176.

Figure 31:
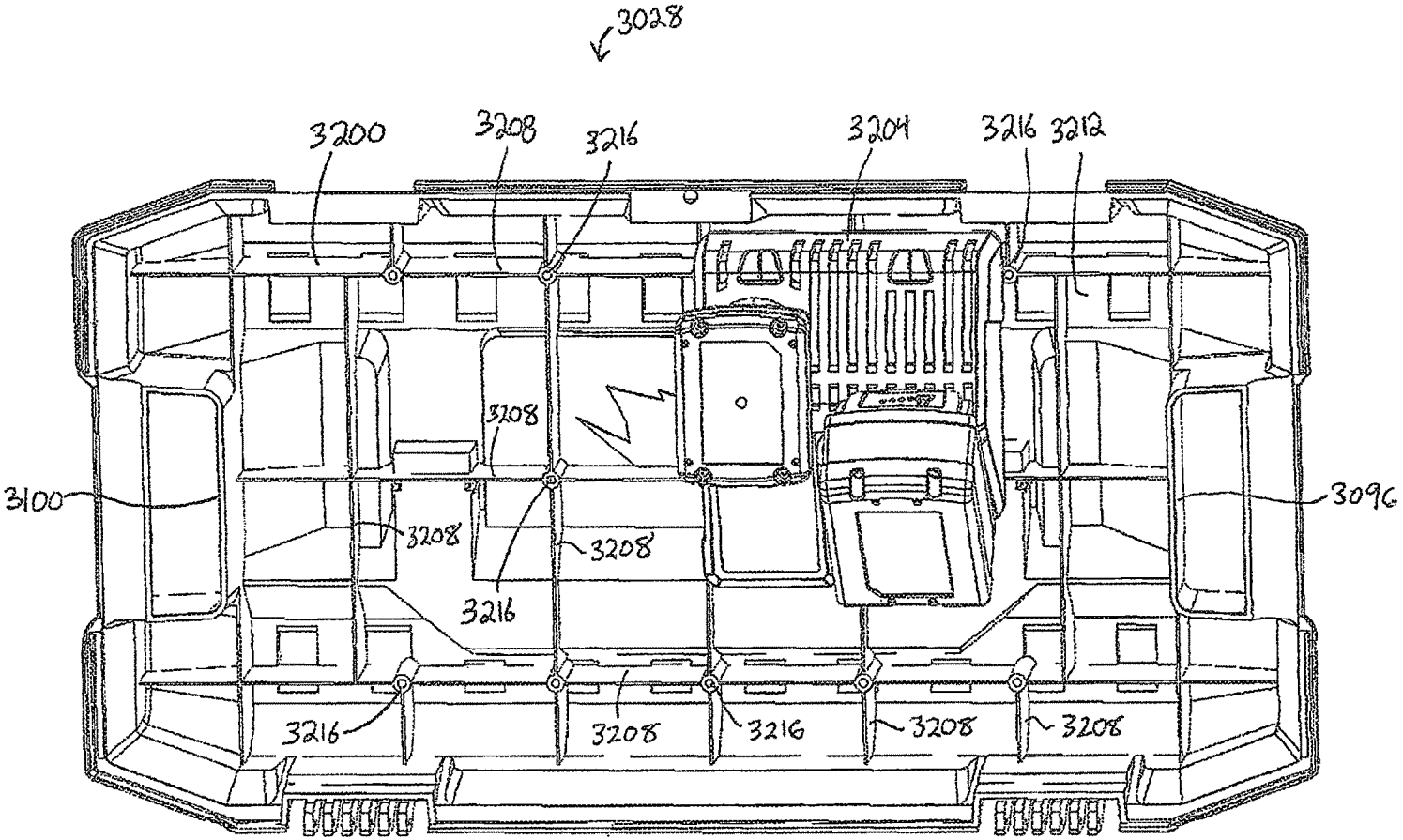
FIG. 31 is a bottom view of the lid of FIG. 25, illustrated with a battery charger coupled to the lid.
Figure 32:
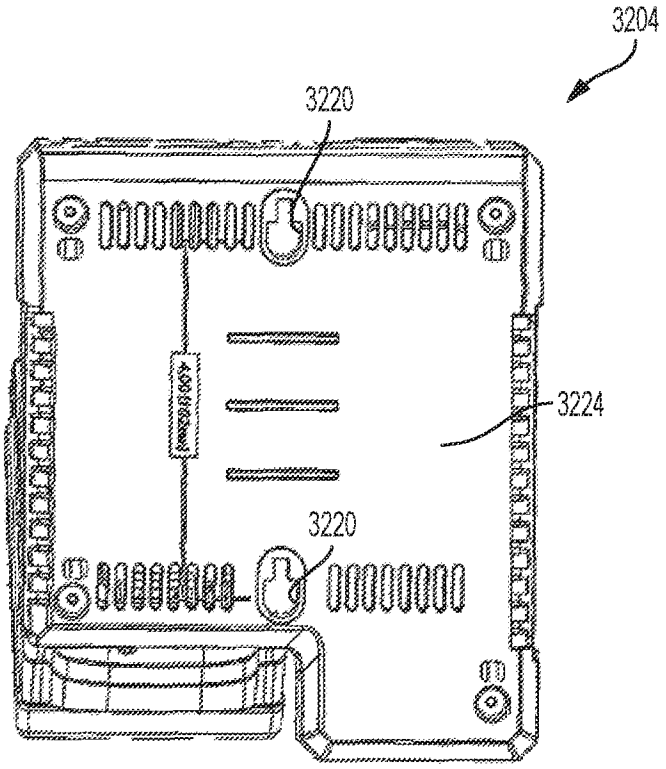
FIG. 32 is a bottom view of the battery charger shown in FIG. 31.

As shown in FIG. 31, the lid 3028 includes a mounting structure 3200 for supporting a battery charger 3204. The illustrated mounting structure 3200 includes ribs 3208 extending from an inner surface 3212 of the lid 3028. The ribs 3208 intersect at right angles to form a grid-like structure. Screw bosses 3216 are formed at the intersections of some of the ribs 3208. The screw bosses 3216 receive screws, or other fasteners, to mount the battery charger 3204 to the lid 3028. For example, as shown in FIG. 32, the battery charger 3204 includes two keyhole slots 3220 formed in a bottom surface 3224 and normally used to mount the battery charger 3204 to a wall. The keyhole slots 3220 engage two screws extending from the screw bosses 3216 of the lid 3028 (FIG. 31) to mount the charger 3204 to the lid 3028. When mounted to the lid 3028, the battery charger 3204 moves (e.g., pivots) with the lid 3028 relative to the container 3024 but is still stored within the storage area 3052 of the container 3024 when the lid 3028 is closed. The battery charger 3204 can be removed from and repositioned on the lid 3028, depending on the availability of other screw bosses 3216.

In some embodiments, the storage tray 3140 may also include keyhole slots to mount the tray 3140 to the mounting structure 3200. In further embodiments, other devices, such as cord wraps, lights, magnets, etc., may also or alternatively be mounted to the lid 3028 using the illustrated mounting structure 3200.

Figure 33:
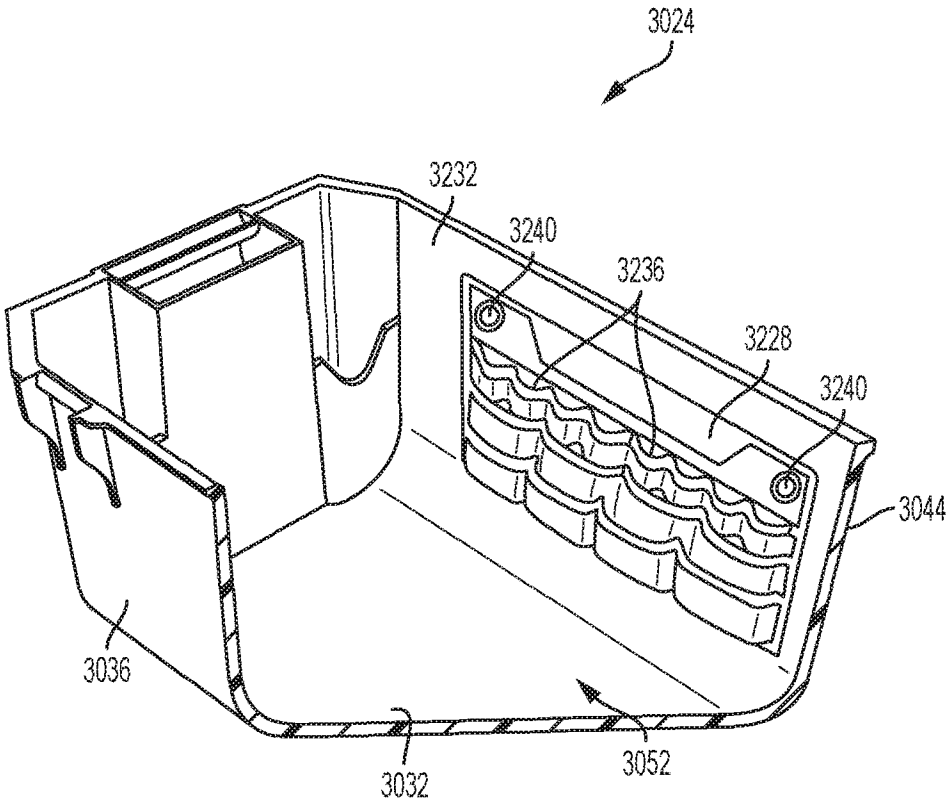
FIG. 33 is a cross-sectional perspective view of the container of FIG. 27, illustrated with a tool organizer.

As shown in FIG. 33, the toolbox 3020 also includes a tool organizer 3228 coupled to an interior side 3232 of the sidewall 3044 of the container 3024. The illustrated tool organizer 3228 is a fabric pouch including a plurality of pockets 3236 to receive different types of tools, bits, or other devices. The tool organizer 3228 is removably mounted to the container 3024 by openings 3240 that receive rivets, hooks, bosses, or other projections extending inwardly from the sidewall 3044.

In some embodiments, the toolbox 3020 may a water-tight and, in such embodiments, may not include any ingress or egress holes. In addition, the container 3024 and the lid 3028 may be formed by a two-shot injection molding process to provide a relatively elastic material that creates a seal at an interface between the container 3024 and the lid 3028. Alternatively, the toolbox 3020 may include an O-ring, gasket, or other elastomeric member located at the interface between the container 3024 and the lid 3028. In other embodiments, the toolbox 3020 may not be water-tight such that water can flow out of the container 3024 and air can circulate through the storage area 3052.

Figure 34:
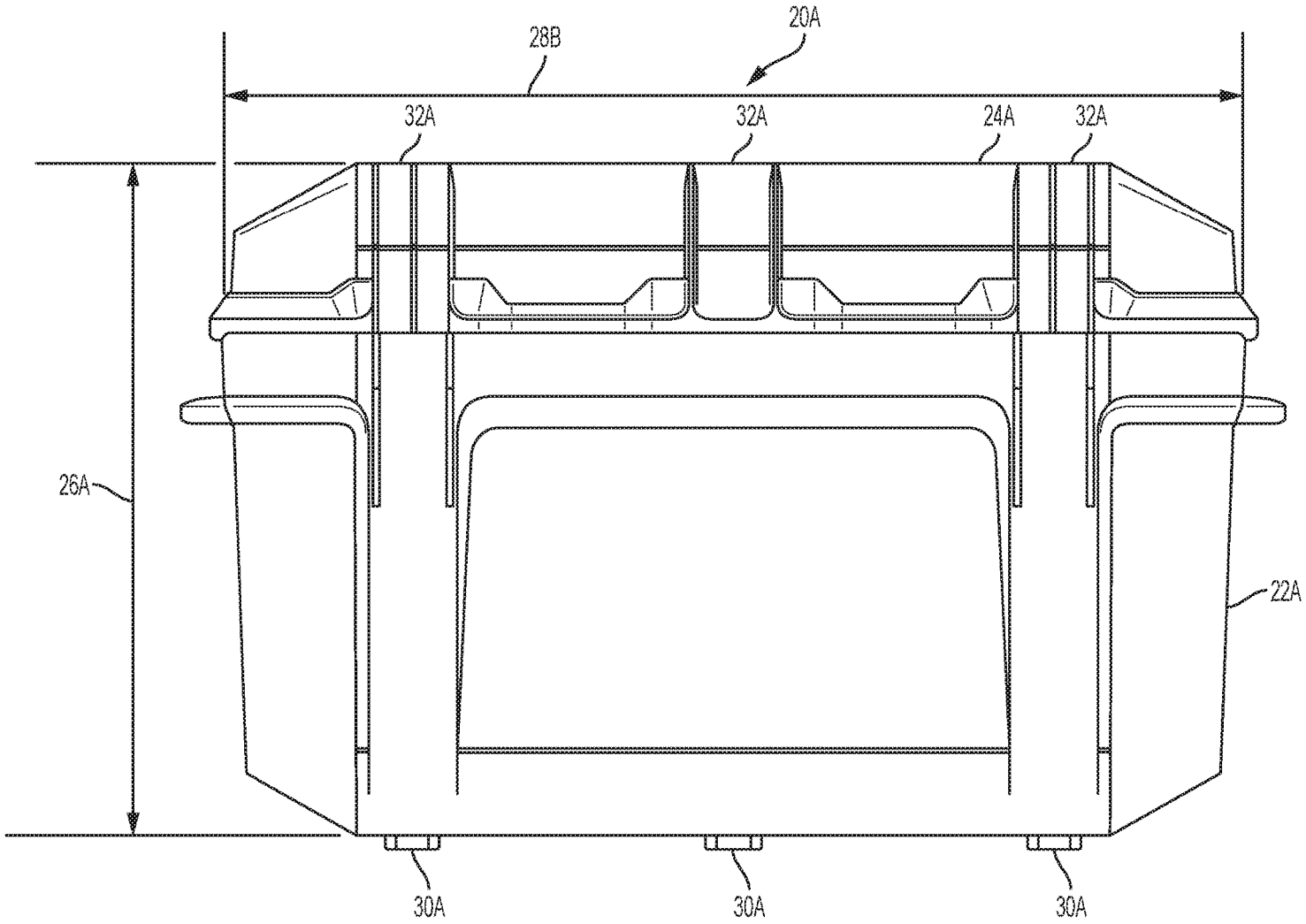
FIG. 34 is a side view of a tool storage device according to another independent embodiment.
Figure 47:
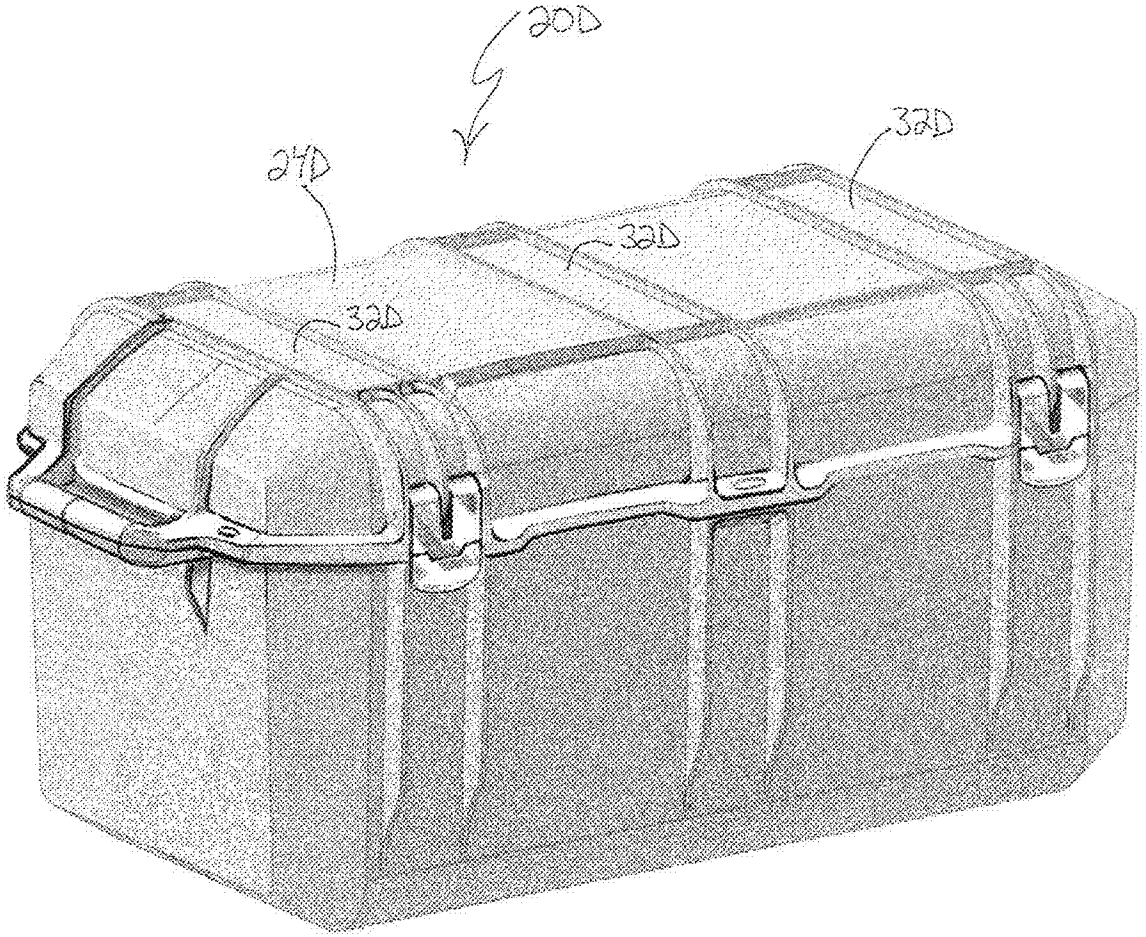
FIG. 47 illustrates a tool storage device according to another independent embodiment.

FIG. 34 illustrates a tool storage device 20A, such as a generally rigid tool box, including a container 22A and a removable lid 24A. The tool box 20A has a height 26A and a width 28B. The container 22A includes equally-spaced projections 30A that extend from the bottom of the container 22A, and the top of the lid 24A includes complementarily-spaced recess 32A. FIG. 47 illustrates a tool box 20D with a lid 24D having recesses 32D similar to the recesses 32A.

Figure 36:
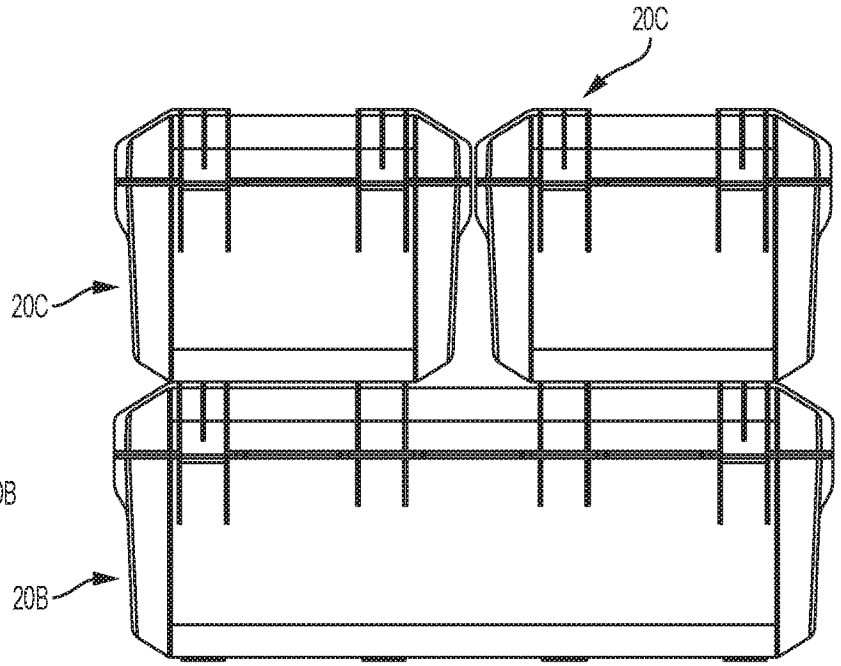
FIG. 36 is a side view of another plurality of tool storage devices according to independent embodiments of FIG. 37.
Figure 35:
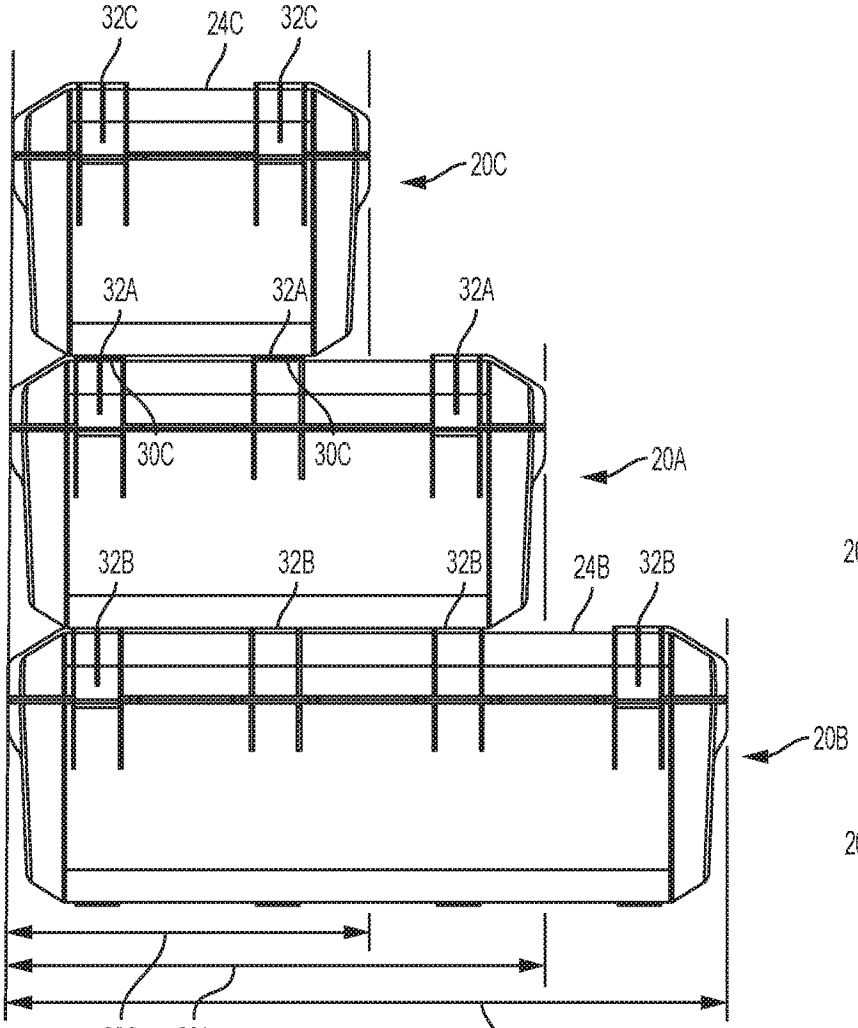
FIG. 35 is a side view of a plurality of tool storage devices according to independent embodiments.
Figure 37:
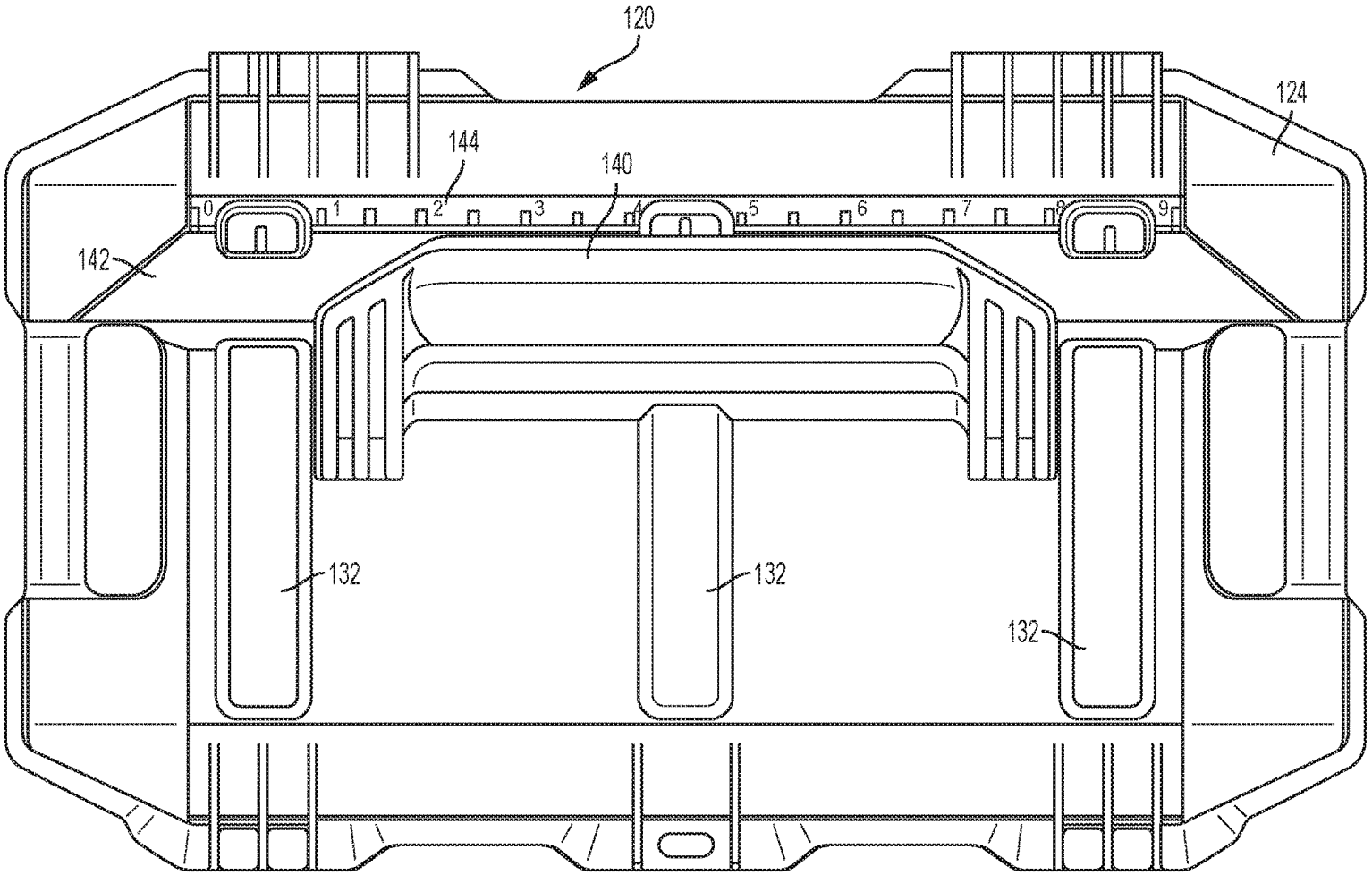
FIG. 37 is a top view of a tool storage device according to another independent embodiment.

Referring to FIGS. 35-36, the tool box 20A can be used as part of a set of tool boxes 20A-20C. The tool box 20B has a width 28B, and the width 28A of the box 20A is about two-thirds the width 28B of the box 20B. The box 20B includes a lid 24B with recesses 32B spaced and sized to receive projections 30A (FIG. 34) so that the tool box 20A can be securely stacked on top of and interlock with the box 20B.

The tool box 20C has a width 28C, and the width 28C of the box 20C is about one half the width 28B of the box 20B. The box 20C includes a lid 24C with recesses 32C and a container 20C with projections 30C spaced the same distance as the recess 32A, 32B. As illustrated in FIGS. 35-36, the box 20C can be securely stacked on either box 20A or 20B. The projections 30A, 30B, 30C can be received in the recesses 32A, 32B, 32C using a snap fit type connection to securely stack and interlock any suitable arrangement of boxes 20A, 20B, 20C.

FIGS. 37-40 illustrate a tool storage device 120, such as a generally rigid tool box, including a container 122 and a pivotable lid 124. The lid 124 includes recesses 132, similar to the recesses 32A, 32B, and 32C, discussed above, and the container 122 can include projections similar to the projections 30A, 30B, 30C, discussed above. The tool box 120 can thus be stacked with other tool boxes or the tool boxes 20A, 20B, 20C, as discussed above.

The lid 124 further includes a handle 140 pivotally coupled to the lid 124, a groove 142 adjacent the handle 140 and a ruler 144 adjacent and outside the groove 142. The handle 140, the groove 142, and the ruler 144 will be discussed in more detail below in regard to the embodiment of FIGS. 42-43.

Figure 38:
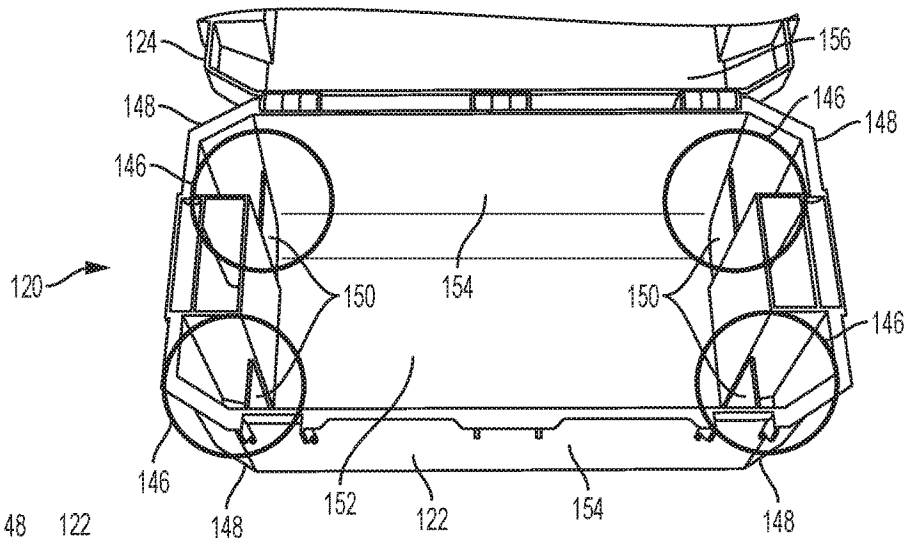
FIGS. 38-40 are perspective views of portions of the device of FIG. 37.
Figure 40:
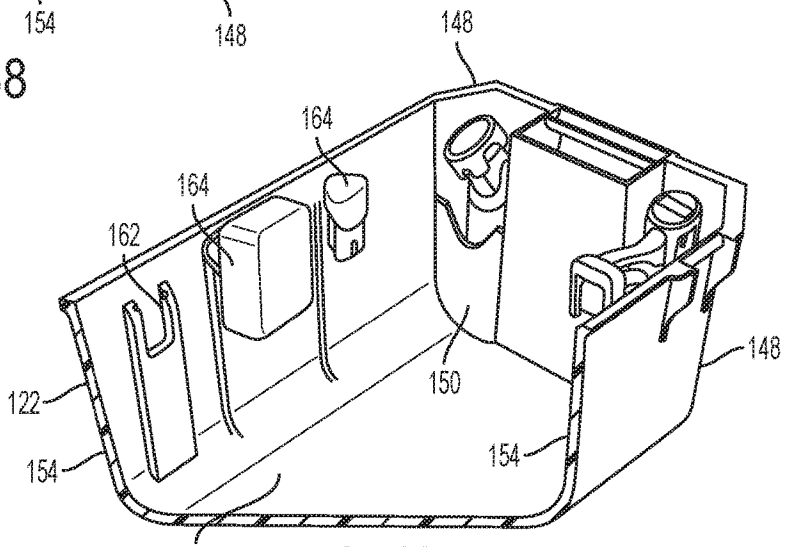
Figure 39:
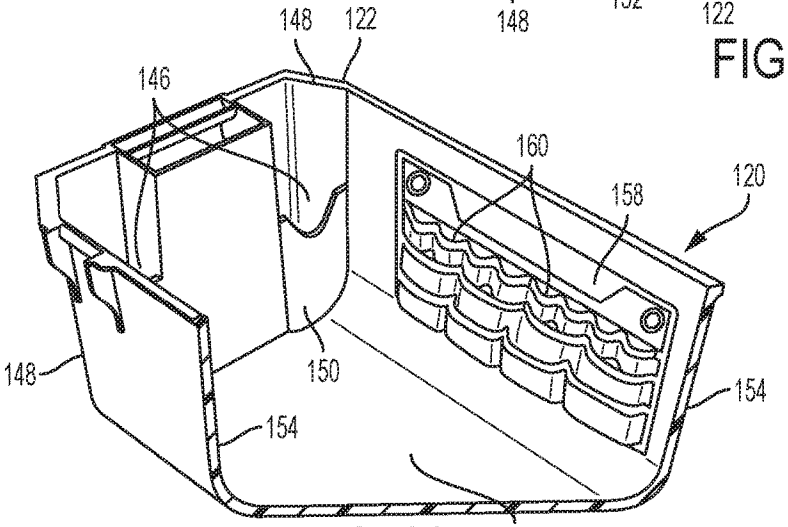

Referring to FIGS. 38-40, the container 122 includes storage compartments 146 formed at each corner 148. The compartments 146 are formed by a wall 150 that extends upwardly from a base 152 of the container 122. The walls 150 also attach to adjacent sidewalls 154 of the container 122. As illustrated in FIG. 39, the storage compartments 146 provide a place to store tools, such as, hand tools, flashlights, drills, etc. Also, the walls 150 in each corner 148 increase the rigidity and durability of the container 122.

An underside 156 (FIG. 38) of the lid 124 can include ridges or walls (not shown) to increase the rigidity of the lid 124, provide compartments for storing tools, fasteners, etc. A cover (not shown) can be provided for the underside 156 of the lid 124 to enclose such compartments. The cover may be provided with retaining members to prevent objects in one compartment from spilling into another compartment. As illustrated in FIG. 38, the lid 124 pivots open to a position generally parallel to the support surface, which would provide convenient access to any storage compartments on the underside 156 of the lid 124.

As illustrated in FIG. 40, the box 120 can include a removable soft organization panel 158. The panel 158 includes pockets 160 to store small items, such as hand tools, tool bits, etc., and can be hung on hooks, posts, other projections, etc. on one or more sidewalls 154 of the container 122. Further, the panel 158 can be removed and attached to a work belt, a second storage or tool box, a work surface, etc.

As illustrated in FIG. 39, the sidewall 154 can also include ribs or recesses 162 of different sizes corresponding to different size devices to be stored (e.g., power tool batteries 164). As illustrated in FIG. 39, the batteries 164 can be slid into the recess 162 to attach the batteries 164 to the sidewall 154 above the base 152 of the container 122.

Figure 41:
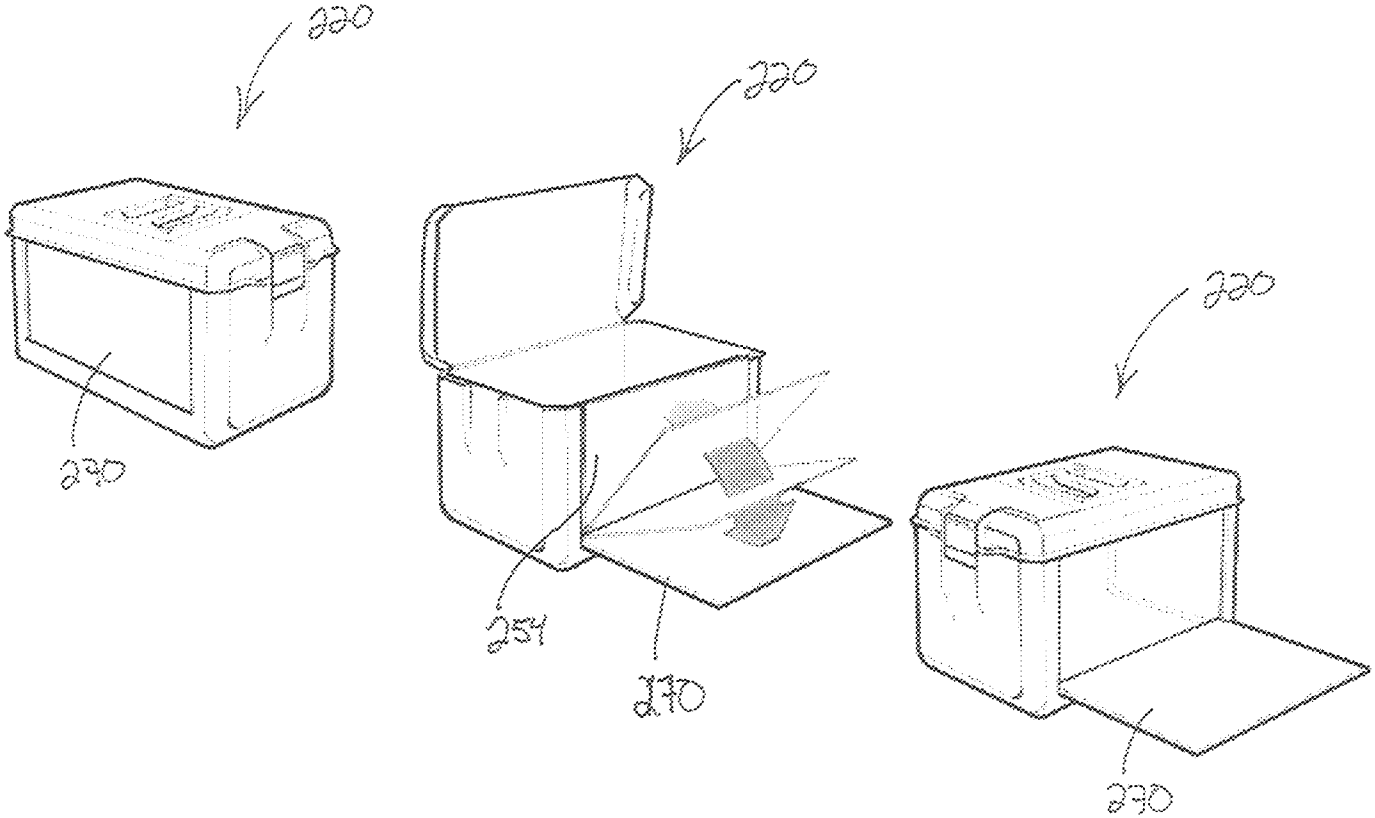
FIG. 41 illustrates a tool storage device according to another independent embodiment.

FIG. 41 illustrates a tool storage device 220, such as a generally rigid tool box, including any one or more of the features of the tool boxes 20, 120, etc., discussed above. The tool box 220 further includes a fold out flap 270 that folds out from a sidewall 254. The flap 270 can be configured to lay flush on the floor and provides a place to set tools, fasteners, etc. while the user sits on the tool box 220. The flap 270 can include a lip and/or a magnet to inhibit small items from rolling off.

Figure 42:
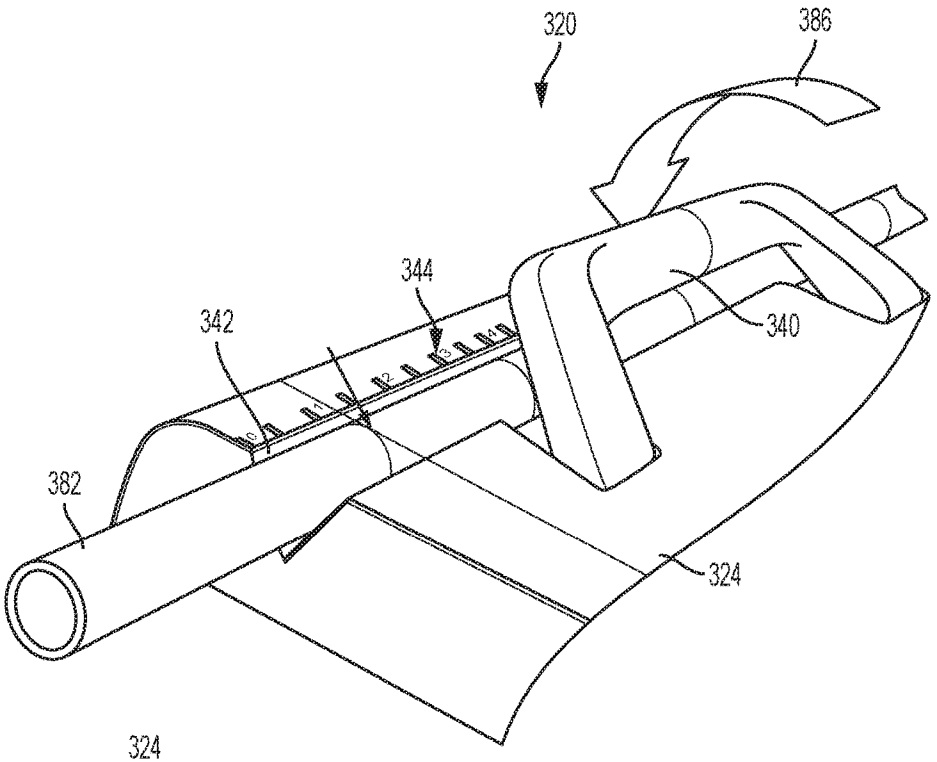
FIG. 42 is a perspective view of a portion of a tool storage device according to another independent embodiment.
Figure 43:
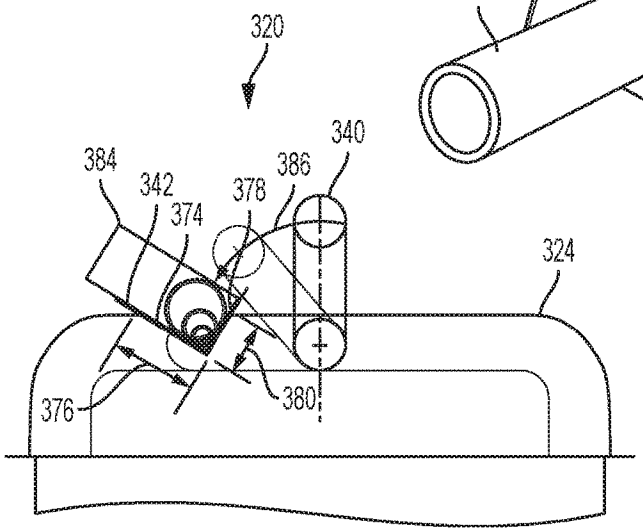
FIG. 43 is a side view of the device of FIG. 42, illustrating support of a work piece.

FIGS. 42-43 illustrate a tool storage device 320, such as a generally rigid tool box, including any one or more of the features of the tool boxes 20, 120, 220, etc., discussed above, and, likewise, the tool boxes 20, 120, 220, etc. can include features of the tool box 320 discussed below.

The tool box 320 includes a lid 324 having a handle 340 pivotally coupled to the lid 324, a groove 342 adjacent the handle 340 and a ruler 344 adjacent and outside the groove 342. The illustrated groove 342 is somewhat V-shaped but is asymmetric. Alternatively stated, the groove 342 has a first wall 374 having a first length 376 and second wall 378 having a different second length 380 (e.g., less the length 376 of the first wall 374). The walls 374, 378 are substantially perpendicular. The user can use the groove 342 to support a work piece, such as a conduit 382, a pipe, a wood stud 384, etc., and the user can pivot the handle 340 in the direction of arrow 386 to hold the work piece in the groove 342 and inhibit the work piece from moving (e.g., rotating, sliding) in the groove 342. The asymmetric shape of the groove 342 (discussed above) both holds the work piece in a more desirable position for cutting and inhibits the work piece from rotating in the groove 342 during cutting. The user can use the ruler 344 to measure the work piece and then cut the work piece to any desired length.

Figure 44:
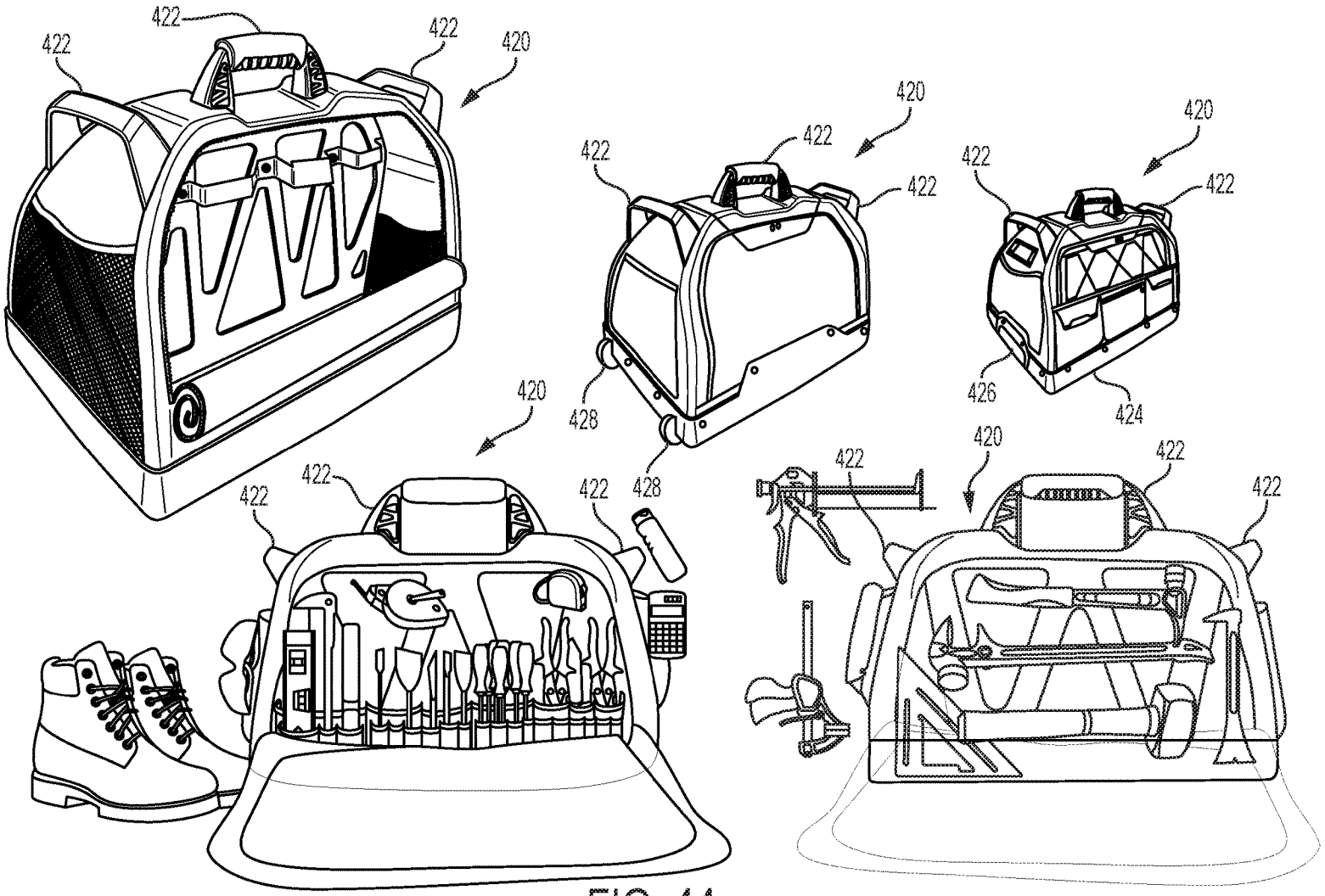
FIG. 44 illustrates a tool storage device according to another independent embodiment.

FIG. 44 illustrates a tool storage device 420, such as a generally soft-sided tool bag. The bag 420 includes handles 422 to carry or hang the bag 420. Also, the bag 420 includes rigid bottom 424. A handle 426 can telescope out from the bottom 424 of the bag 420 to allow the user to roll the bag on wheels 428.

Figure 45:
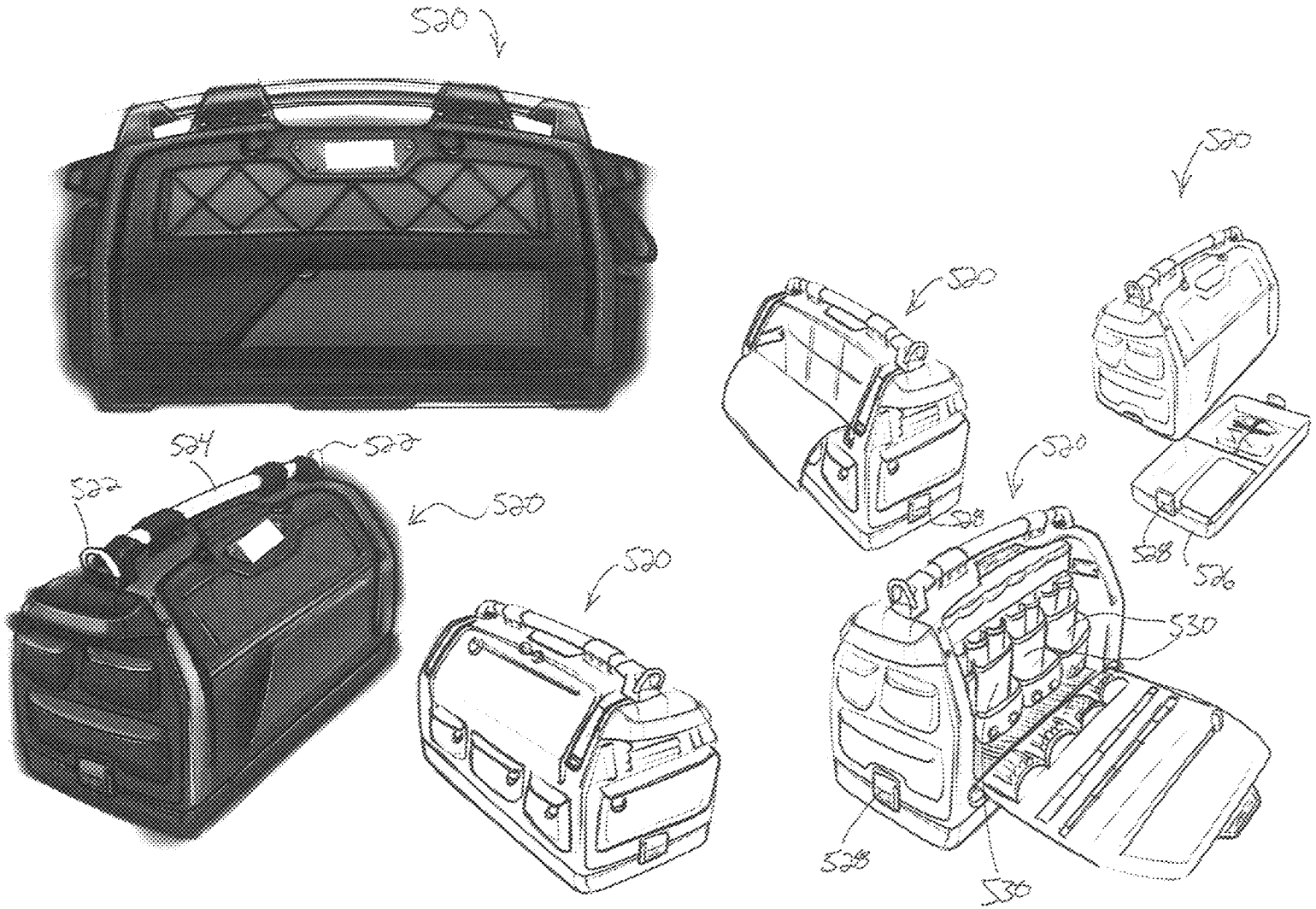
FIG. 45 illustrates a tool storage device according to another independent embodiment.

FIG. 45 illustrates a tool storage device 520, such as a generally soft-sided tool bag. The bag 520 includes rings 522 located at ends of a handle 524. The rings 522 can be used to attach a shoulder strap to the bag 520 or hang the bag 520. The bag 520 further includes a rigid bottom tray 526 removably attached to the bottom of the bag 520 with latches 528. The tray 526 can be used to store tools, personal items (cell phone, wallet, etc.). The illustrated bag 520 further includes pockets 530 inside the bag 520. The pockets 530 can be removed from the bag 520 and attached to a tool belt.

Figure 46:
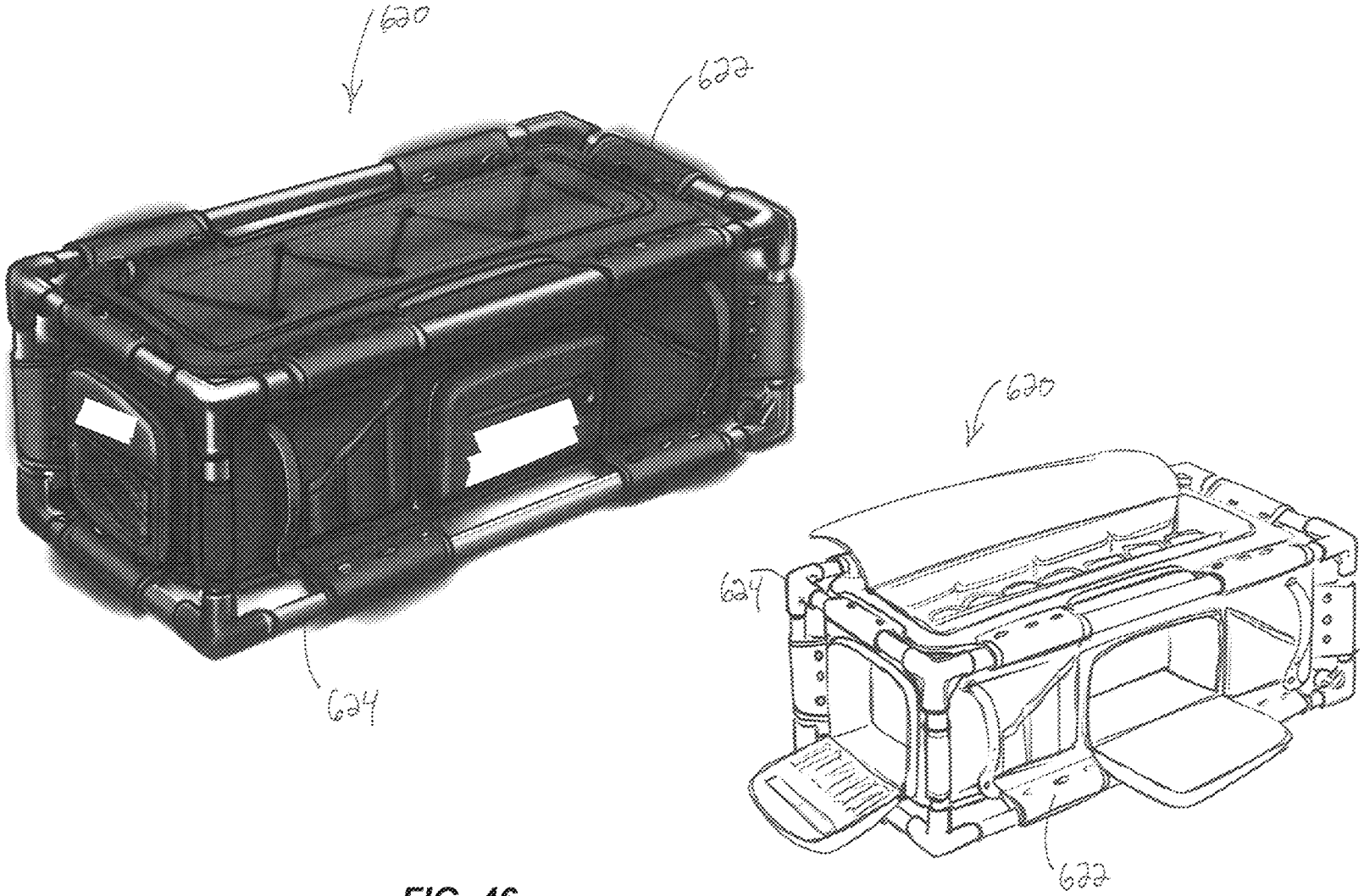
FIG. 46 illustrates a tool storage device according to another independent embodiment.

FIG. 46 illustrates a tool storage device 620 including a generally soft-sided bag 622 and a rigid frame 624. The rigid frame 624 allows the user to stack multiple bags 620 while protecting the contents of the bag 620 from the weight of other bags or material.

FIGS. 48-55 illustrate a tool storage device 720, such as a tool bag, including a generally soft-sided body 724, a carrying handle 728, and a carrying strap 732. The body 724 includes a zippered cover 736 to selectively open (FIG. 49) and close (FIG. 48) the bag 720. The cover 736 includes an upper portion 740 and a lower portion 744. The cover portions 740, 744 are independently openable and closeable. When opened, the upper cover portion 740 fits underneath the carrying handle 728 to stay out of the way.

The bag 720 also includes a relatively hard base 748 coupled to the body 724. The base 748 includes detents and/or recesses formed on an outer lower surface to mate with complementary structure of other tool storage devices for stacking the bag 720.

Figure 49:
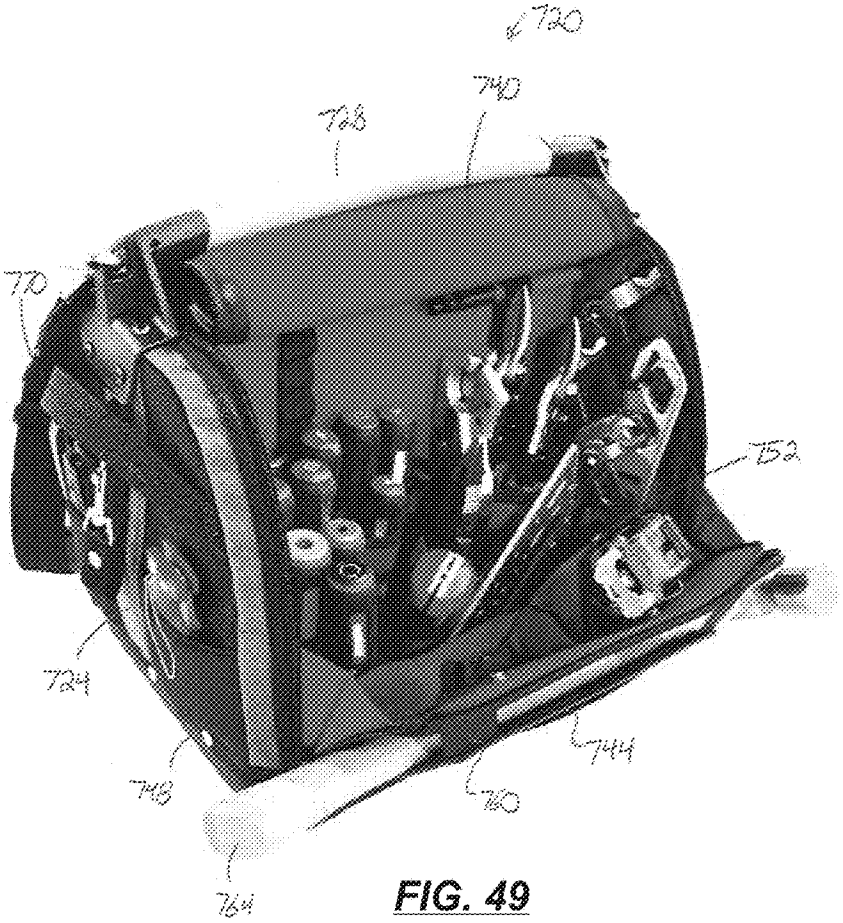
FIG. 49 is a front perspective view of the device of FIG. 48, illustrated in an open position.
Figure 48:
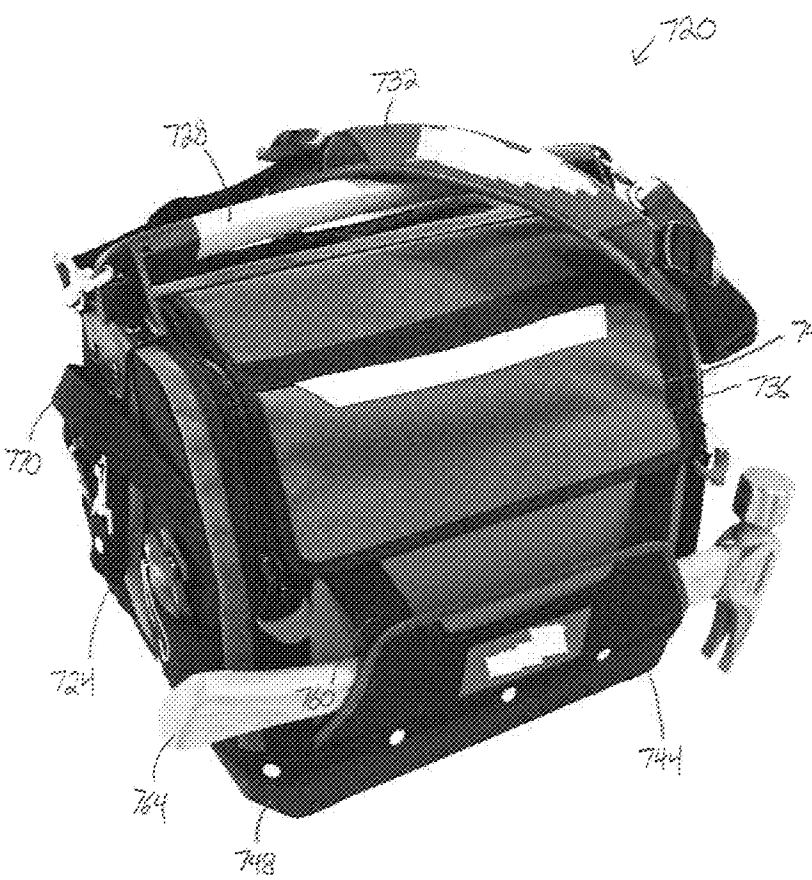
FIG. 48 is a front perspective view of a tool storage device according to another independent embodiment, illustrated in a closed position.
Figure 51:
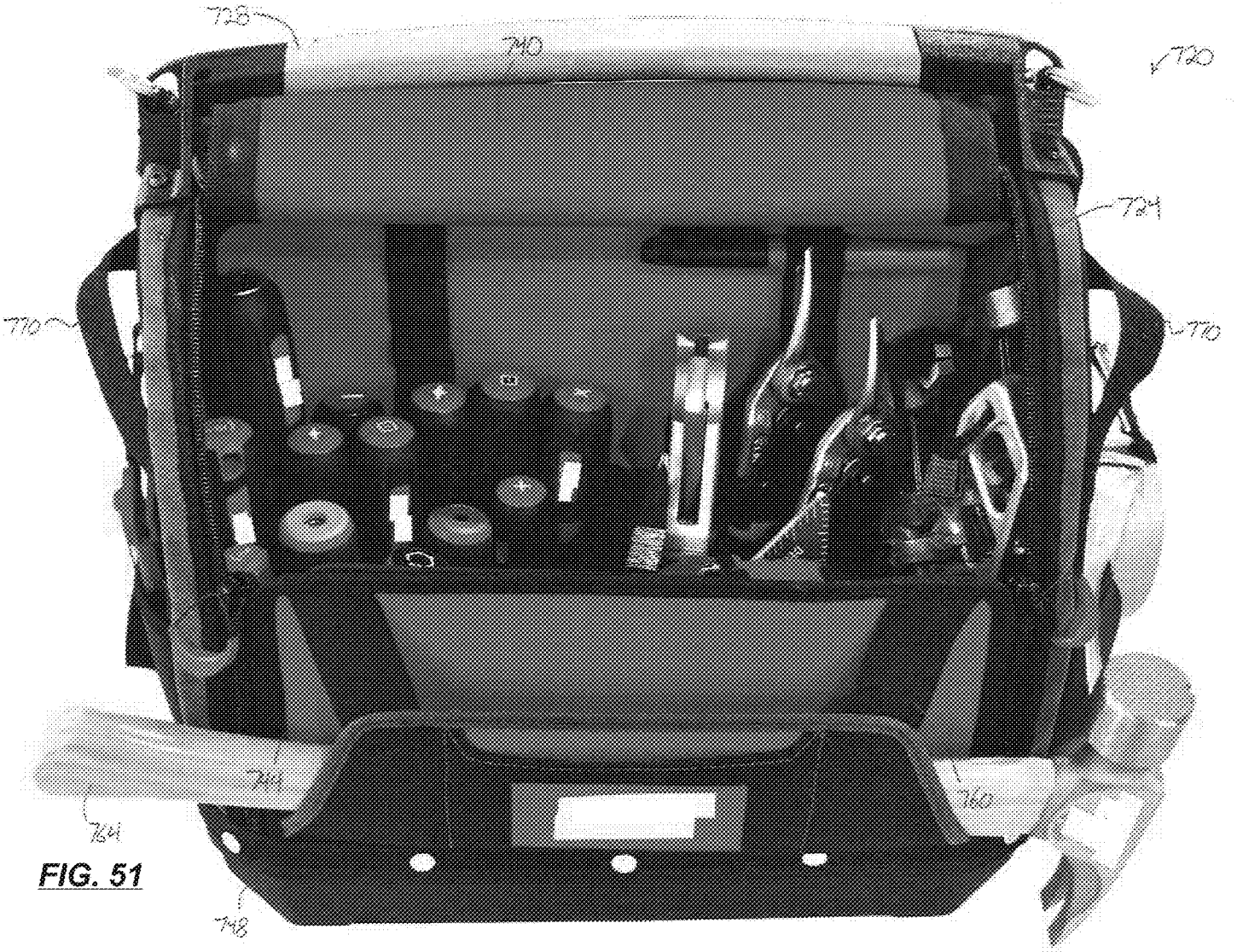
FIG. 51 is a front view of the device of FIG. 48, illustrated in a partially-open position.
Figure 52:
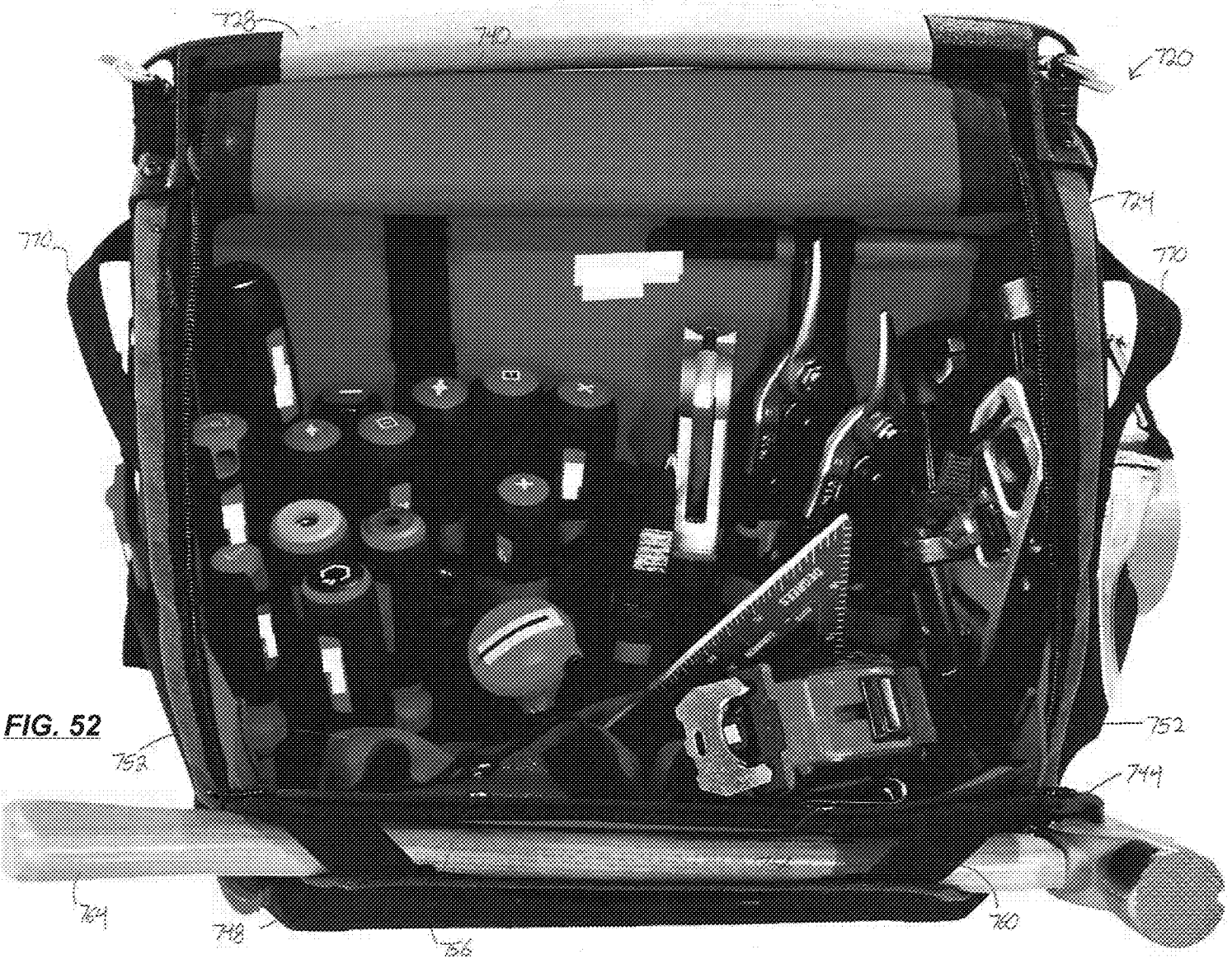
FIG. 52 is a front view of the device of FIG. 48, illustrated in the open position.

As shown in FIGS. 49 and 51-52, the body 724 includes pockets 752 for storing a variety of tools. At least some of the pockets 752 include snaps 756 that allow the pockets 752 to be resized to receive larger or smaller tools, devices, etc. The illustrated pockets 752 are also bottomless—that is, the pockets 752 are not closed at the bottom such that small items (e.g., nails, screwdriver bits, etc.) do not become stuck and lost in the individual pockets 752. Rather, the small items fall through the pockets 752 to the bottom of the body 724 to be more easily retrieved.

Figure 50:
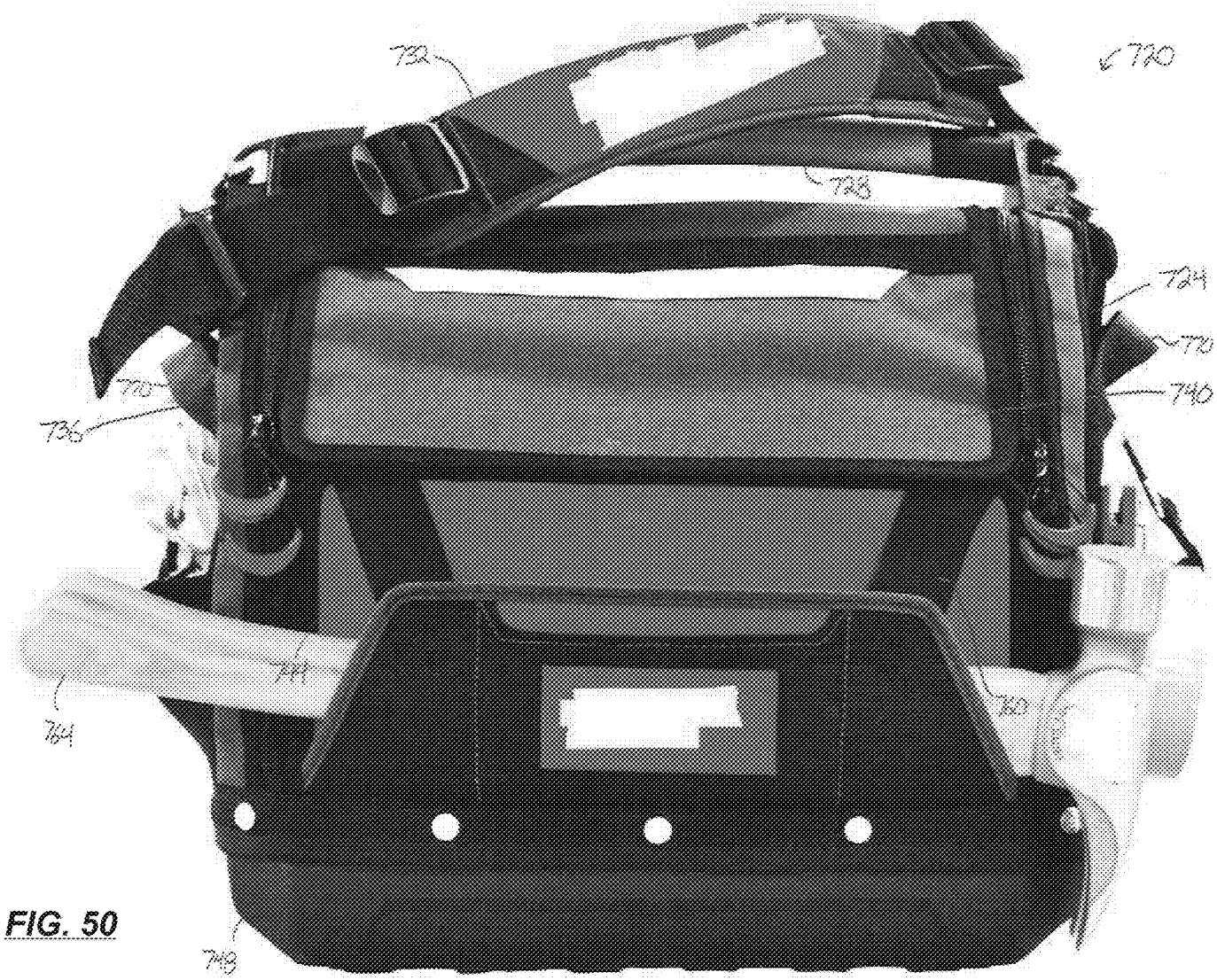
FIG. 50 is a front view of the device of FIG. 48, illustrated in the closed position.

As shown in FIGS. 50-51, the lower cover portion 744 includes an outer strap assembly 760 for holding a relatively long tool 764, such as a hammer. The outer strap assembly 760 provides easy and quick accessibility to the long tool 764.

As shown in FIGS. 51-52, the bag 720 also includes two side handles 770. The illustrated side handles 770 are made of a fabric material. In some embodiments, the side handles 770 may include a plastic, rubber, elastomeric overlay to facilitate grasping and carrying the bag 720.

Figures 53, 54, 55:
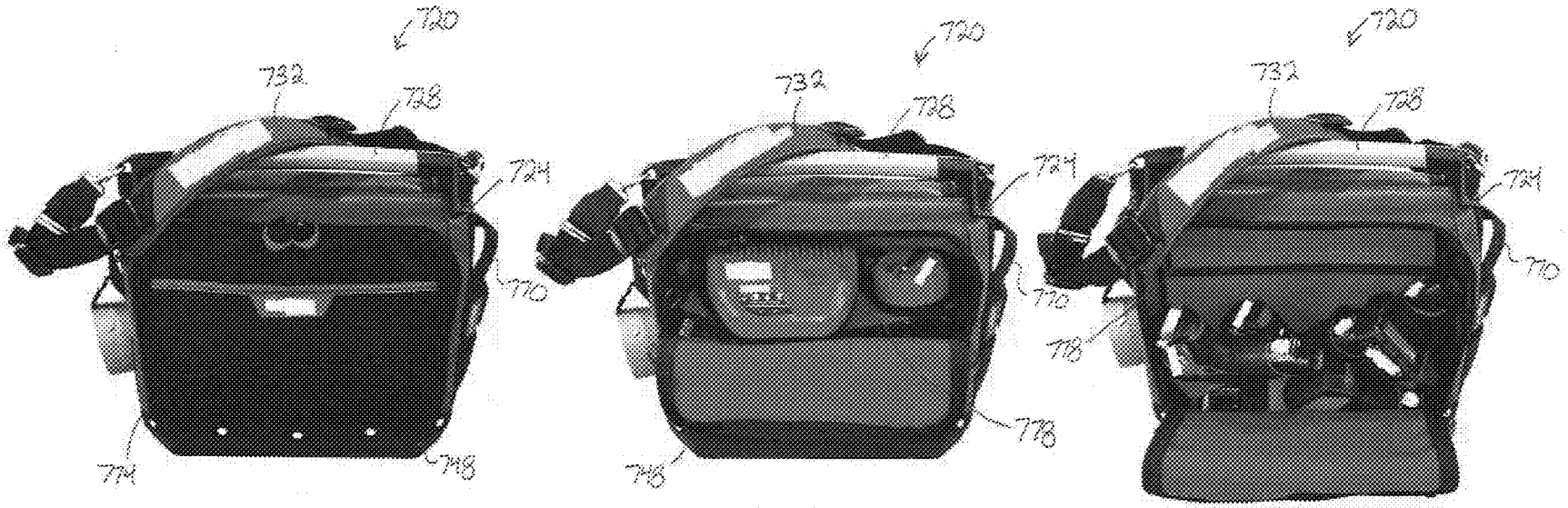
FIG. 53 is a rear view of the device of FIG. 48, illustrated in a closed position.
FIG. 54 is a rear view of the device of FIG. 48, illustrated in a partially-open position.
FIG. 55 is a rear view of the device of FIG. 48, illustrated in an open position.
Figure 56:
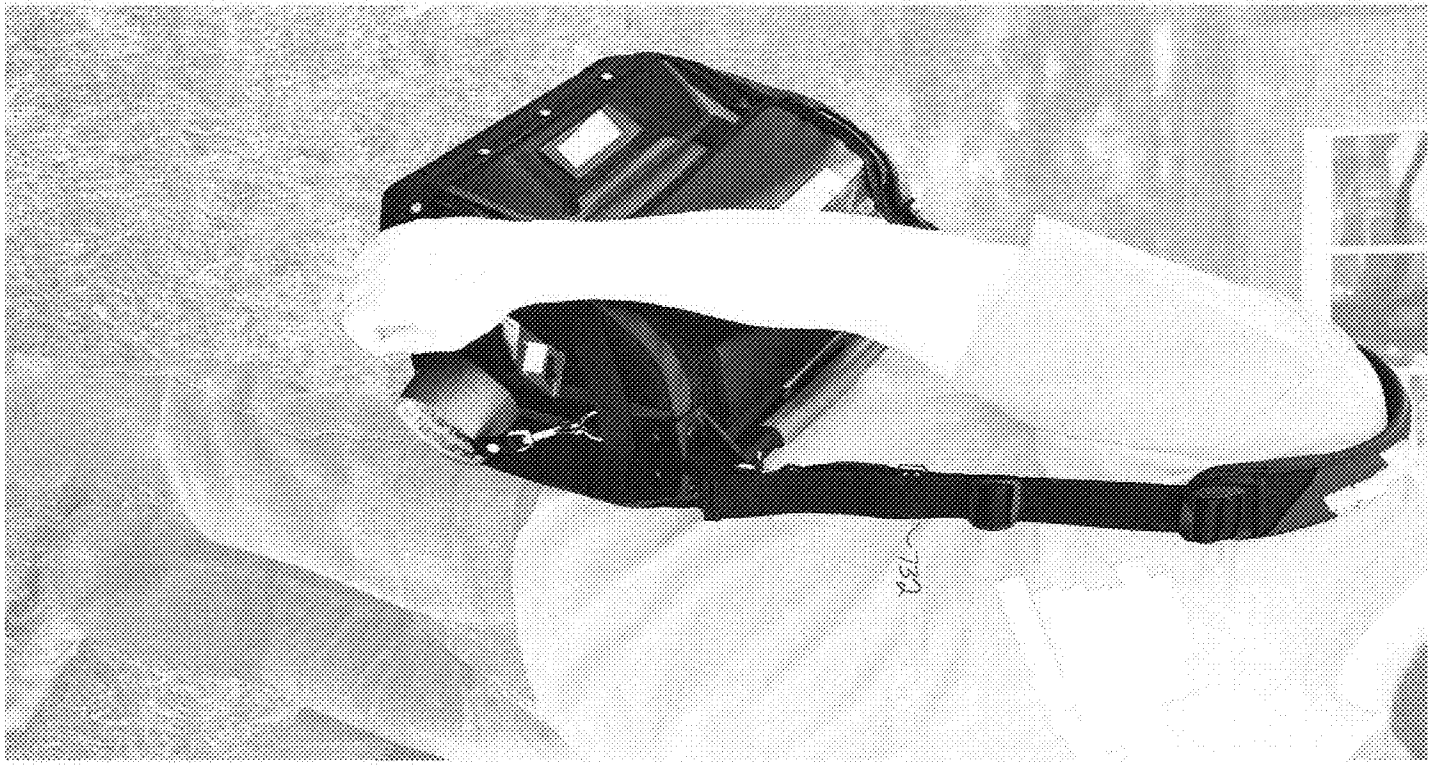
FIG. 56 illustrates a user carrying the device of FIG. 48.

FIG. 53 illustrates a rear side of the bag 720, and the body 724 includes a second zippered cover 774 located on the rear side. The cover 774 has a relatively smooth outer surface (compared to the first cover) and is padded. When a user is carrying the bag 720 by the carrying strap 732 (as shown in FIG. 56), the second cover 774 can contact the user in a more comfortable manner than the first cover 736. In the illustrated embodiment, the inner surfaces of the body 720 and the covers 736, 774 are of a lighter color (e.g., red) such that the interior of the bag 720 is brighter and more visible (compared to a black bag).

As shown in FIGS. 54-55, the bag 720 includes a support shelf 776 positioned inside the body 724. The support shelf 776 is a drop-down shelf that is pivotally coupled to an interior of the body 724 by two straps. In some embodiments, the support shelf 724 may include a relatively rigid plastic insert surrounded by a fabric material. In a lowered position (FIG. 54), the shelf 776 can support tools, and, in a raised position (FIG. 55), the shelf 776 is moved out of the way to facilitate access to other tools stored within the bag 720. In some embodiments, the support shelf 776 may include snaps, retainers, etc. to selectively hold the shelf 776 in the raised position.

Figure 57:
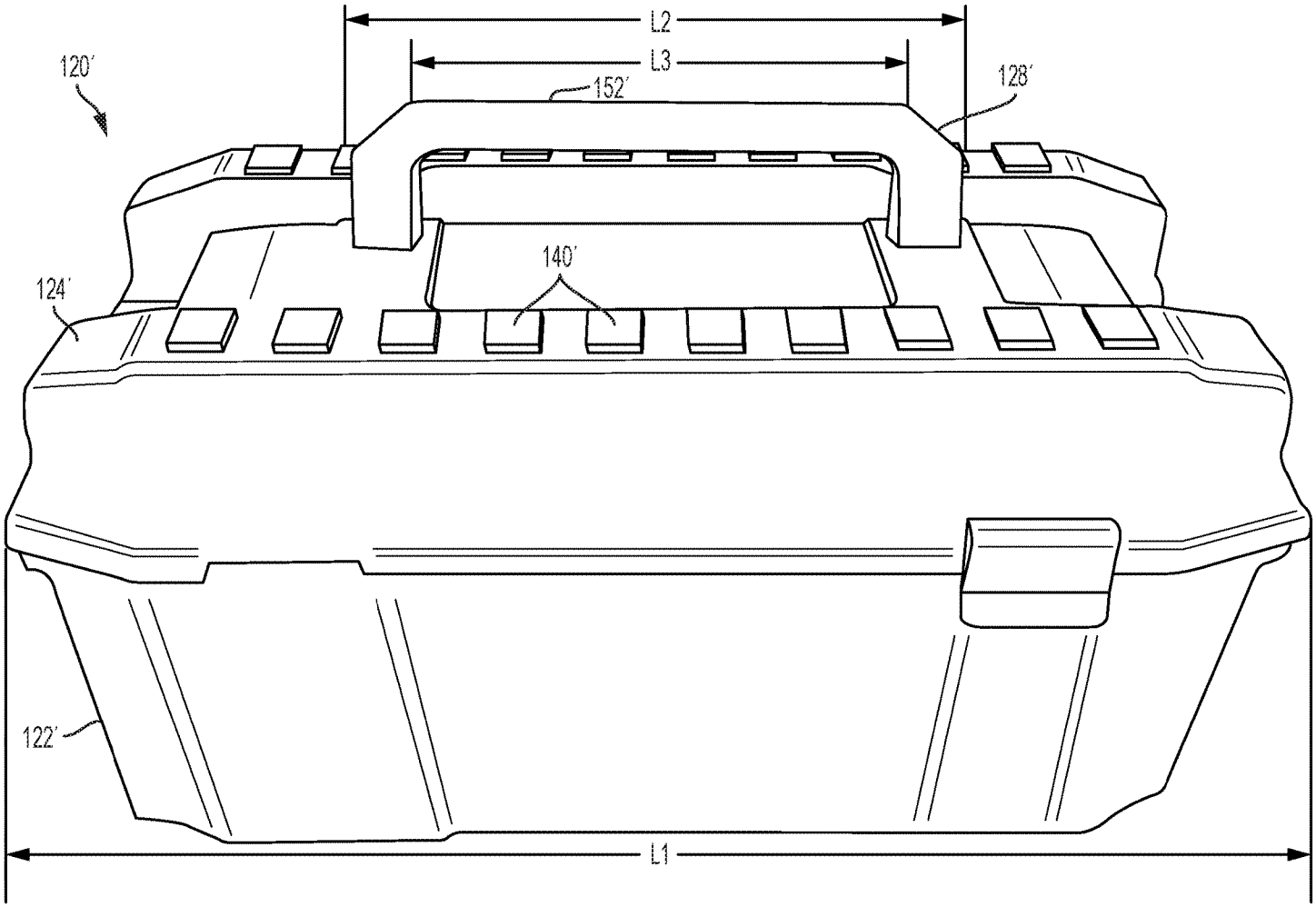
FIG. 57 is a front perspective view of a tool storage device according to another independent embodiment, illustrated in a closed position.
Figure 58:
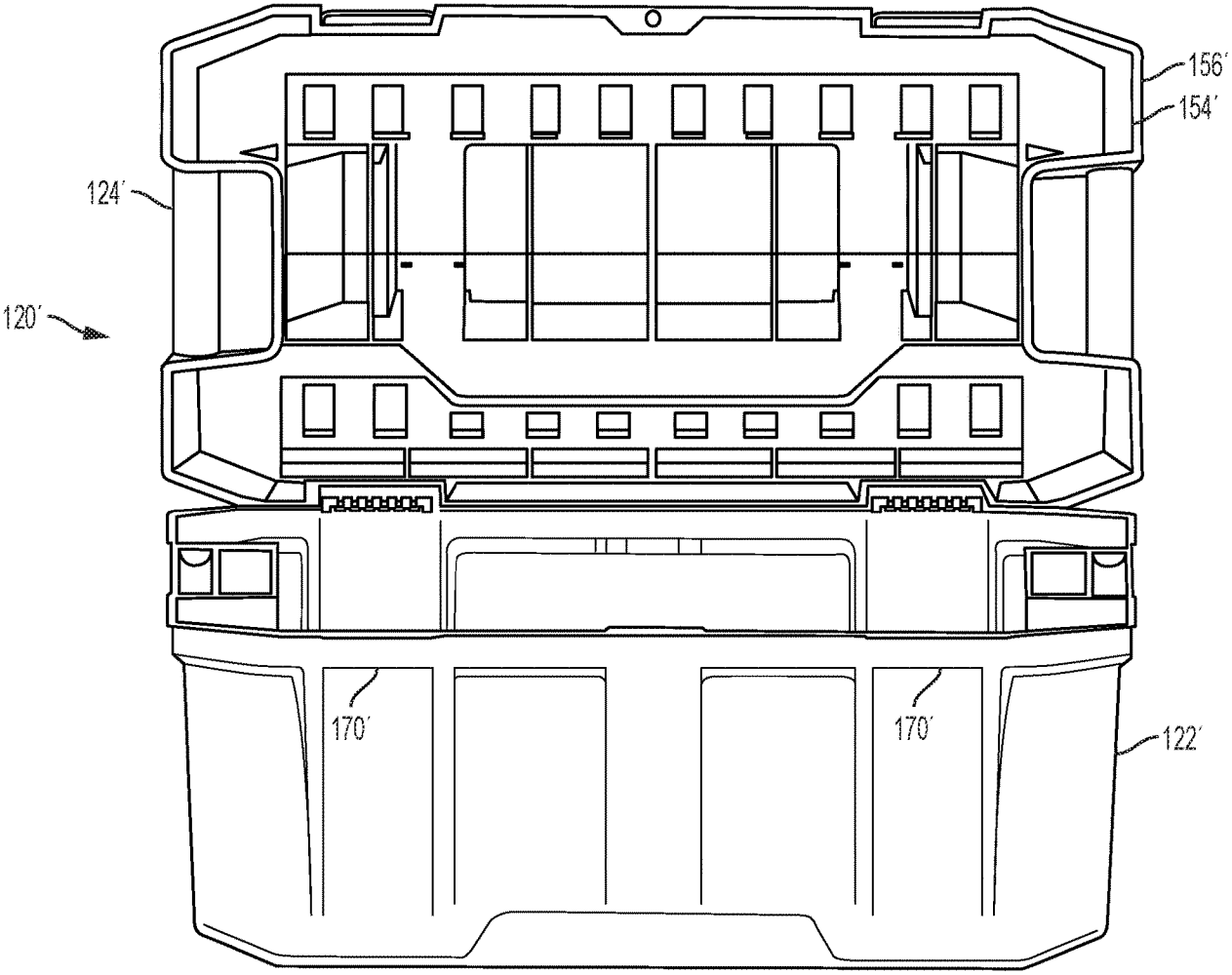
FIG. 58 is a front perspective view of the device of FIG. 57, illustrated in an open position.

FIGS. 57-58 illustrate a tool storage device 120', such as a generally rigid tool box, including a container 122' and a pivotable lid 124'. The lid 124' includes projections 140', and the container 122' can include complementary recesses (not shown) spaced and sized to receive the projections 140' so that multiple devices 120' can be securely stacked on top of one another.

With reference to FIG. 57, the lid 124' further includes a handle 128' pivotally coupled to the lid 124'. In the illustrated embodiment, the tool storage device 120' defines an overall length L1 of about 26 inches, permitting, for example, a standard 24 inch level to be stored within the container 122'. The handle 128' defines an overall length L2 of about 12 inches and has a grip portion 152' with a length L3 of about 10 inches. The grip portion 152' is long enough to permit a two-handed grip on the handle 128'. In addition, the relatively long grip portion 152' allows a user to select a gripping location on the handle 128' that provides optimum possible balance, particularly if the container 122' is loaded unevenly. A ratio of the length L2 of the handle to the length L1 of the tool storage device 120' is about 0.55 to about 0.35 (about 0.46 in the illustrated construction). A ratio of the grip portion length L3 of the handle 128' to the length L1 of the tool storage device 120' is about 0.50 to about 0.30 (about 0.39 in the illustrated construction).

Referring to FIG. 58, an elastomeric seal 154' extends along the perimeter of the lid 124'. When the lid 124' is closed, the seal 154' inhibits the ingress of water, contaminants into the container 122'. In the illustrated embodiment, the seal 154' is press-fit within a groove 156' of the lid 124' but may be affixed to the lid 124' by adhesive or by any other suitable means or affixed to the perimeter of the container 122'.

Figure 59:
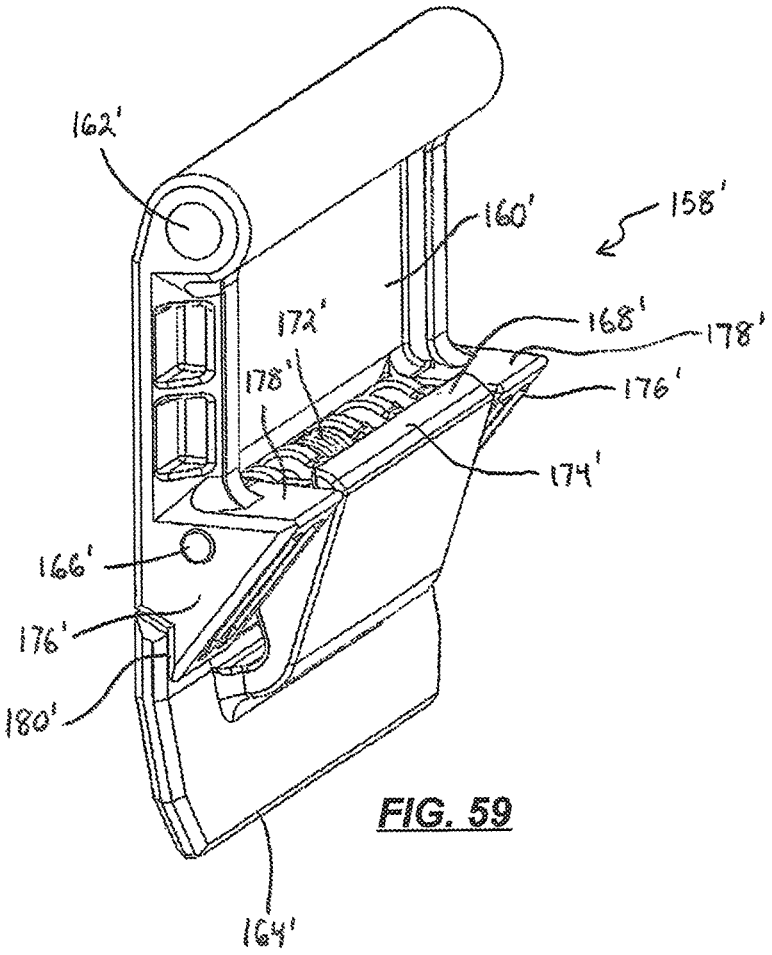
FIG. 59 is a perspective view of a latch according to one independent embodiment and usable with the tool storage device of FIG. 57.
Figure 60:
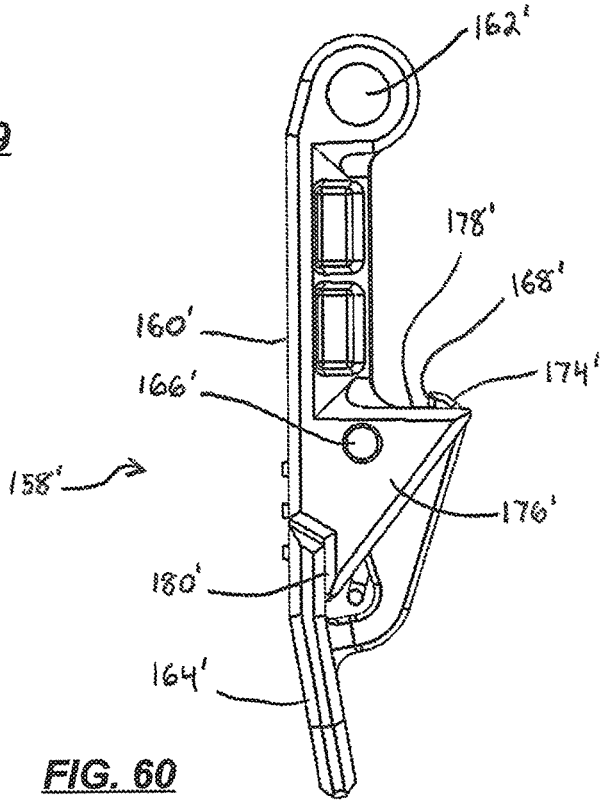
FIG. 60 is a side view of the latch of FIG. 59.

FIGS. 59-60 illustrate a latch 158' usable with the tool storage device 120'. The latch 158' selectively secures the lid 124' in a closed position. The latch 158' may be used individually, or may be one of a plurality latches 158'. The latch 158' includes a latch body 160' and a main hinge pin 162' that pivotally couples the latch body 160' to the lid 124' (FIG. 59). The latch 158' further includes a pull tab 164' pivotally coupled to the latch body 160' by a second hinge pin 166'. A hook 168' is disposed on the underside of the pull tab 164' and is engageable with a lip 170' on the container 122' (FIG. 58).

To disengage the latch 158' (e.g., to open the lid 124'), a user grasps the pull tab 164' and pivots the pull tab 164' relative to the latch body 160' against the biasing force a spring 172' (FIG. 59). This movement disengages the hook 168' from the lip 170', allowing the latch body 160' to pivot about the main hinge pin 162' and allowing the lid 124' to open. To engage the latch 158' (e.g., to close the lid 124'), the user presses the latch body 160' towards the lip 170'. The hook 168' includes a cam surface 174' that bears against the lip 170', pivoting the pull tab 164' away from the lip 170'. Once the cam surface 174' clears the lip 170', the biasing force of the spring 172' engages the hook 168' with the lip 170'.

With reference to FIG. 59, the latch 158' further includes a pair of generally triangular projections 176' through which the second hinge pin 166' passes. Each of the projections 166' includes a first side 178' engageable with the lip 170' to aid in securing the lid 124' in the closed position. Each of the projections 166' also includes a second side 180' generally perpendicular to the first side that acts as a stop surface for the pull tab 164'.

Figure 61:
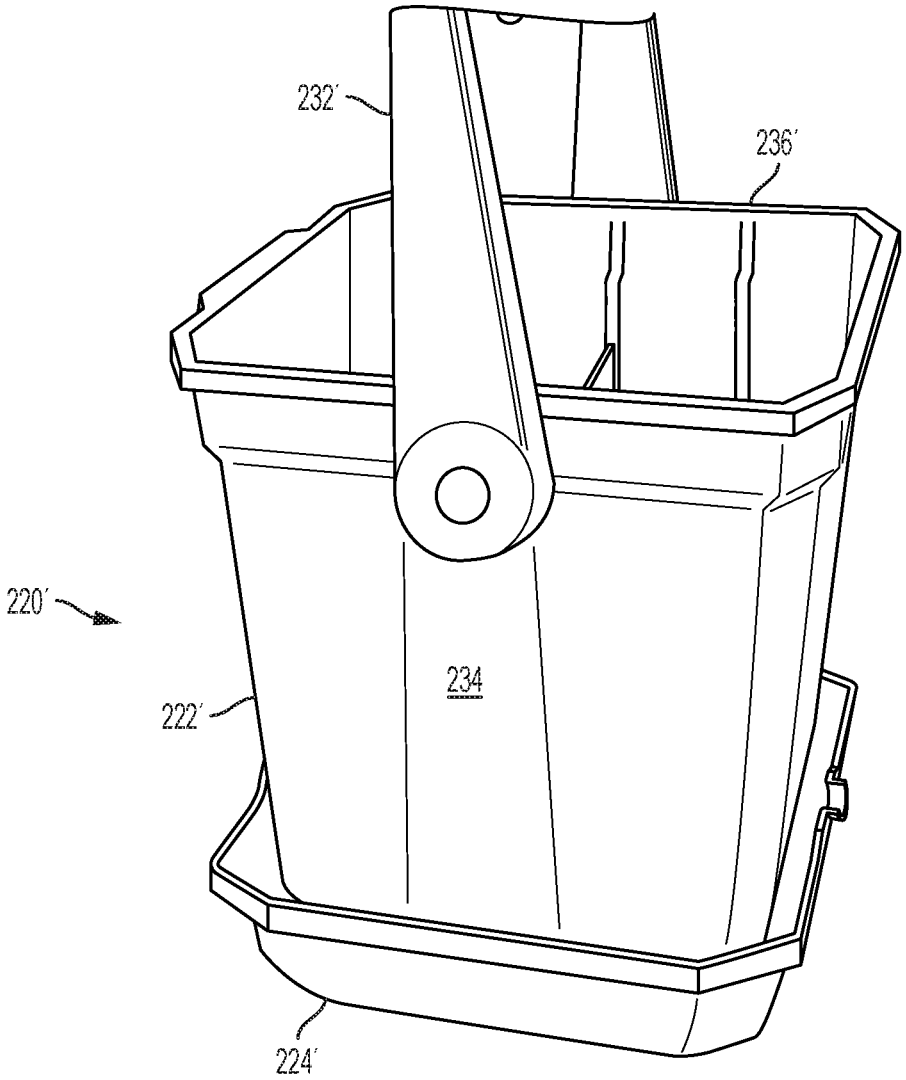
FIG. 61 is a perspective view of a tool storage device according to another independent embodiment.

FIG. 61 illustrates a tool storage device 220' including any one or more of the features of the tool storage device 120', etc., discussed above, and likewise the tool storage device 120', etc., can include features of the tool storage device 220' discussed below.

Figure 65:
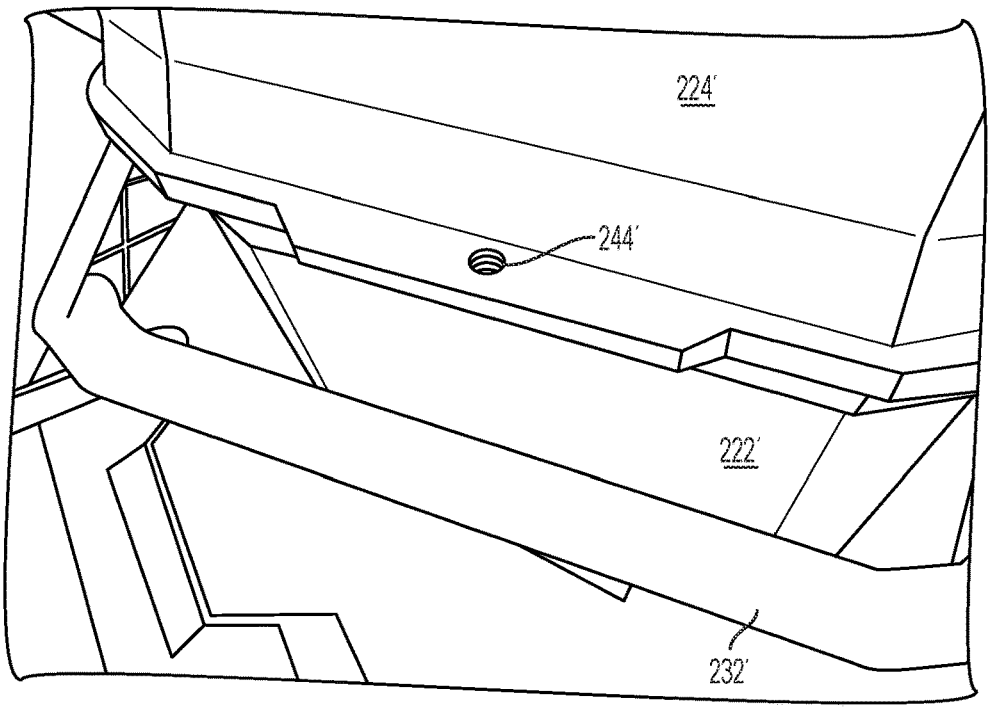
FIG. 65 is a perspective view of a portion of the device of FIG. 61, illustrated with the lid in a closed position.

The tool storage device 220' is a generally rigid tool box and includes a container 222' and a lid 224'. The device 220', the container 222' and the lid 224' each have a generally square cross-section. The illustrate container 222' generally tapers outwardly from the bottom toward the top. The lid 224' is attachable at the rim to the top of the container 222' (FIG. 65) in a closed position. The lid 224' is also attachable, for example, by a friction fit, at a position inwardly of the rim to the bottom of the container 222' (FIG. 61) in an open position to retain the lid 224' is retained with the container 222' (e.g., when moving the tool storage device 220'). In some embodiments, the tool storage device 220' is sufficiently strong so as to be usable as a support, stool, etc.

Figure 64:
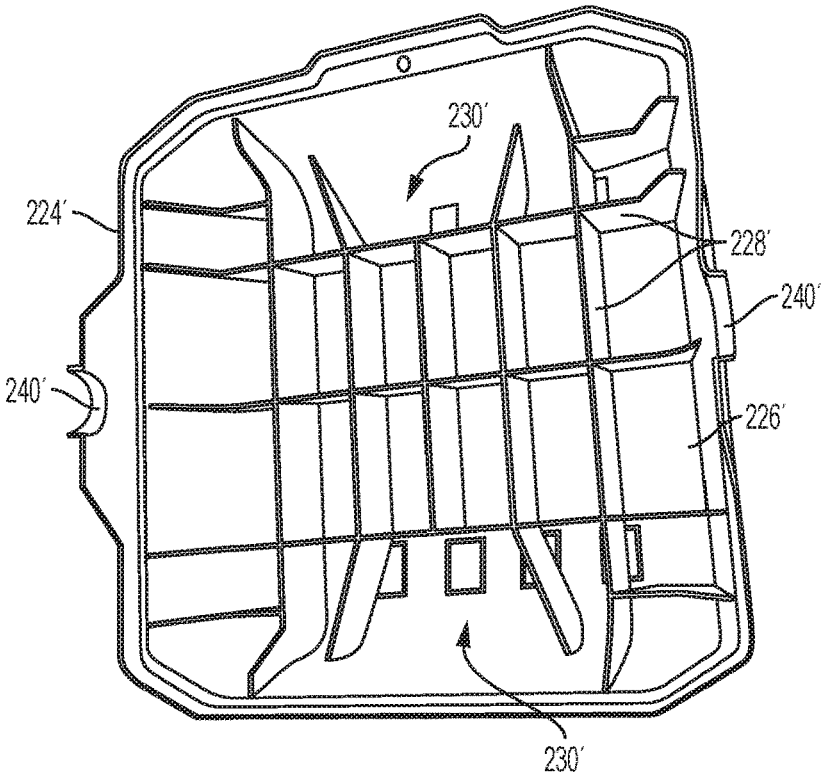
FIG. 64 is a perspective view of a lid of the device of FIG. 61.

With reference to FIG. 64, an underside 226' of the lid 224' includes ribs 228' that provide greater strength/rigidity to the lid 224', define compartments 230' with extra clearance for long items stored vertically within the container 222' or to organize small items (e.g., fasteners, bits, etc.) when the lid 224' is removed from the container 222'. The outer portions of the ribs 228' provide the location for attachment of the lid 224' to the bottom of the container 222'.

The tool storage device 220' further includes a handle 232' pivotally coupled to opposing sidewalls 234', 236' of the container 222'. The handle 232' includes receptacles 238' (FIG. 62) configured to receive arcuate projections 240' (FIG. 64) on the lid 224' when the lid 224' is in the closed position, to selectively lock the lid 224' in place. The handle 232' is pivotable between an unlocked position (FIG. 62), in which the arcuate projections 240' are insertable into the receptacles 238' through apertures 242', and a locked position (FIG. 65), in which the apertures 242' are misaligned with the arcuate projections 240' to prevent removal of the lid 224' from the container 222'. With continued reference to FIG. 65, the lid 224' and the container 222' collectively define an aperture 244' to receive an external lock (e.g., a padlock, not shown) to further secure the lid 224' to the container 222'. The external lock can interfere with movement of the handle 232' to retain the handle 232' in the locked position.

Figure 62:
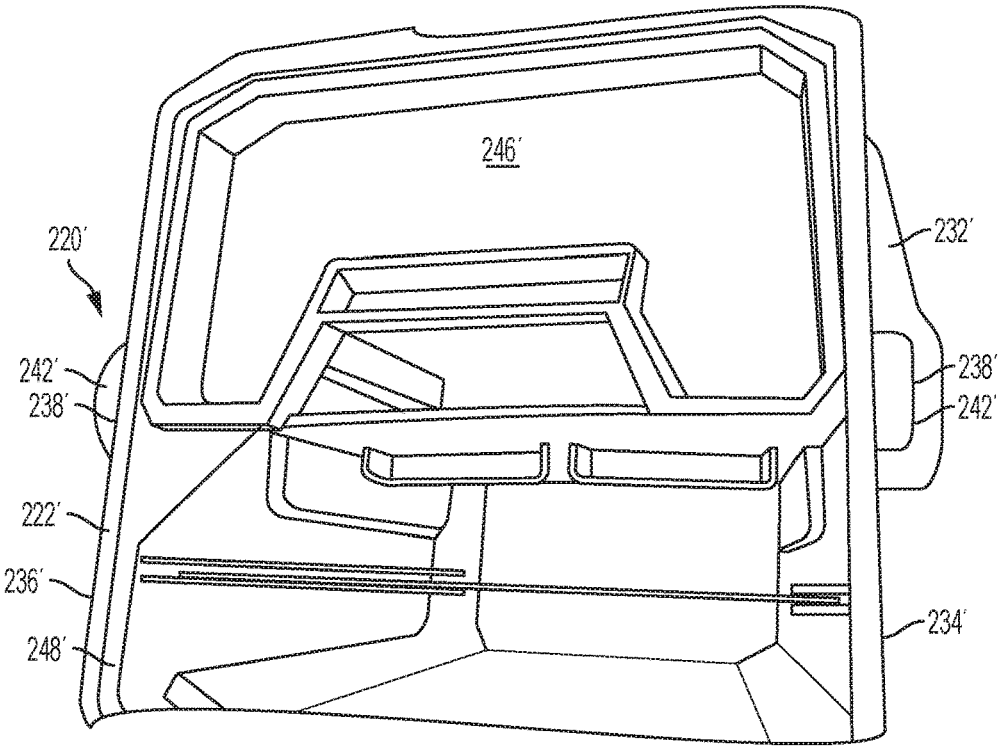
FIG. 62 is a perspective view of the device of FIG. 61, illustrated with a tray.
Figure 63:
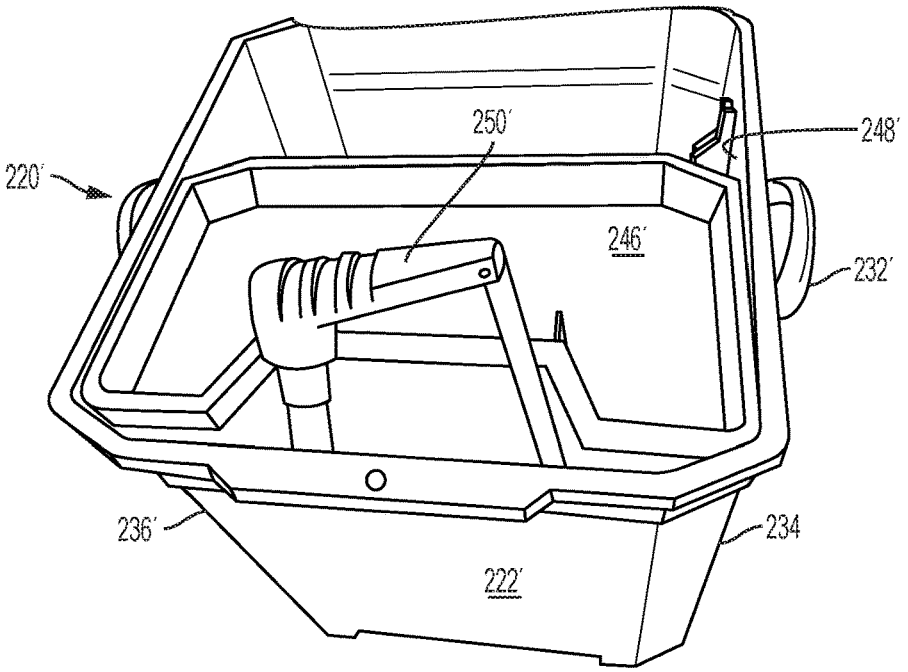
FIG. 63 is a perspective view of the device of FIG. 61, illustrated with the tray partially supporting a hack saw in the device.

Referring to FIGS. 62-63, the tool storage device 220' can include a tray 246' removably positioned in an upper portion 248' of the container 222'. The tray 246' may be particularly suitable for storing small items, such as a small tools, bits, fasteners, personal items (wallet, keys, cell phone), safety glasses, etc. The tray 246' can also act as a guide for positioning relatively long items (e.g., a hacksaw 250') in an upright position in the container 222' (FIG. 63).

Figure 66:
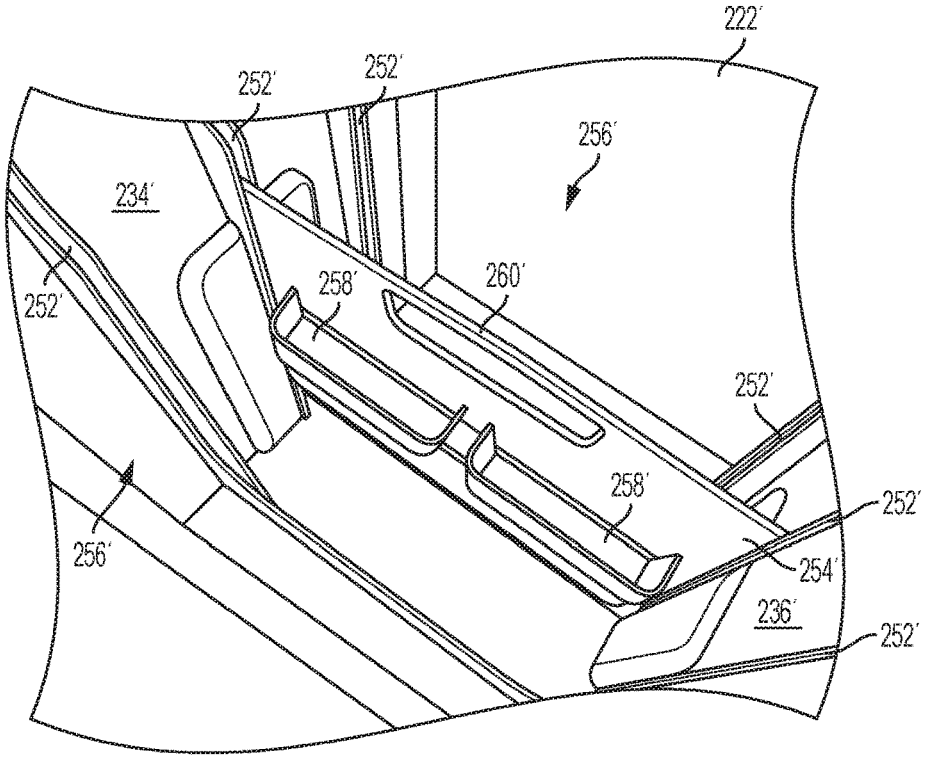
FIG. 66 is a perspective view of the device of FIG. 61, illustrated with a divider.
Figure 67:
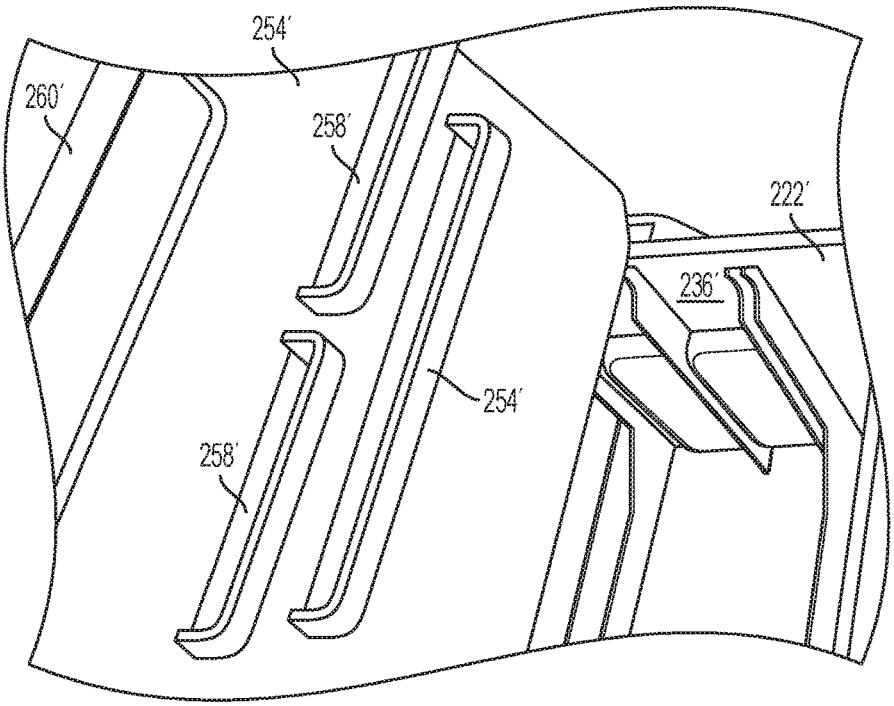
FIG. 67 is a perspective view of the divider shown in FIG. 66, illustrated removed from the device.

With reference to FIGS. 66-67, the sidewalls 234', 236' of the container 222' include slots 252' for receiving a divider 254'. The divider 254' can separate the container 222' into a plurality of compartments 256'. The divider 254' includes receptacles 258' for storing hand tools, such as screw drivers, wrenches, and the like. The divider 254' also includes a handle 260' to facilitate insertion/removal of the divider 254' from the container 222'. When removed, the divider 254' can be used separately from the tool storage device 220', hung on a wall, hook, etc.

Figure 68:
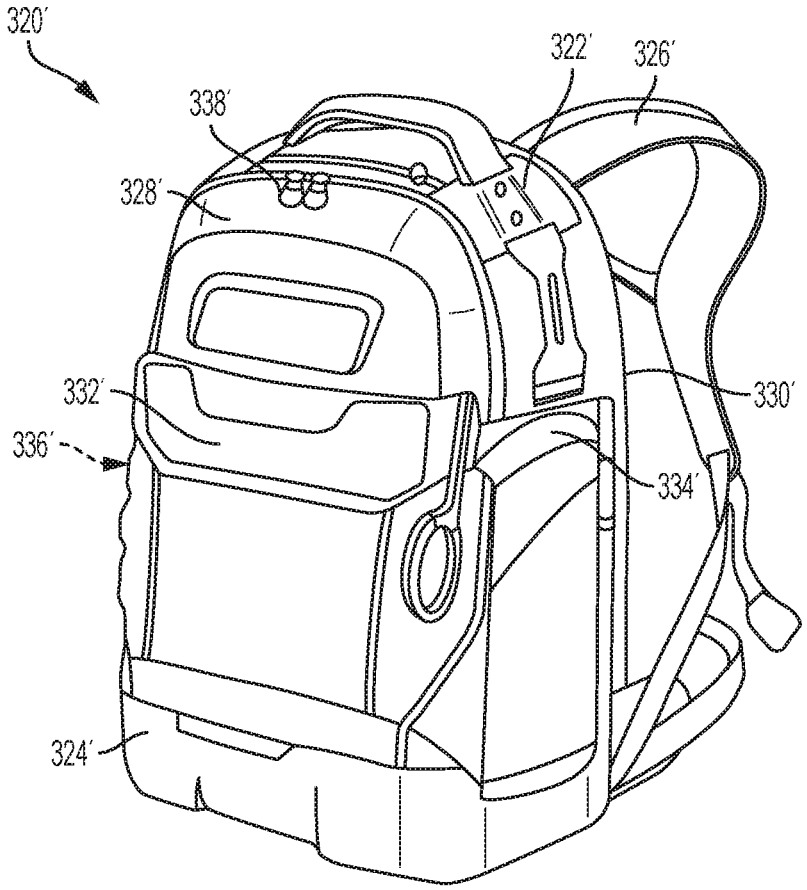
FIG. 68 is a front perspective view of a tool storage device according to another independent embodiment, illustrated in a closed position.
Figure 69:
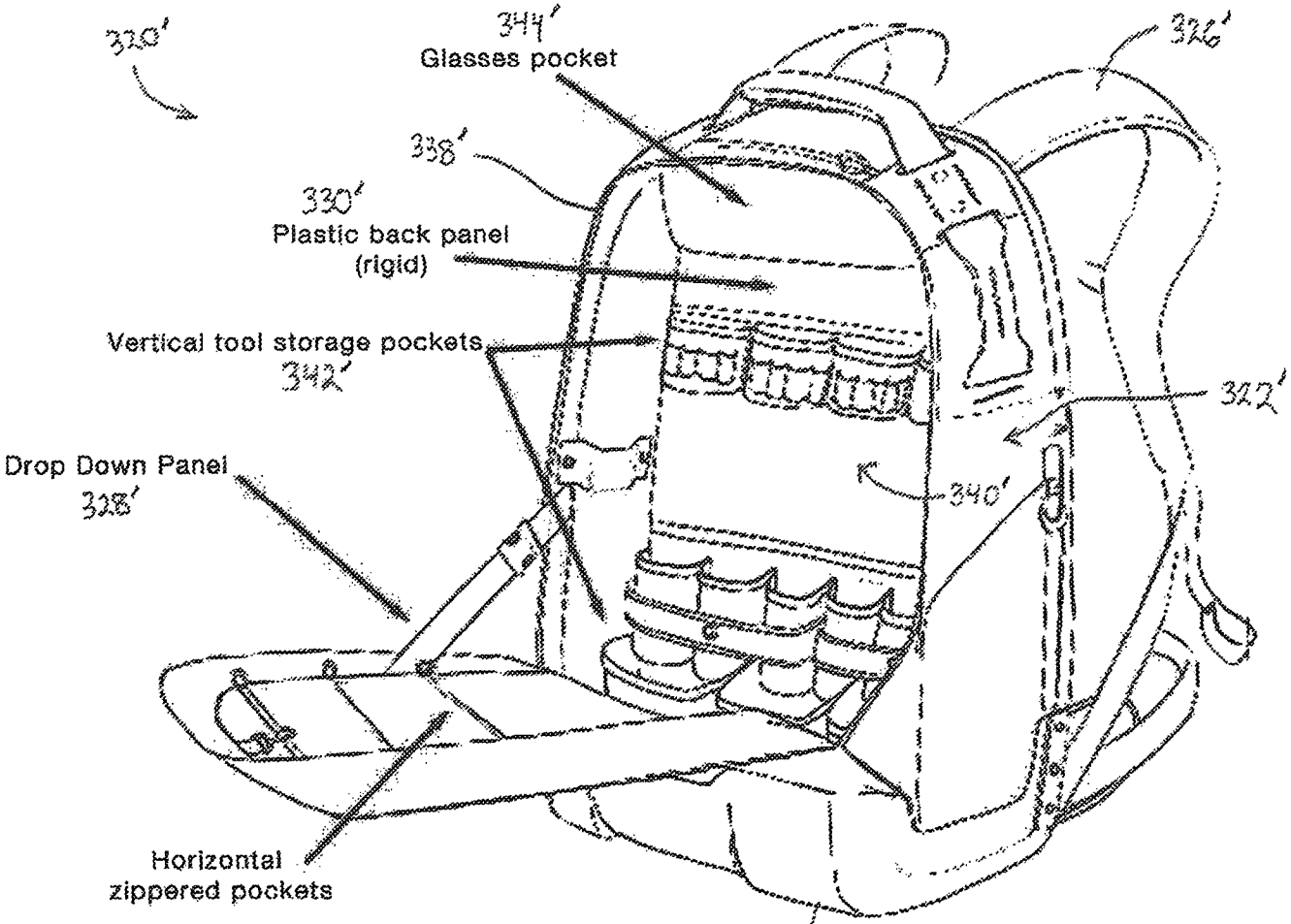
FIG. 69 is another front perspective view of the device of FIG. 68, illustrated in an open position.
Figure 70:
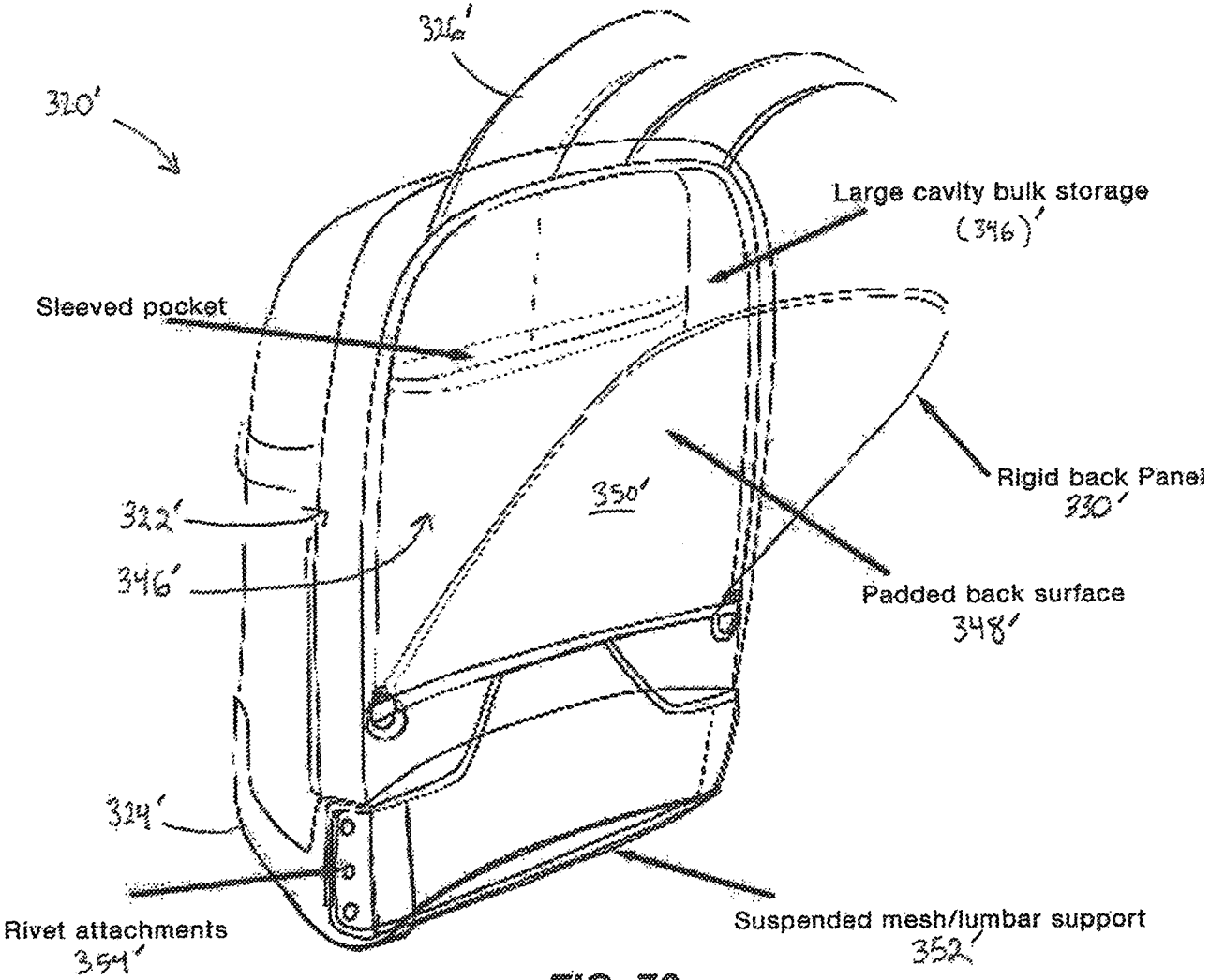
FIG. 70 is a rear perspective view of the device of FIG. 68, with an openable back panel.

FIGS. 68-70 illustrate a tool storage device 320', such as a backpack, including a generally soft, main body 322', a generally rigid, molded base 324' for stable, upright positioning of the tool storage device 320' on a surface (e.g., the ground), and a pair of shoulder straps 326' for carrying the tool storage device 320' as a wearable article.

The main body 322' is disposed between a primary front panel 328' and a generally rigid back panel 330'. A secondary front panel 332' is coupled to the back panel 330' by a compression strap 334'. The compression strap 334' can be tightened to draw the secondary front panel 332' towards the back panel 330', thereby compressing the main body 322' to reduce an overall size of the tool storage device 320'. The secondary front panel 332' can also be moved away from the primary front panel 328' to provide a front storage space 336'. The storage space 336' may be particularly suitable for storing a fish tape reel, for example.

With reference to FIG. 69, the primary front panel 328' is coupled to the main body 322' by a zipper 338' such that the primary front panel 328' can be selectively opened to permit access to a first interior storage compartment 340' of the main body 322'. The first storage compartment 340' includes organizers 342', such as pockets, loops, etc., for neatly storing a variety of tools, devices, etc. (not shown). The first storage compartment 340' also includes a pouch 344' particularly suitable for storing glasses (e.g., sunglasses, safety glasses, etc.).

Referring to FIG. 70, the back panel 330' is coupled to the main body 322' by a zipper (not shown) or other suitable means such that the back panel 330' can be selectively opened to permit access to a second interior storage compartment 346' of the main body 322'. The second storage compartment 346' is particularly suitable for storing large items, such as power tools. The tool storage device 320' further includes padding 348' on a back side 350' of the back panel 330' and a mesh lumbar support 352' suspended away from the back panel 330' for added comfort when the tool storage device 320' is worn by a user. The lumbar support 352' may be at least partially attached to the main body by rivets 354' or other suitable fasteners.

Figure 71:
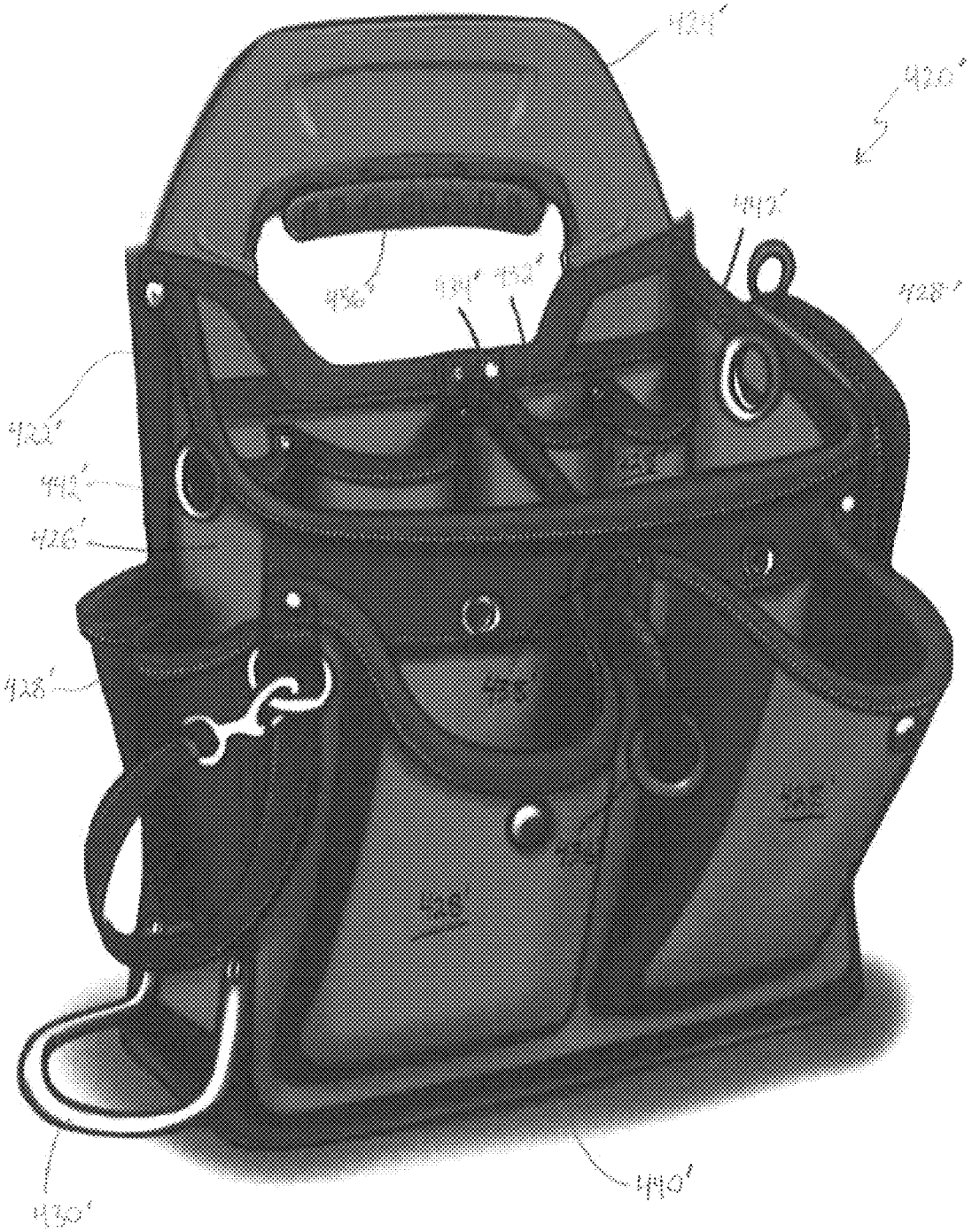
FIG. 71 is a perspective view of a tool storage device according to another independent embodiment.

FIG. 71 illustrates a tool storage device 420', such as a tool pouch or tool carrier, that can be used in conjunction with a tool belt (not shown such as the tool belts described above). The tool storage device 420' includes a back panel 422', a rigid handle 424' extending upwardly from the back panel 422', and a main compartment 426' extending forwardly from the back panel 422'. A variety of pockets 428' are located on the interior and exterior of the main compartment 426' for storing tools, accessories, etc. in a convenient, easily accessible manner. The main compartment 426' and the pockets 428' can be formed from leather, nylon, polyester, or any other durable material. A metal loop 430' coupled to a side of the tool storage device 320' provides a location to store a tool, such as a hammer.

The main compartment 426' can be drawn together by a cinching cord 432' having one end 434' fixed to the back panel 422' and another end 436' extending through a compression fitting 438' on the main compartment 426'. The tool storage device 420' has a generally flat, rectangular base 440' to provide stability when the tool storage device 420' is set upright upon a surface (e.g., the ground). A shoulder strap (not shown) can be secured to a pair of grommets 442' to provide an additional method of carrying the tool storage device 420'.

Figure 72:
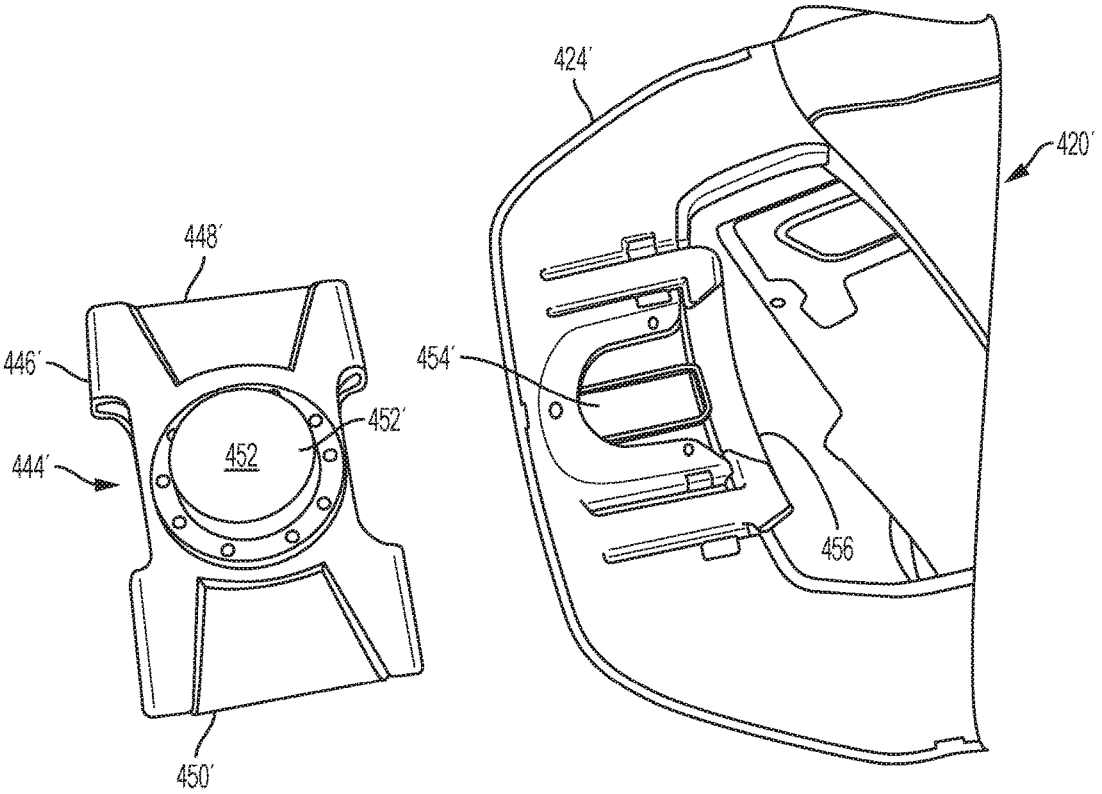
FIG. 72 is a perspective view of a portion of the device of FIG. 71, illustrating an attachment for securing the device to a belt.
Figure 73:
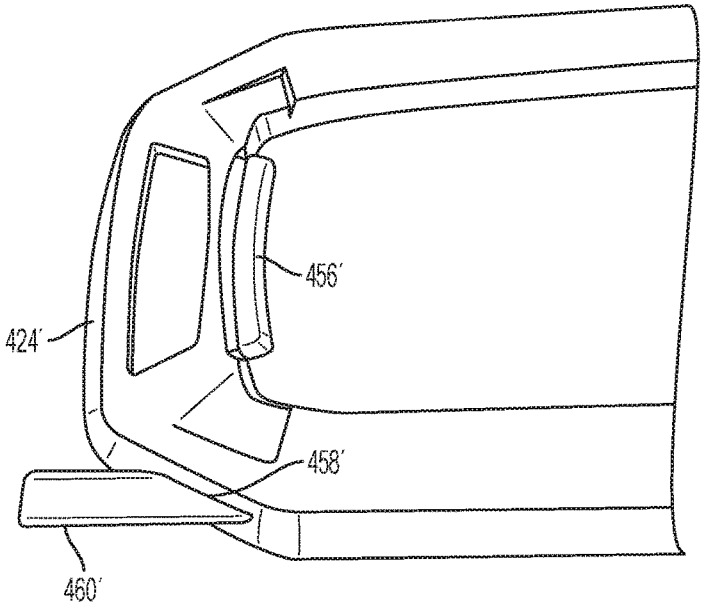
FIG. 73 is a perspective view of another portion of the device of FIG. 71.

FIG. 72 illustrates an attachment 444' that can be slid on to a belt (not shown but similar to the tool belts described above) for coupling the tool storage 420' device to the belt. The attachment 444' includes a body 446' having two open ends 448', 450' through which the belt extends when the attachment 444' is positioned on the belt, and a round projection 452' extending transversely from the body 446'. The handle 424' of the tool storage device 420' includes a receptacle 454' that allows the tool storage device 420' to be slid or otherwise manipulated on to the projection 452' of the attachment 444'. The tool storage device 420' is able to freely rotate about the round projection 452' to maintain the tool storage device 420' in a generally vertical orientation, regardless of the orientation of the belt. The handle 424' includes an actuating portion 456' surrounding the receptacle 454' to facilitate disengaging the projection 452' from the receptacle 454' (e.g., to remove the tool storage device 420' from the attachment 444' and belt). The handle 424' can include (see FIG. 73) one or more compartments 458' for storing accessories 460', such as a pen or a pencil.

In some embodiments, the attachment 444' can be adapted for mounting the tool storage device 420' on another support, such as a wall, post, etc. In other embodiments, the attachment 444' can be adapted to have two projections 452' extending from opposite sides of the body 446' for coupling two tool storage devices 420' together.

Figure 74:
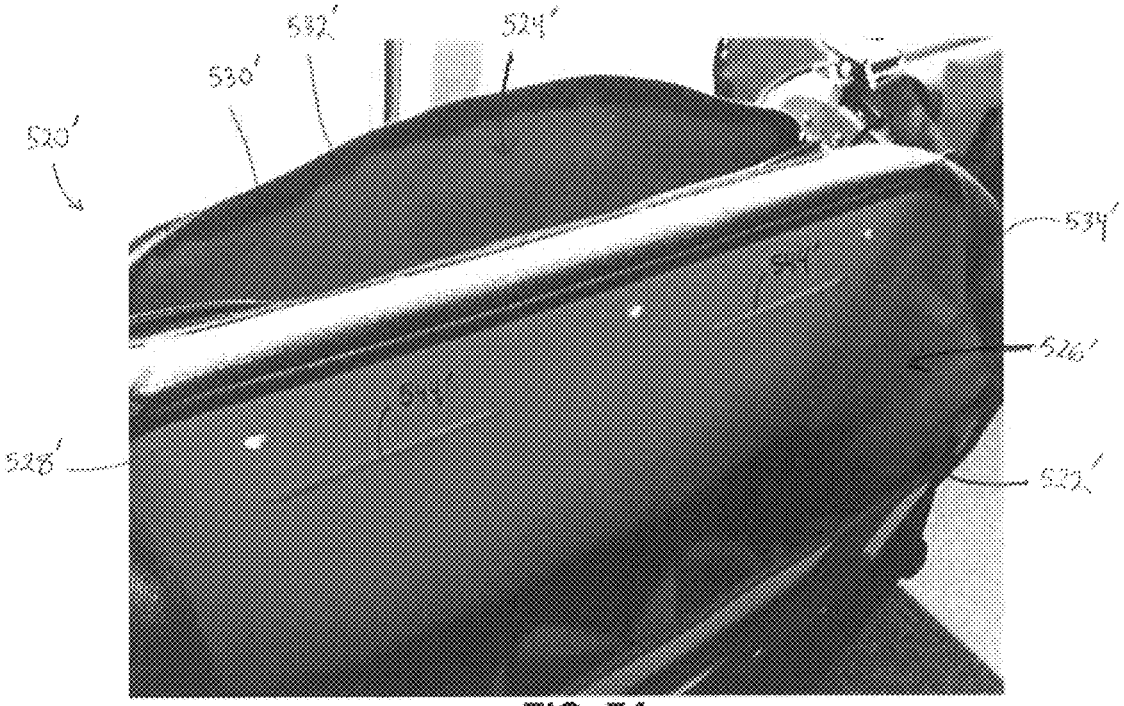
FIG. 74 is a perspective view of an interior of a tool storage device according to another independent embodiment.

FIG. 74 illustrates a tool storage device 520', such as a tool bag, including a generally soft-sided body 522' with a first compartment 524' and a second compartment 526' separated by a central wall 528'. The body 522' further includes a zippered cover 530' having a first portion 532' to selectively open and close the first compartment 524' and a second portion 534' to selectively open and close the second compartment 526'. The cover portions 532', 534' are independently openable and closeable. In the illustrated embodiment, the inner surfaces of the body 522' and the cover 530' are light colored (e.g., red) such that the interior of the tool storage device 520' is brighter and more visible (compared to a black interior).

Figure 75:
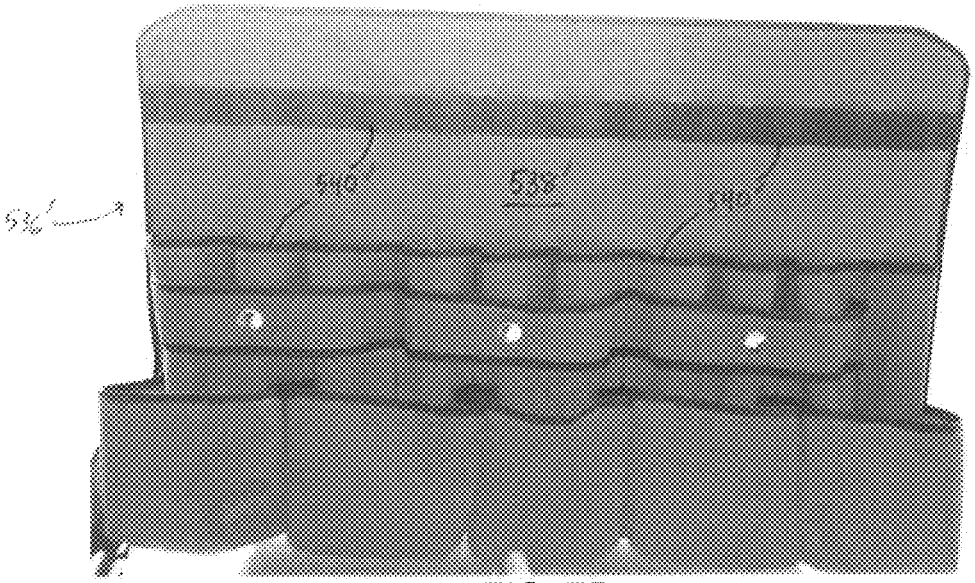
FIG. 75 is a front view of an insert of the device of FIG. 74.

FIG. 75 illustrates an insert 536' for use with the tool storage device 520'. The insert 536' includes a generally-rigid body 538' and organizers 540' (pockets, loops, etc.) attached to the body 538' for storing a variety of tools and/or accessories. The body 538' can include hooks, grommets, straps, or other means suitable for hanging the insert 536' on a wall, hook, etc.

Figure 76:
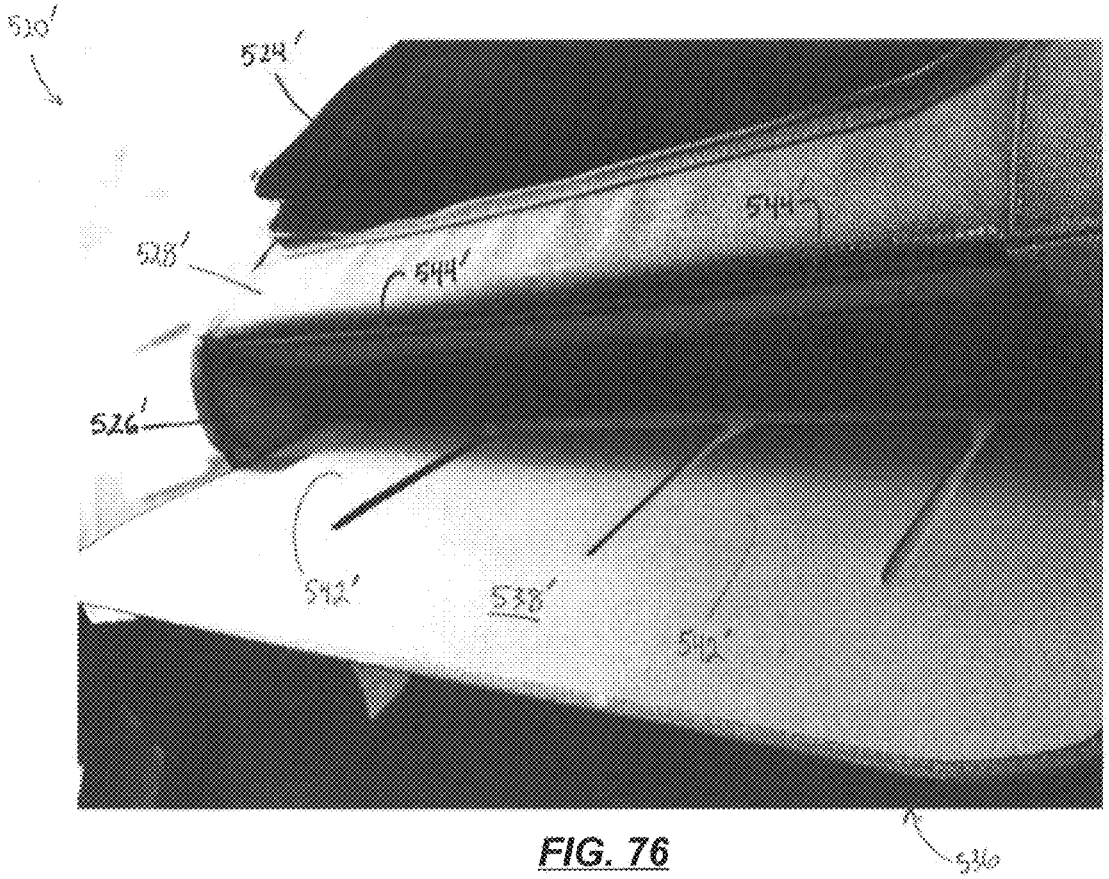
FIG. 76 is a perspective view of the device of FIG. 74, illustrated receiving the insert of FIG. 75.

The insert 536' includes (see FIG. 76) tongues 542' insertable into complementary slots 544' in the central wall 528' to secure the insert 536' to the central wall 528'. In other embodiments, the insert 536' and the central wall 528' can include snaps, fasteners, latches, or other suitable means for selectively securing the insert 536' to the central wall 528'. The central wall 528' can include slots 544' on both sides such that the insert 536' can be positioned within either the first compartment 524' or the second compartment 526'. Alternatively, a user can position two inserts 536' into the first and second compartments 524', 526', respectively.

It should be understood that, except when mutually exclusive or physically incompatible, features of any of the above-described tool storage devices may be used with others of the tool storage devices.

One or more independent features and independent advantages of the invention may be set forth in the following claims:

What is claimed is:

1. A tool storage device comprising:

flexible walls cooperating to define a storage area to receive tools, the walls including a bottom wall, a top wall and a plurality of side walls extending between the bottom wall and the top wall;

a rigid frame supported in the storage area and including, a first central member having a first central spine extending in a direction from the bottom wall toward the top wall, and a first base portion extending from one side of the first central spine, along the bottom wall and toward one side wall in a direction generally orthogonal with respect to the first central spine, and a second central member separate from the first central member and having a second central spine extending in a direction from the bottom wall toward the top wall, and a second base portion extending from one side of the second central spine, along the bottom wall and toward an opposite side wall in a direction generally orthogonal with respect to the second central spine; and a handle separate from the first central member and the second central member, directly connected to and operable to couple the first central spine and the second central spine by a fastener and engageable by a user.

2. The device of claim 1, wherein the frame divides the storage area into a first area on the one side of the first and second central members and a second area on the opposite side of the first and second central members.

3. The device of claim 2, wherein the one side wall includes a first cover portion movable between an open position to permit access to the first area and a closed position, and wherein the opposite side wall includes a second cover portion movable between an open position to permit access to the second area and a closed position.

4. The device of claim 1, wherein the first central spine is integrally formed with the first base member.

5. The device of claim 1, wherein the handle extends through the top wall.

6. The device of claim 1, further comprising at least one bracket connectable to the first central member and operable to support at least one of a tool, an accessory, and a support pocket.

7. The device of claim 6, wherein the at least one bracket includes a first bracket connectable to the first central member and a second bracket connectable to the second central member.

8. The device of claim 6, wherein the at least one bracket includes a first bracket and a second bracket connectable to the first central member.

9. The device of claim 6, wherein the bracket defines an opening, and wherein the device further comprises a support pocket including a pocket portion operable to support at least one of a tool and an accessory and a flange engageable in the opening to removably connect the support pocket to the bracket.

10. The device of claim 1, wherein the first central member and the second central member are formed from stamped aluminum.

11. The device of claim 10, wherein the handle is made of an elastomeric material.

12. The device of claim 1, wherein the first central spine, the second central spine, and the handle each include an aperture, the fastener being receivable through the apertures to connect the first central member, the second central member, and the handle.

* * * * *